US008387500B2

(12) United States Patent
Kato

(10) Patent No.: US 8,387,500 B2
(45) Date of Patent: Mar. 5, 2013

(54) SLUG FLOAT-UP PREVENTING MECHANISM

(75) Inventor: Fumio Kato, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 0 days.

(21) Appl. No.: 13/249,928

(22) Filed: Sep. 30, 2011

(65) Prior Publication Data

US 2012/0017734 A1 Jan. 26, 2012

Related U.S. Application Data

(62) Division of application No. 10/515,632, filed as application No. PCT/JP03/07205 on Jun. 6, 2003, now abandoned.

(30) Foreign Application Priority Data

Jun. 7, 2002 (JP) ..... 2002-166876
Jul. 19, 2002 (JP) ..... 2002-210883
Nov. 7, 2002 (JP) ..... 2002-323501

(51) Int. Cl.
*B26F 1/14* (2006.01)

(52) U.S. Cl. ..... 83/552; 83/684

(58) Field of Classification Search ..... 83/24, 98, 83/99, 109, 137, 145, 149, 169, 177, 690, 83/102, 552, 454, 549; 234/42, 43, 44
See application file for complete search history.

(56) References Cited

U.S. PATENT DOCUMENTS 1,370,116 A 3/1921 Johnson
1,958,705 A 5/1934 Klein
2,049,624 A 8/1936 Ronning
2,660,245 A 11/1953 Marsh
2,837,161 A 6/1958 Taylor et al.
3,465,959 A * 9/1969 Hoffman ..... 234/114
3,580,120 A 5/1971 Adams et al.
3,710,666 A 1/1973 Keyes et al.
3,715,947 A 2/1973 Weisbeck et al.
3,738,569 A * 6/1973 Killaly, Sr. ..... 234/43
3,935,755 A * 2/1976 Daniels ..... 74/815
4,412,469 A * 11/1983 Hirata et al. ..... 83/552
4,656,900 A * 4/1987 Herrington ..... 83/24
4,821,614 A * 4/1989 Fleet et al. ..... 83/100
5,168,610 A * 12/1992 Ichimura et al. ..... 29/33 J
5,205,149 A * 4/1993 Hayashi ..... 72/446
5,259,100 A * 11/1993 Takahashi ..... 29/33 J
5,361,660 A * 11/1994 Tsubota ..... 83/55
5,379,826 A * 1/1995 Miwa et al. ..... 164/4.1
5,402,564 A * 4/1995 Tsukasaki et al. ..... 29/832
5,787,775 A * 8/1998 Stevens et al. ..... 83/34
5,860,481 A * 1/1999 Prokop et al. ..... 173/207
5,907,985 A 6/1999 Bezama et al.
6,003,418 A 12/1999 Bezama et al.

(Continued)

FOREIGN PATENT DOCUMENTS

EP 0338211 2/1989
JP 52-50475 11/1977

(Continued)

*Primary Examiner* — Sean Michalski
(74) *Attorney, Agent, or Firm* — Greenblum & Bernstein P.L.C.

(57) ABSTRACT

A scrap floating prevention mechanism comprises: a die holder formed with a first communication pipe which sends compressed fluid; a mounting table formed with a second communication pipe which comes into communication with the first communication pipe and which sends compressed fluid to the first communication pipe, the die holder being placed on and fixed to the mounting table; and a fluid injecting member which is formed with a plurality of inclined injecting pipes for injecting compressed fluid from the first communication pipe and which is provided below the die.

8 Claims, 44 Drawing Sheets

U.S. PATENT DOCUMENTS

| | | | | |
|---|---|---|---|---|
| 6,109,159 | A | 8/2000 | Seto | |
| 6,401,581 | B1 | 6/2002 | Sand | |
| 6,634,269 | B2 * | 10/2003 | Eckstein et al. | 83/100 |
| 7,479,004 | B2 | 1/2009 | Naito et al. | |

FOREIGN PATENT DOCUMENTS

| | | | |
|---|---|---|---|
| JP | 2-155519 | | 6/1990 |
| JP | 05-261454 | * | 10/1993 |
| JP | 5-261454 | | 10/1993 |
| JP | 7-155865 | | 6/1995 |
| JP | 8-150433 | | 6/1996 |
| JP | 10-166082 | | 6/1998 |
| JP | 2001071061 | * | 9/1999 |
| JP | 11-320000 | | 11/1999 |
| JP | 2000-051966 | | 2/2000 |
| JP | 2004-0010055 | | 1/2004 |
| WO | 03/106066 | | 12/2003 |
| WO | WO 03//106066 | * | 12/2003 |

* cited by examiner

Prior Art

Prior Art
FIG.8
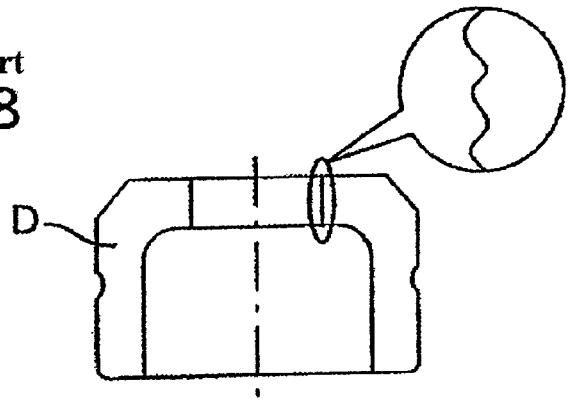
Prior Art
FIG.10
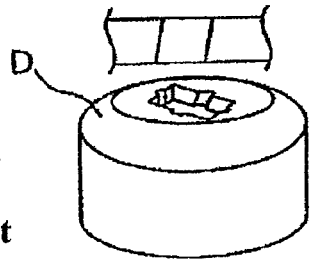
FIG.9
Prior Art
Prior Art
FIG.11
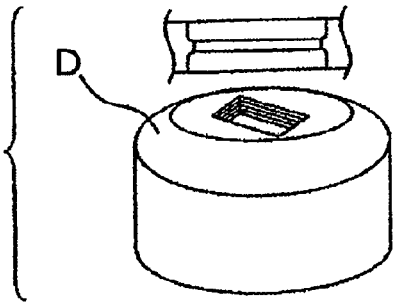
Prior Art
FIG.12
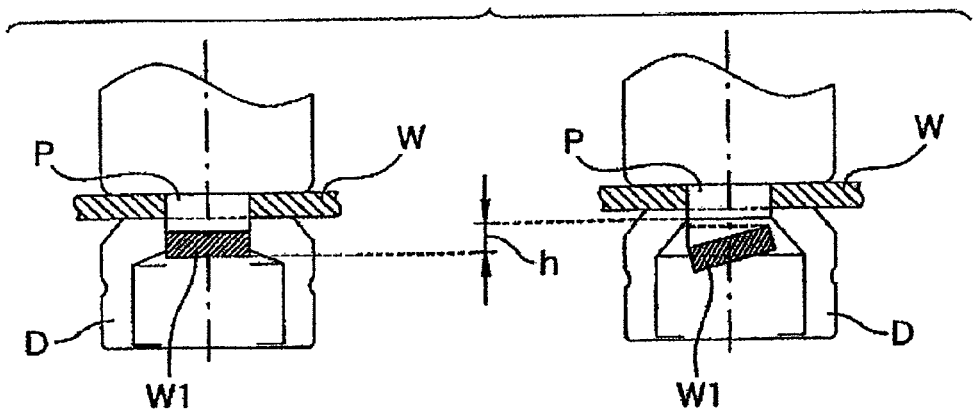

SLUG FLOAT-UP PREVENTING MECHANISM

CROSS-REFERENCE RELATED APPLICATIONS

The present application is a division of U.S. application Ser. No. 10/515,632, filed Dec. 6, 2004, which is a National Stage Application of PCT/JP03/7205, filed Jun. 6, 2003, the disclosures of which incorporated herein by reference in their entireties.

TECHNICAL FIELD

The present invention relates to a scrap floating prevention mechanism which can be applied to a punch press and to a metal mold having a large bore, a small metal mold, and a metal mold having a rotation mechanism.

BACKGROUND ART

As shown in FIG. 1, for example, a conventional turret punch press includes an upper turret 96 and a lower turret 97. A punch P is mounted on the upper turret 96 through a punch holder 94. A die D is mounted on the lower turret 97 through a die holder 95.

With this structure, when a striker (not shown) strikes the punch P, the punch P goes down, and the punch P punches a workpiece W grasped by a clamp 93 in cooperation with the die D.

A punched-out or die-cut scrap W1 produced by punching the workpiece W naturally drops into a scrap discharge hole 90 and is collected in a scrap bucket provided in the turret punch press.

After the punching operation, the punch P rises and returns to its original position.

However, the scrap W1 (FIG. 1) produced by punching the workpiece W sticks on a tip end of the punch P, and when the punch P rises, the scrap W1 also floats and sticks on an upper surface of the workpiece W in some cases.

As a result, the workpiece W is damaged and this deteriorates quality thereof.

Japanese Utility Model Publication No. S52-50475 (FIG. 2) and Japanese Patent Application Laid-open No. 2000-51966 (FIG. 3) disclose mechanisms for preventing such scrap floating.

In these conventional techniques, an air jet hole 91 (FIG. 2), 92 (FIG. 3) connected to an air source is downwardly inclined through a predetermined angle θ.

This structure can be applied to a punch press, but cannot be applied to a turret punch press which has a plurality of metal molds disposed on a rotatably turret and which rotation-indexes the metal molds, thereby selecting a desired one of the metal molds and carrying out the punching operation. However, the scrap floating prevention mechanism shown in each of FIGS. 2 and 3 has a single fixed metal mold.

FIGS. 4 to 12 show scrap floating prevention mechanisms applied to a turret punch press.

Among the scrap floating prevention mechanisms, in the scrap floating prevention mechanism shown in FIGS. 4 to 7, a stroke amount H of the punch P is increased (FIGS. 4 and 5), the punch P is provided at its tip end with a scrap pusher 98 (FIG. 6), or by forming the tip end of the punch P with oblique angle (FIG. 7), the scrap W1 is forcibly dropped, thereby preventing the scrap floating.

According to the scrap floating prevention mechanism shown in FIGS. 8 to 12, the roughness of an inner surface of the die D is increased (FIG. 8), the inner surface of the die D is formed with a groove (FIGS. 9 and 10), the inner surface of the die D is formed with a projection (FIG. 11), or a straight portion of a blade of the die D is shortened (by an amount h shown in FIG. 12, for example) to make the die D thin, the friction force between the die D and the scrap W1 is increased so that the scrap W1 does not float together with the punch P, thereby preventing the scrap floating.

However, in the case of the scrap floating prevention mechanism obtained by devising the metal molds P and D shown in FIGS. 4 to 12, the mechanism is limited to the size of the metal mold, and the mechanism cannot easily be applied to a small metal mold in some cases. Further, since the metal molds P and D is subjected to additional work or the metal mold is formed into special shape, the mechanism cannot be applied to a standard metal mold, and a special metal mold is required. As a result, the cost is increased.

In another mechanism for preventing the scrap floating, there is one in which a tip end of the punch P is provided with a scrap pusher, or air is utilized (for example, Japanese Patent Application No. 2002-166876).

According to such a scrap floating prevention mechanism, however, when the metal mold has a large bore and a thin blade in which sizes of a cutting edge of the punch P and a cutting edge of a die hole corresponding to the former cutting edge are 5 mm×40 mm, only little effect is exhibited.

That is, when a metal mold has a large bore and a thin blade, the width of the punch P is small and it is difficult to provide a scrap pusher.

In a scrap floating prevention mechanism utilizing air, the die D is placed on an ejector pipe or a nozzle member, and a side surface of the ejector pipe or the nozzle member is provided with a plurality of air injecting ports.

Therefore, when vertical positions of the air injecting ports are located away from the die holes for punching the workpiece W and when the metal mold has a large bore and a thin blade, the ejector pipe and the nozzle member also become large bores. Therefore, lateral positions of the air injecting ports are separated from a central portion.

As a result, a negative pressure generating position is far from the die hole and the generated negative pressure itself is small and thus, an amount of outside air sucked from the die hole is reduced, and air suction force becomes small. Therefore, a large scrap W1 (for example, 5 mm×40 mm) generated when the workpiece W is punched cannot be discharged.

The scrap floating prevention mechanism utilizing air is formed with an extremely wide scrap discharge hole below the die D. Thus, outside air sucked from the die hole is dispersed in this wide scrap discharge hole, and the sucking effect is small.

In the scrap floating prevention mechanism using air explained in the above conventional example (Japanese Patent Application No. 2002-166876), a die holder 95 on which the die D is mounted is fixed, and this mechanism cannot be applied to a rotatable die holder.

That is, as is well known, the punch holder 94 and the die holder 95 are mounted on a rotatably punch receiver and a rotatable die receiver, respectively, predetermined punch P and die D whose punching shapes have directivity are positioned on a punching center and then, the punch P and the die D are rotated through predetermined angles and the workpiece W is punched in some cases.

In a turret punch press having such a metal mold rotation mechanism, however, air for preventing scrap floating cannot be supplied in the conventional technique. Thus, a scrap W1 generated during the punching operation cannot be discharged and as a result, an application range of the scrap floating prevention mechanism using air is narrowed.

In other words, the conventional scrap floating prevention mechanism using air can be applied only to a case where the metal molds P and D is fixed, and when the metal molds P and D can rotate, the scrap floating prevention mechanism cannot be applied.

The present invention has been achieved in order to solve the above problems, and it is a first object of the invention to provide a scrap floating prevention mechanism, a die apparatus, a die, and a nozzle member which can be applied to a punch press, and to a metal mold having a large bore, a small metal mold, and a metal mold having a rotation mechanism.

It is a second object of the invention to provide a die apparatus, a die, and a nozzle member having a scrap floating prevention mechanism which can be applied to a metal mold having a thin blade.

It is a third object of the invention to provide a scrap floating prevention mechanism which can be applied to a rotating metal mold by making it possible to supply air in a punch P having a metal mold rotation mechanism even when the metal mold is positioned with any angle.

DISCLOSURE OF THE INVENTION

To achieve the above object, in a turret punch press in which metal molds comprising a plurality of punches P and dies D are disposed on rotatable upper turret 6 and lower turret 7, a desired one of the metal molds is selected at a punch center C, and a workpiece positioned on the punch center C is subjected to predetermined punching work, a first aspect of the present invention provides a scrap floating prevention mechanism comprises: an air supply port 28 provided in an upper surface of a disk support 24 disposed at the punch center C; an air introducing port 29 which is in communication with a scrap discharge hole 35 located below the die D at a location on a lower surface of the lower turret 7 corresponding to a location directly above the air supply port 28; and a nozzle member 46 including a plurality of injecting ports 32 which have discharge holes 47 capable of coming into communication with a die hole 53 formed in the die D for punching a workpiece W and which are downwardly inclined toward the discharge holes 47 for injecting air A, and an introducing portion 31 for introducing air A into each injecting port 32.

The nozzle member 46 having the discharge hole 47 which is in communication with the die hole 53 is provided below the die D, the nozzle member 46 is provided with the plurality of injecting ports 32 which are downwardly inclined toward the discharge hole 47 and which inject air A and with the introducing portion 31 for introducing air A to the injecting ports 32.

A die apparatus is characterized such that the nozzle member 46 having a plurality of injecting ports 32 for injecting air A to downwardly such the scrap W1 punched out from the workpiece W by the die hole 53 is provided below the die D, the die holder 23 is provided with a communication pipe 30 which is in communication with the introducing portion 31 for introducing air A to the nozzle member 46 and which supplies air A.

Therefore, according to the structure of the present invention, when three dies D are mounted on the die holders 23 on the lower turret 7 in the radial direction in accordance with the number of tracks T1, T2, and T3, three air supply ports 28 are provided on the upper surface of the disk support 24 in correspondence with the three dies D, and three air introducing ports 29 are provided for each die holder 23 on the lower surface of the lower turret 7 at locations corresponding to positions directly above the air supply port 28. With this structure, when the turrets 6 and 7 are rotated in synchronism with each other and the die holder 23 on which a desired die D on the lower turret 7 to be selected is positioned on the punch center C, the corresponding air introducing port 29 provided on the lower surface of the lower turret 7 is positioned directly above the air supply port 28 provided on the upper surface of the disk support 24.

In this state, when the switching valve 34 is switched such as to match the track positions C1, C2, and C3 of the striker 2, only one of the three air supply ports 28 is connected to the air source 25, and air is injected only to the scrap discharge hole 35 below the selected die D. With this structure, a negative pressure is generated below the die hole 53, the scrap W1 generated when the workpiece W is worked is strongly ducked downward from the die hole 53, and the scrap W1 passes through the scrap discharge hole 35 from the scrap escape hole 45 and is discharged outside. Therefore, scrap floating is prevented.

With this structure, the scrap floating prevention mechanism, the nozzle member, the die, and the die apparatus of the present invention can be applied also to a turret punch press. Since the scrap floating is prevented using air A, the invention can be applied to a standard metal mold and a small metal mold as compared with the conventional technique in which metal molds P and D is devised.

Therefore, according to the present invention, it is possible to provide the scrap floating prevention mechanism, the nozzle member, the die, and the die apparatus which can be applied to the turret punch press, as well as to the standard metal mold, and the small metal mold.

To achieve the second object, a metal mold apparatus according to a second aspect of the present invention comprises: a die D having a die hole 153 for punching a workpiece W; a plurality of injecting ports 132 which incorporate, in the die D, a nozzle member 146 having a discharge hole 47 which is in communication with the die hole 153, and which are downwardly inclined toward the discharge hole 47 for injecting air A; and an introducing portion 131 provided in the nozzle member 146 for introducing air A into the injecting ports 132.

Therefore, according to the structure of the present invention, an opening of the discharge hole 147 of the nozzle member 146 incorporated in the die D is set slightly larger than that of the die hole 153, and a duct 149 which is in communication with the discharge hole 147 of the nozzle member 146 and which has an opening slightly larger than that of the discharge hole 147. Thus, the plurality of injecting ports 132 which are downwardly inclined toward the discharge hole 147 and which inject air A are closer to the die hole 153, and are collectively provided in a smaller region in the vicinity of a central portion, and the duct 149 is disposed in the wide scrap discharge hole 135 below the die D.

With this structure, air injected from the injecting ports 132 is converged to the position C in the duct 49, a position where the negative pressure is generated around the position C becomes closer to the die hole 153, the negative pressure is increased, air B sucked from outside through the die hole 153 by the negative pressure is not dispersed and converged to the inside of the duct 149 and thus, the suction of air B is increased. When the workpiece W is punched by a large bore and thin blade metal mold, a thin and long scrap W1 of 5 mm×40 mm is generated, but the scrap W1 is strongly sucked by air B having the great suction and is discharged outside.

Thus, according to the invention, it is possible to provide a die metal mold having a scrap floating prevention mechanism which can be applied to the large bore and thin blade metal mold.

To achieve the third object, a third aspect of the present invention provides a die apparatus in which a die D having a die hole 253 for punching a workpiece W is mounted on a die holder 223, and the die holder 223 is mounted on a rotatable die receiver 264, the die apparatus comprises: an annular groove 231*a* which is provided in an outer surface of the rotatable die receiver 264 and which circulates air A supplied from outside; and an air introducing portion which introduces air A into the plurality of injecting port 232 which are downwardly inclined toward the scrap discharge hole 235.

Therefore, according to the mechanism of present invention, since the outer surface of the rotatable die receiver 264 is provided with the annular groove 231*a*, when a plurality of injecting port 232 are provided in the ejector pipe 233 inserted into the opening 241 of the die receiver 264, for example, when the air introducing portion comprises a horizontal through holes 231*b* which is in communication with the annular groove 231*a* and an annular groove 2231*c* in an outer surface of the ejector pipe 233 which is in communication with the through holes 231*b* and the injecting ports 232, air A supplied from outside is injected from the injecting ports 232 from the air introducing portion from the annular groove 231*a* no matter what angle (for example, a) the die D is positioned, and the air A is converged to the position E in the ejector pipe 233. Therefore, a negative pressure is generated below the die hole 253, air B is sucked from outside through the die hole 253, and the scrap W1 generated when the workpiece W is worked is strongly sucked and discharged outside.

Therefore, according to the present invention, in a punch press having a metal mold rotation mechanism, air A can be supplied no matter what angle the metal molds P and D is positioned. Thus, the scrap floating prevention mechanism using air can be applied also to the rotating metal mold, and its application range is increased.

According to a scrap floating prevention mechanism of a fourth aspect of the present invention, in a turret punch press in which desired one of metal molds comprising a plurality of punches and dies disposed on rotatable upper turret and lower turret is selected at a punch center and a workpiece positioned on the punch center is subjected to predetermined punching work, an air support port is provided on an upper surface of a disk support disposed on the punch center; and an air introducing port which is in communication with a scrap discharge hole below the die is provided in a position on a lower surface of the lower turret corresponding to a location directly above the air supply port.

A fifth aspect of the present invention provides the scrap floating prevention mechanism according to the fourth aspect, wherein when a plurality of dies are mounted on each die holder on the lower turret in a radial direction in accordance with the number of tracks, a plurality of air supply ports are provided to correspond to the plurality of dies, and a plurality of air introducing ports are provided in each die holder.

A sixth aspect of the present invention provides the scrap floating prevention mechanism according to the fourth or fifth aspect, wherein connections between the air supply ports and an air source is switched in accordance with a track position of a striker so that only corresponding one of the air supply ports is connected to the air source, and air is injected only to a scrap discharge hole below the selected die.

A seventh aspect of the present invention provides the scrap floating prevention mechanism according to the fourth, the fifth, or the sixth aspect, wherein an ejector pipe on which the die is placed is inserted into the scrap discharge hole, and the ejector pipe is provided at its side surface with a plurality of downwardly inclined injecting ports which are in communication with the air introducing port on the lower surface of the lower turret.

A nozzle member according to an eighth aspect of the present invention includes a discharge hole which can be in communication with a die hole formed in a die, a plurality of injecting ports which inject air downwardly toward the discharge hole, and an introducing portion for introducing air to the injecting ports.

A ninth aspect of the present invention provides the nozzle member according to the eighth aspect, wherein the introducing portion comprises a groove formed in an outer peripheral surface.

A die according to a tenth aspect of the present invention includes a die hole for punching a workpiece, a nozzle member provided below the die and having a discharge hole which is in communication with the die hole, the nozzle member includes a plurality of injecting ports for injecting air downward toward the discharge hole, and an introducing portion for introducing air to each injecting port.

A die apparatus according to an eleventh aspect of the present invention has a die including a die hole for punching a workpiece, the die is detachably attached to a die insertion hole of a die holder, a nozzle member having a plurality of injecting ports for injecting air to downwardly suck a scrap punched out from the workpiece by a die hole is provided below the die, and the die holder is provided with a communication pipe which is in communication with the introducing portion for introducing air to the nozzle member.

A twelfth aspect of the present invention provides the die apparatus according to the eleventh aspect, wherein the communication pipe is in communication with the introducing portion through a horizontal pipe or a vertical pipe.

According to a die metal mold of a thirteenth aspect of the present invention, in a die having a die hole for punching a workpiece, a nozzle member having a discharge hole which is in communication with a die hole is incorporated in the die, and the nozzle member is provided with a plurality of injecting ports for downwardly injecting air toward the discharge hole and an introducing portion for introducing air to each injecting port.

A fourteenth aspect of the present invention provides the die metal mold according to the thirteenth aspect, wherein an opening of the discharge hole of the nozzle member is set slightly larger than that of the die hole, and there is mounted a duct which is in communication with the discharge hole of the nozzle member and which has an opening slightly larger than that of the discharge hole.

A fifteenth aspect of the present invention provides the die metal mold according to the thirteenth or the fourteenth aspect, wherein introducing portions for introducing air are provided in an upper surface of the nozzle member on both sides of the discharge hole, each introducing portion comprises a T-shaped groove, the T-shaped groove comprises a parallel portion which is provided in the vicinity of the discharge hole and which is in parallel thereto and which is provided with a plurality of injecting ports in the longitudinal direction, and an intersecting portion which is in communication with the parallel portion and which intersects with the parallel portion and extends outward, and each intersecting portion is in communication with an air passage provided in an outer periphery of an upper surface of the nozzle member.

A sixteenth aspect of the present invention provides the die metal mold according to the thirteenth, the fourteenth or the fifteenth aspect, wherein in a state where a shielding plate which shields the upper surface of the nozzle member and which is in communication with the discharge hole of the nozzle member and which has a through hole whose opening is substantially the same as that of the opening of the discharge hole is interposed between the nozzle member and a wall surface of the scrap escape hole of the die, the nozzle member and the wall surface are tightly contacted with each other.

In a die apparatus according to a seventeenth aspect of the present invention, a die having a die hole for punching a workpiece is mounted on a die holder, the die holder is mounted on a rotatable dire receiver, the rotatable die receiver is provided with an annular groove which circulates air supplied from outside, and there is provided an air introducing portion which introduces air from the annular groove to a plurality of injecting ports which are downwardly inclined toward the scrap discharge hole.

An eighteenth aspect of the present invention provides the die apparatus according to the seventeenth aspect, wherein the die is placed on an ejector pipe inserted into an opening of the die receiver which constitutes the scrap discharge hole, when the ejector pipe is provided with a plurality of injecting ports, the air introducing portion comprises a horizontal through hole which is in communication with an annular groove provided in an outer surface of the die receiver and which is provided in the die receiver, and the annular groove which is in communication with the horizontal through hole and the plurality of injecting ports and which is provided in the outer surface of the ejector pipe.

A nineteenth aspect of the present invention provides the die apparatus according to the seventeenth or the eighteenth aspect, wherein the die is placed on the ejector pipe inserted into the opening of the die receiver which constitutes the scrap discharge hole, when the plurality of injecting ports are provided above the ejector pipe and in a nozzle member incorporated in the die, an air introducing portion comprises an L-shaped through hole which is in communication with an annular groove provided in an outer surface of a die receiver and which is provided in the die receiver, a vertical through hole which is in communication with the L-shaped through hole and which is provided in a flange of the ejector pipe, a reversed L-shaped through hole which is in communication with the vertical through hole and which is provided in the die, and a T-shaped groove which is in communication with through hole reversed L-shaped through hole and the plurality of injecting ports and which is provided in the upper surface of the nozzle member.

A twentieth aspect of the present invention provides a scrap floating prevention mechanism comprising: a die holder holding a die which punches a plate-like workpiece in cooperation with a punch, the die holder being formed with a first communication hole for sending compressed fluid; a mounting table on which the die holder is placed and fixed, the mounting table being formed with a second communication pipe which is in communication with the first communication pipe formed on the die holder and which sends compressed fluid to the first communication pipe; and a fluid injecting member provided below the die, the fluid injecting member being formed with a plurality of inclined injecting pipes for injecting compressed fluid from the first communication pipe; wherein the injecting pipes inject compressed fluid downward in a space into which a scrap punched out by the punch and the die drops.

A twenty-first aspect of the present invention provides the scrap floating prevention mechanism according to the twentieth aspect, wherein a radius of the injecting pipe is set smaller then that of the first communication pipe.

A twenty-second aspect of the present invention provides the scrap floating prevention mechanism according to the twentieth aspect, wherein the fluid injecting member is a pipe-like member extending downward; and the plurality of injecting pipes are downwardly inclined toward a center of the pipe-like member.

A twenty-third aspect of the present invention provides the scrap floating prevention mechanism according to any one of the twentieth to the twenty-second aspects, wherein the fluid injecting member is a nozzle member which is fitted into a recess formed below the die; and the plurality of injecting pipes are downwardly inclined toward a center of the nozzle member.

A twenty-fourth aspect of the present invention provides the scrap floating prevention mechanism according to any one of the twentieth to the twenty-third aspects, wherein the mounting table on which the die holder is placed and fixed is a base provided on a single station punch press.

A twenty-fifth aspect of the present invention provides the scrap floating prevention mechanism according to any one of the twentieth to the twenty-fourth aspects, wherein the die holder is an index gear for rotation indexing the die; the base is provided such that the base can rotate integrally with the index gear; the base is formed with the second communication pipe which sends compressed fluid to the first communication pipe formed in the index gear; and the base is provided at its periphery with a joint which can supplied compressed fluid to the second communication pipe no matter which rotational position the base stops.

A twenty-sixth aspect of the present invention provides the scrap floating prevention mechanism according to any one of the twentieth to twenty-fifth aspects, wherein the mounting table on which the die holder is placed and fixed is a lower turret disk of a turret punch press.

A twenty-seventh aspect of the present invention provides the scrap floating prevention mechanism according to any one of the twentieth to twenty-sixth aspects, wherein a disk support is provided in a work position of the lower turret disk below the lower turret disk; and the disk support is provided with a third communication pipe which supplies the compressed fluid to the second communication pipe formed in the lower turret disk.

A twenty-eighth aspect of the present invention provides the scrap floating prevention mechanism according to any one of the twentieth to twenty-seventh aspects, wherein there are a plurality of second communication pipes and a plurality of third communication pipes; and switching valves as many as the third communication pipes are provided between the third communication pipe and a fluid source of the compressed fluid for switching the flow of the compressed fluid.

BRIEF DESCRIPTION OF THE DRAWINGS

FIGS. 8 to 12 are explanatory views of a fourth conventional technique;

THE BEST MODE FOR CARRYING OUT THE INVENTION

Figure 13:
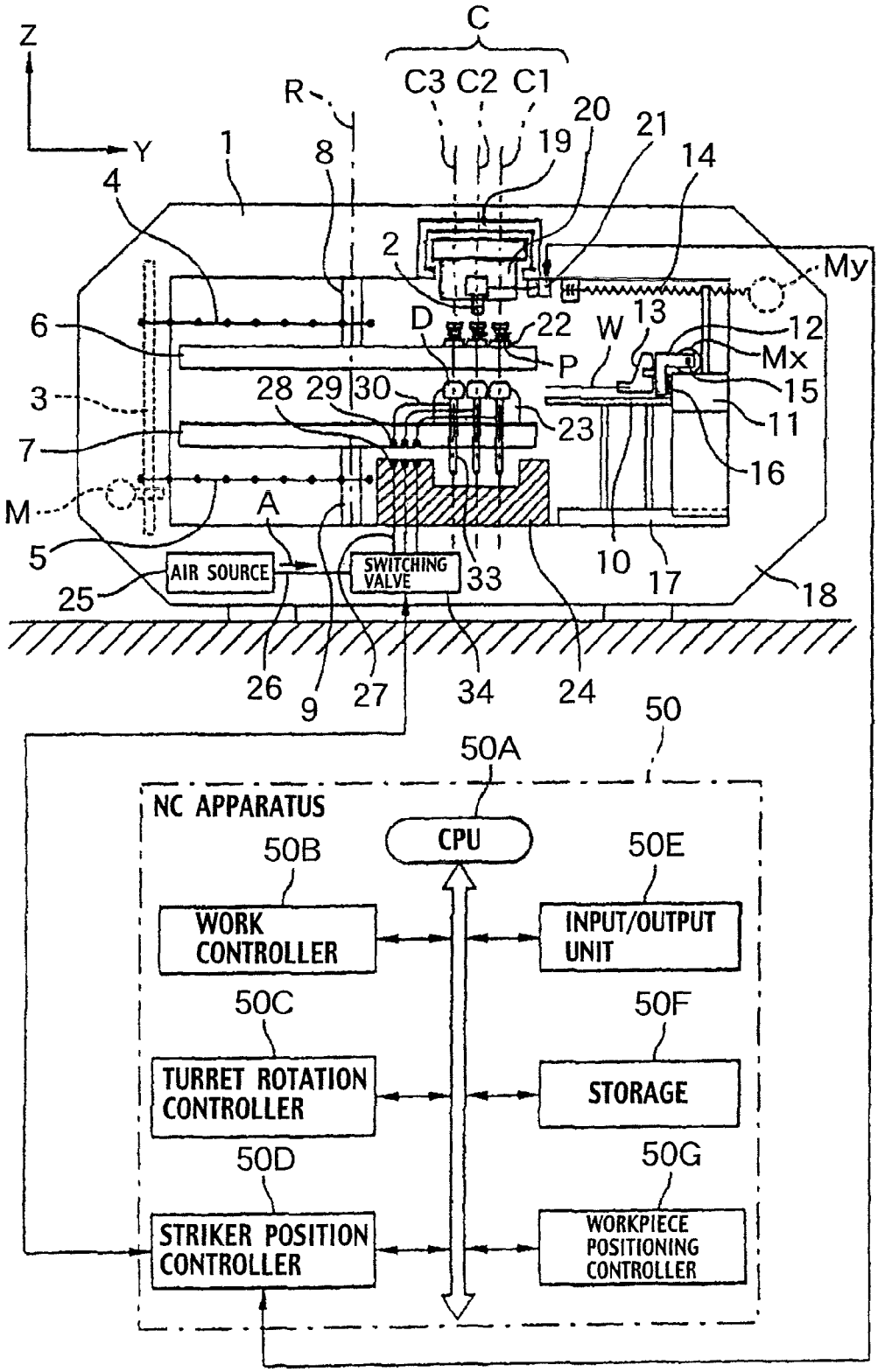
FIG. 13 is an overall view of an embodiment of the present invention.

Hereinbelow, the present invention will be explained based on embodiments, with reference to the accompanying drawings. FIG. 13 is an overall view of a turret punch press of the present invention. The turret punch press shown in FIG. 13 includes an upper turret 6 and a lower turret 7. A metal mold comprising a plurality of punches P and dies D are disposed between the upper turret 6 and the lower turret 7 through a punch holder 22 and a die holder 23, respectively.

As shown in the drawing, chains 4 and 5 are wound around a rotation shaft 8 of the upper turret 6 and a rotation shaft 9 of the lower turret 7, respectively. The chains 4 and 5 are wound around a drive shaft 3. With this structure, when a motor M is driven to rotate the drive shaft 3 and the chains 4 and 5, the upper turret 6 and the lower turret 7 rotate in synchronization with each other, and desired one of the metal molds can be selected at a punch center C.

According to the turret punch press shown in FIG. 13, the turrets 6 and 7 are rotated, and first, metal molds included in three tracks in a radial direction including a desired metal mold are positioned on the punch center C. A later-described striker cylinder 21 is then driven, a striker 2 is positioned on any of corresponding track positions C1, C2, and C3, the positioned striker 2 strikes the punch P of the selected metal mold, and the punch P punches a workpiece W in cooperation with the die D.

The striker 2 can be positioned on Y-axis direction at the punch center C. The striker 2 is slid and coupled to a ram 20, and coupled to the striker cylinder 21 mounted on an outer side surface of the ram 20. The ram 20 is vertically moved by a ram cylinder 19 provided in an upper frame 1.

With this structure, when the striker cylinder 21 is driven, the striker 2 can be positioned on one of track positions C1, C2, and C3 directly above the metal molds P and D to be selected. In this state, when the ram cylinder 19 is driven, the ram 20 is lowered and with this, the striker 2 strikes the selected punch P to carry out a predetermined punching work.

A disk support 24 is disposed on the punch center C below the lower turret 7 so that a pressure received by the turret 7 when the striker 2 strikes the punch P is received by the disk support 24. An upper surface of the disk support 24 is provided with air supply ports 28 as many as the radial metal molds P and D which can be selected on the punch center C. For example, when three radial metal molds of three tracks can be selected on the punch center C as shown in the drawing, three air supply ports 28 are provided on the upper surface of the disk support 24.

The three air supply ports 28 are coupled to a switching valve 34 (for example, solenoid valve) through a branch pipe 27. The switching valve 34 is coupled to an air source 25 through a main pipe 26. With this structure, when a striker position controller 50D constituting a later-described NC apparatus 50 detects the track positions C1, C2, and C3 of the striker 2 based on a feedback signal from an encoder of the striker cylinder 21, the switching valve 34 is switched such as to match the track positions C1, C2, and C3, and only corresponding one of the air supply ports 28 can be connected to the air source 25.

Figure 18:
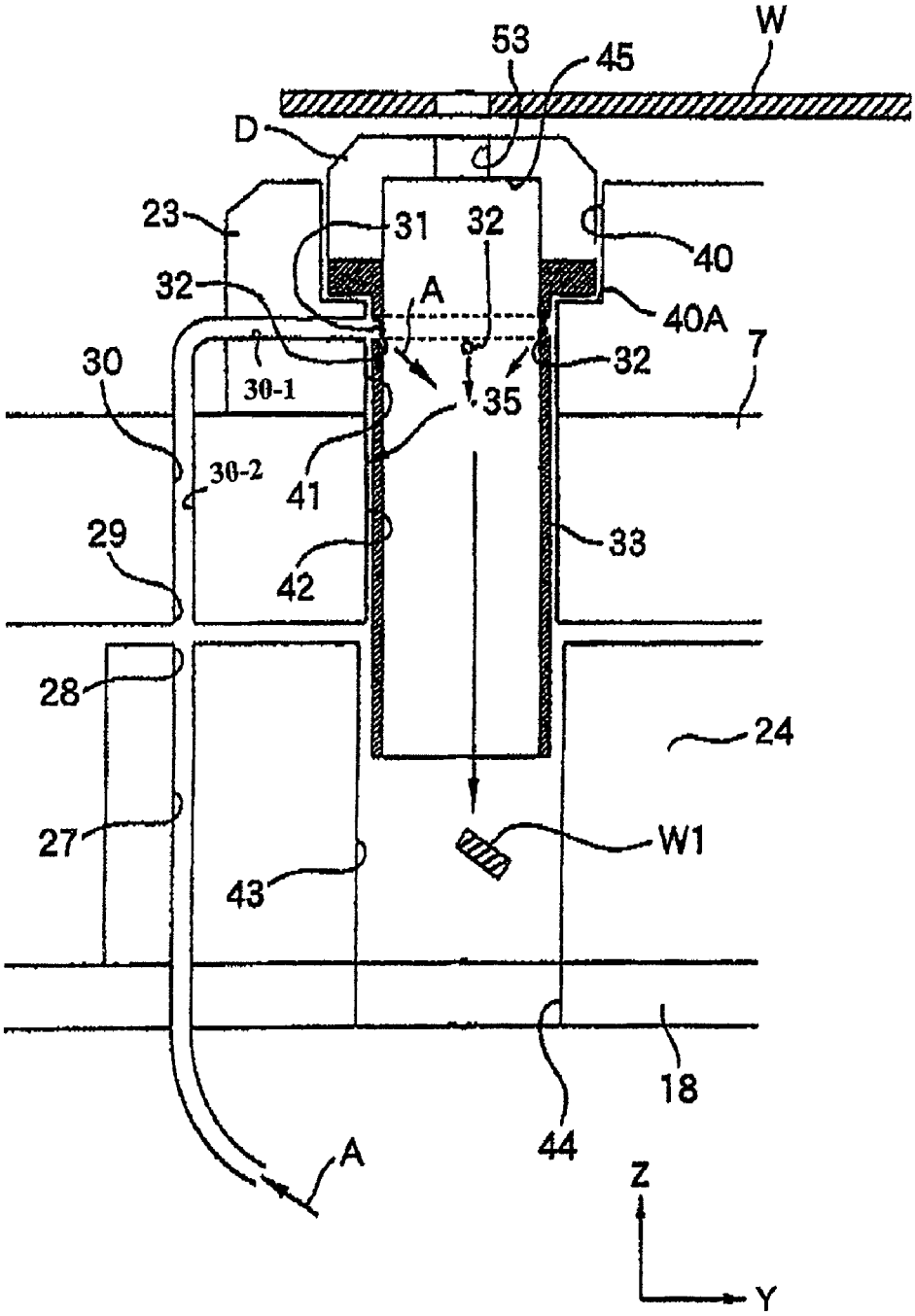
FIG. 18 is a diagram showing a relation between the scrap discharge hole and an injecting port when the invention has an ejector pipe.
Figure 19:
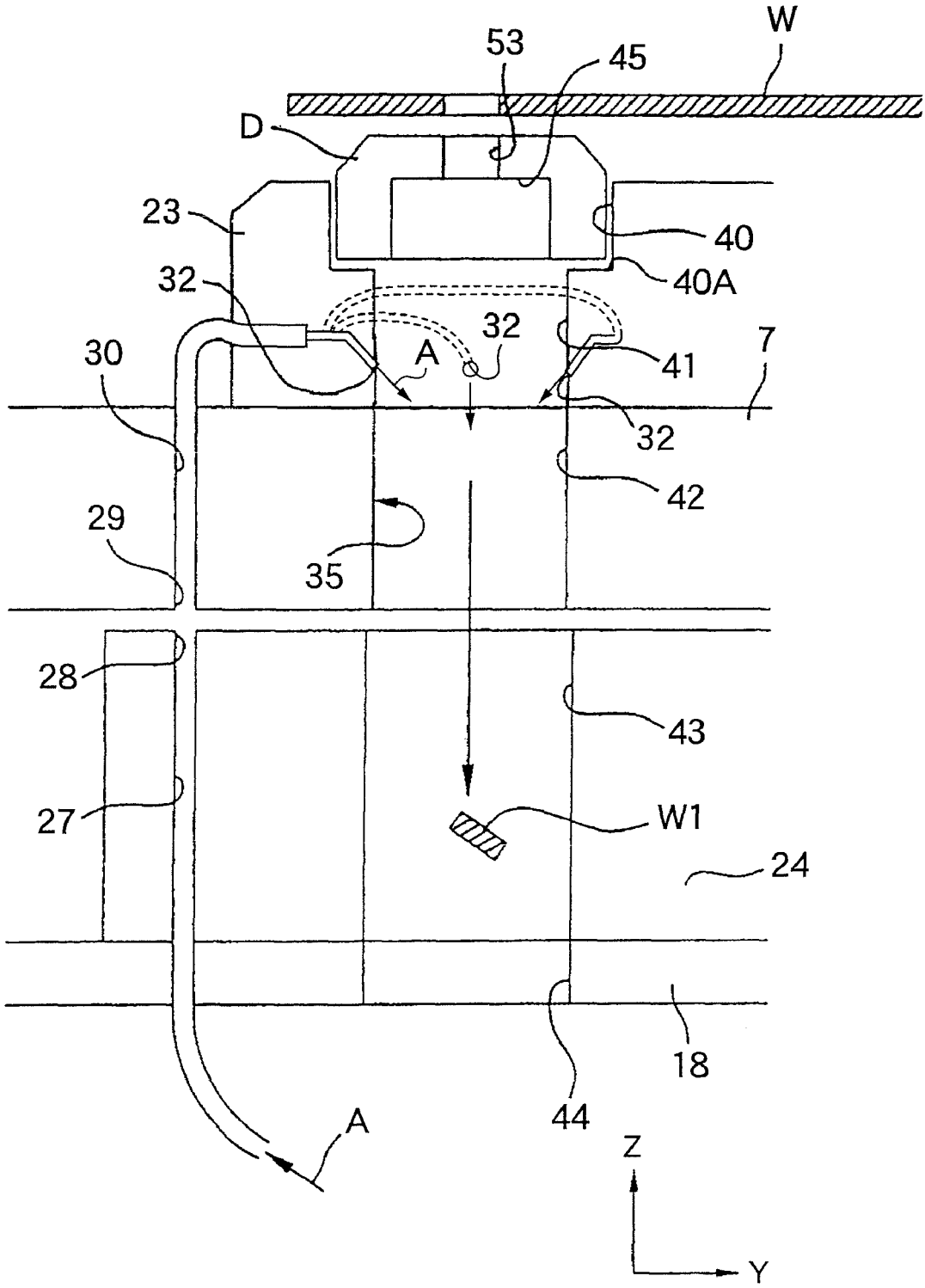
FIG. 19 is a diagram showing a relation between the scrap discharge hole and an injecting port when the invention has no ejector pipe.

With this structure, when the air source 25 is operated, air A is supplied from the main pipe 26, the switching valve 34 and the air supply port 28, and air is injected into the scrap discharge hole 35 below the selected die D through a later-described 30 (FIGS. 18 and 19). An air introducing port 29 is provided on a lower surface of the corresponding lower turret 7 at a location directly above the air supply port 28 of the disk support 24. The air introducing port 29 is in communication with the scrap discharge hole 35 below a later-described die D.

Figure 14:
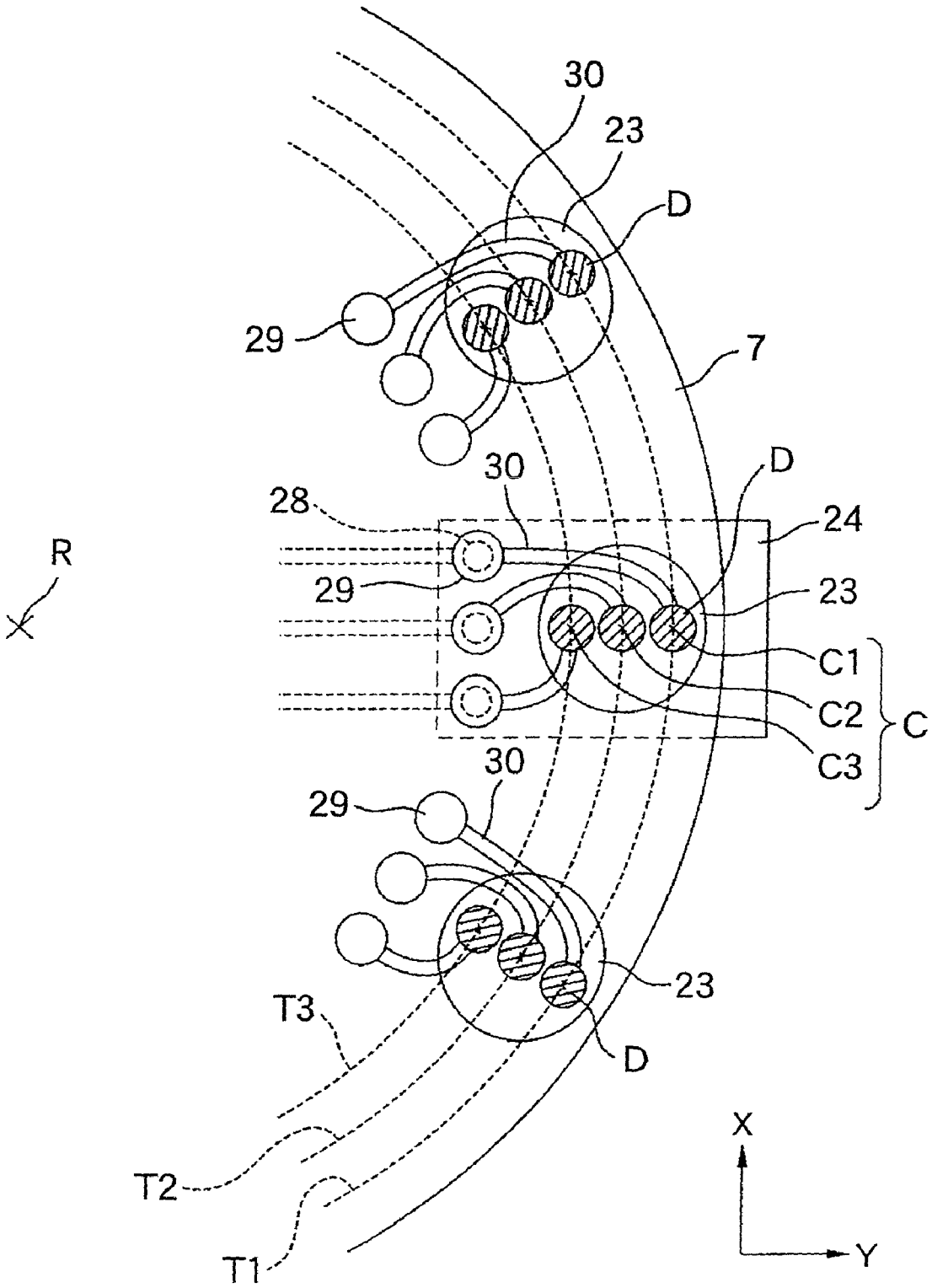
FIG. 14 is a diagram showing a relation between an air supply port of a disk support and an air introducing port of a lower turret constituting the invention (in the case of a three track system)

Each die holder 23 is provided with the air introducing port 29 as will be described later (FIG. 14). The number of the air introducing ports 29 each provided on each die holder 23 is the same as that of the air supply ports 28, and the number is three, for example. That is, as described above, in FIGS. 13 and 14, three metal molds of three tracks in the radial direction can be selected. With this structure, the dies D are radially mounted on the die holders 23 on the lower turret 7 (FIG. 14) on each of tracks T1, T2, and T3. In this manner, three air introducing ports 29 are provided on each die holder 23 at locations on the lower surface of the lower turret 7 in correspondence with the three dies D mounted on the die holder 23 directly above the air supply port 28.

Figure 17:
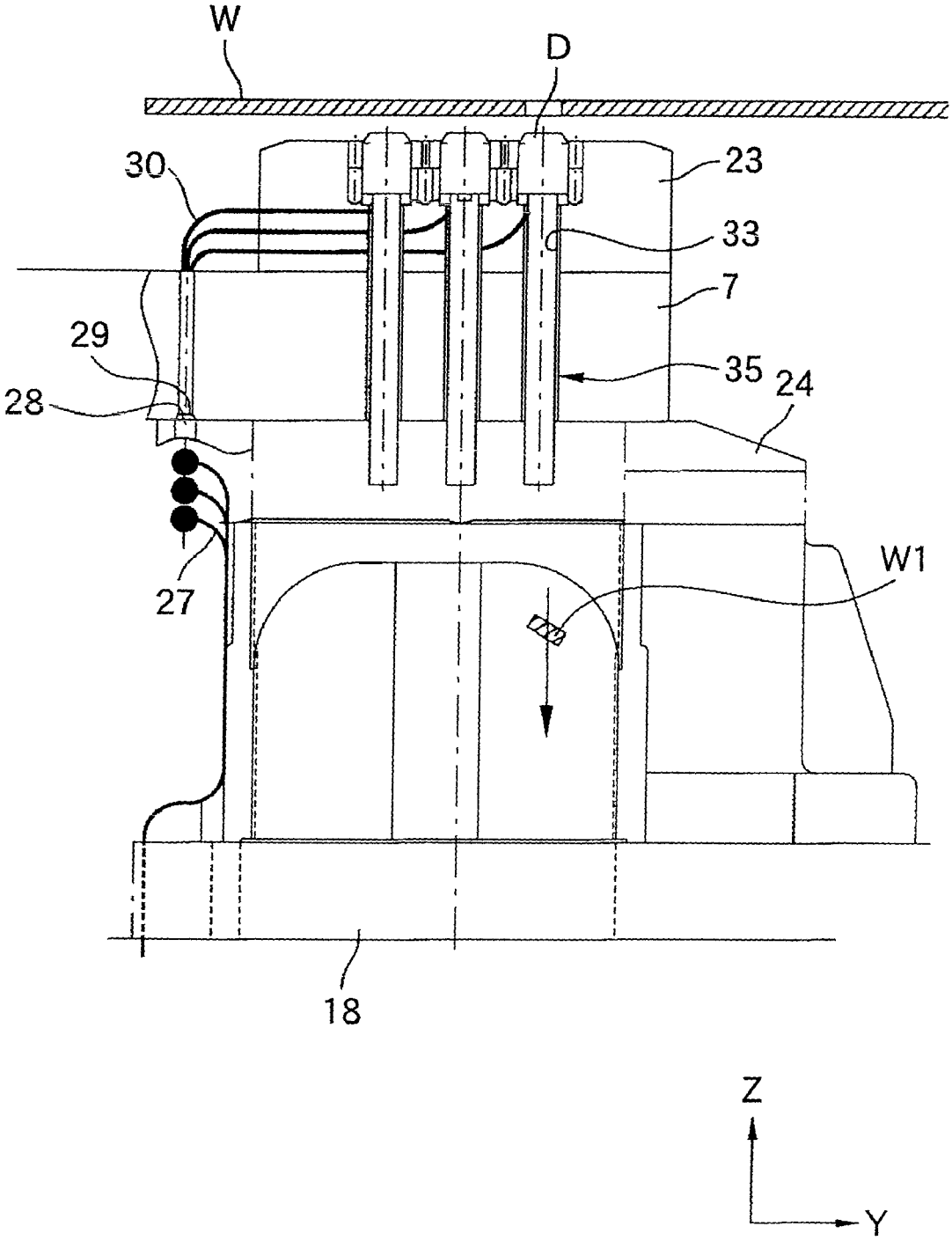
FIG. 17 is a diagram showing a scrap discharge hole constituting the invention.

Therefore, when the motor M is driven (FIG. 13) to rotate the turrets 6 and 7 in synchronism with each other and the die holder 23 on which a desired die D to be selected on the lower turret 7 (FIG. 14) is mounted is positioned on the punch center C, the air introducing port 29 provided on the lower surface of the lower turret 7 is positioned directly above the air supply port 28 provided on the upper surface of the disk support 24. In this state, when the switching valve 34 is switched such as to match the track positions C1, C2, and C3 of the striker 2, only corresponding one of the three air supply ports 28 is connected to the air source 25, air A is injected toward the scrap discharge hole 35 (FIG. 17) below the selected die D, a negative pressure is generated based on this operation, the scrap W1 (FIG. 18) is strongly sucked by the negative pressure toward a location below a die hole 53, and the scrap floating is prevented. When only metal molds P and D of one track (FIG. 15) can be selected, the number of air introducing ports 29 on the lower surface of the lower turret 7 with respect to the three air supply ports 28 on the upper surface of the disk support 24 is one.

Figure 15:
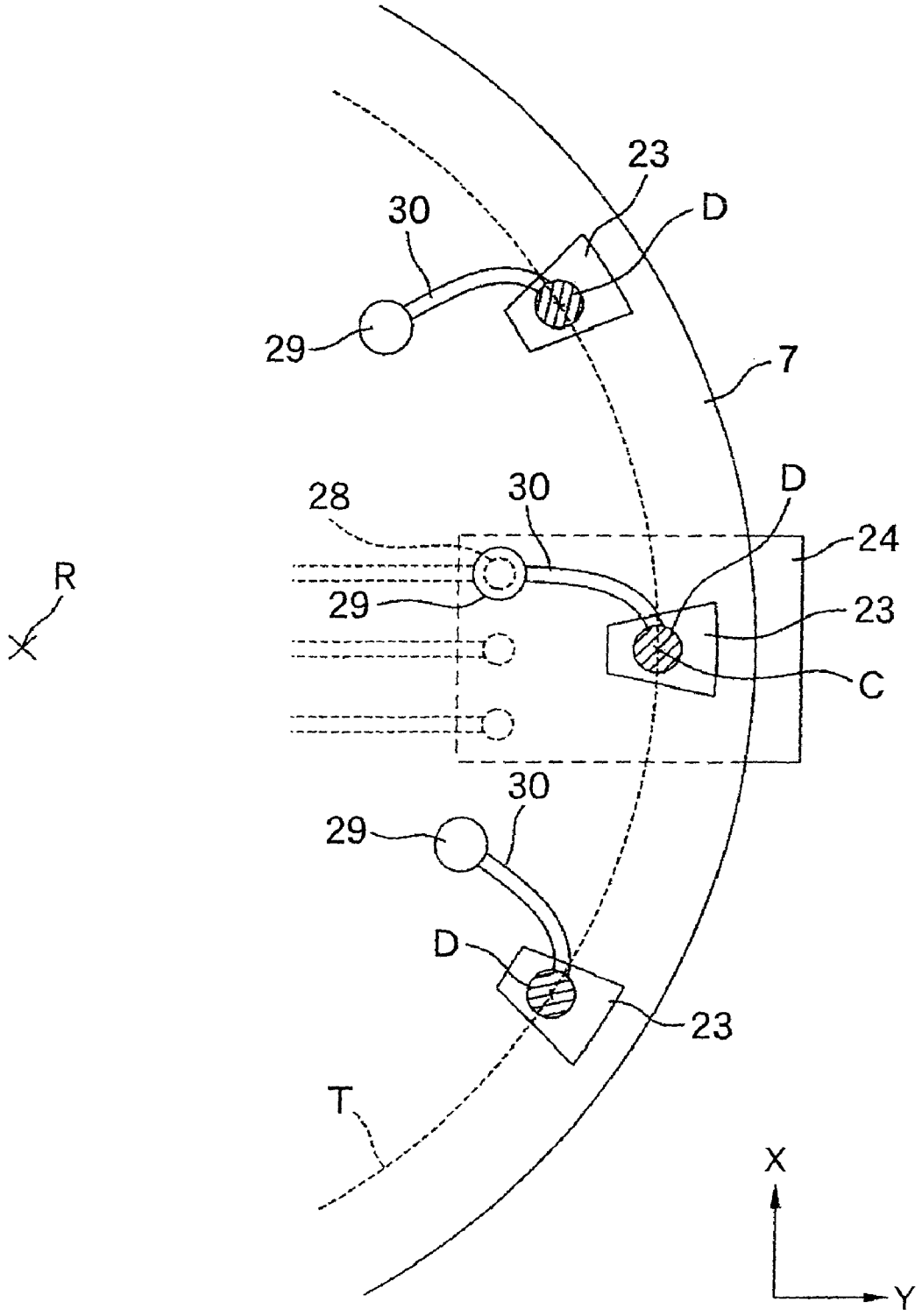
FIG. 15 is a diagram showing a relation between the air supply port and the air introducing port in the case of a one track system.
Figure 16:
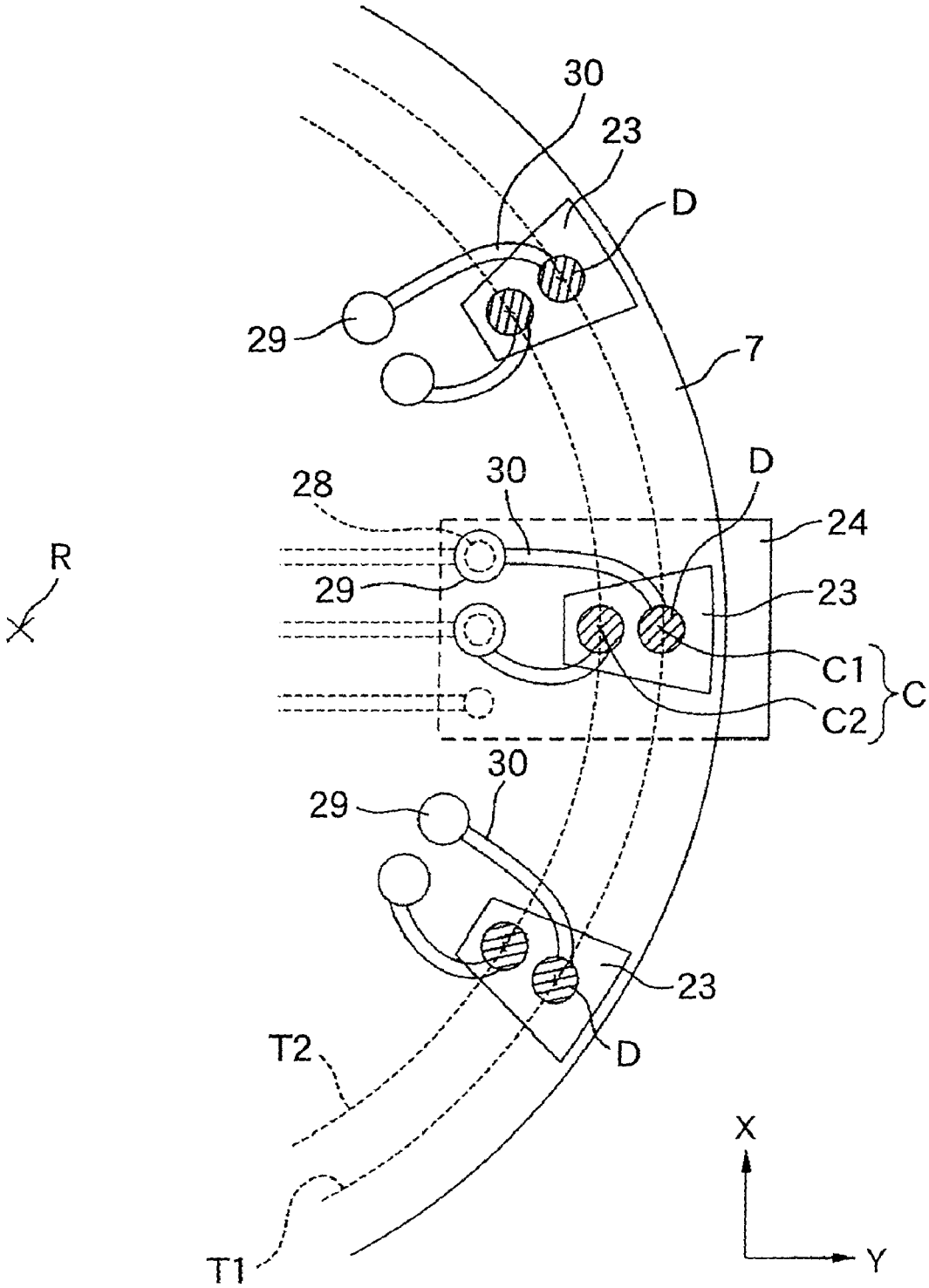
FIG. 16 is a diagram showing a relation between the air supply port and the air introducing port in the case of a two track system.

With this structure, when the turrets 6 and 7 are rotated in synchronism with each other and the die holder 23 on which one die D to be selected is mounted is positioned on the punch center C, one of the air introducing ports 29 on the lower surface of the lower turret 7 is positioned directly above the uppermost one of the three air supply ports 28 on the upper surface of the disk support 24 as viewed from FIG. 15, and only the uppermost air supply port 28 is connected to the air source 25. Air A is injected toward only the scrap discharge hole 35 below the selected die D, a negative pressure is generated based on this operation, the scrap W1 is strongly sucked by the negative pressure toward a location below the die hole 53, and the scrap floating is prevented. When only metal molds P and D on the two tracks T1 and T2 (FIG. 16) can be selected, the number of air introducing ports 29 on the lower surface of the lower turret 7 with respect to the three air supply ports 28 on the upper surface of the disk support 24 is two.

Figure 4:
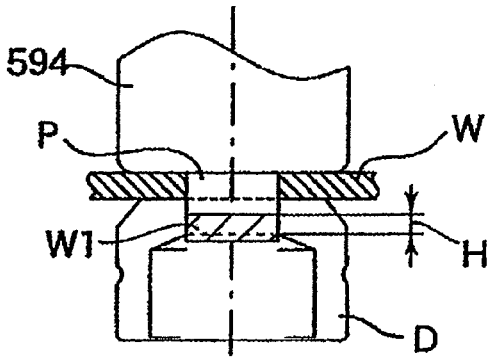
Prior Art FIG.4
FIGS. 4 to 7 are explanatory views of a third conventional technique.
Figure 5:
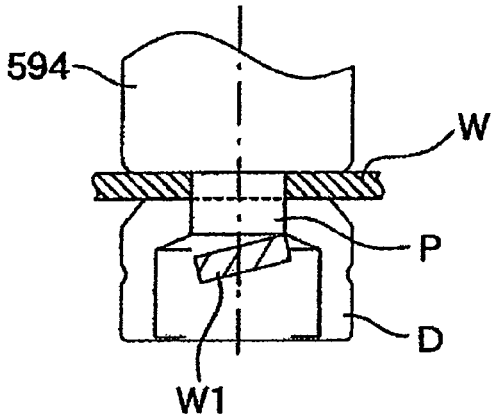
Prior Art FIG.5
Figure 6:
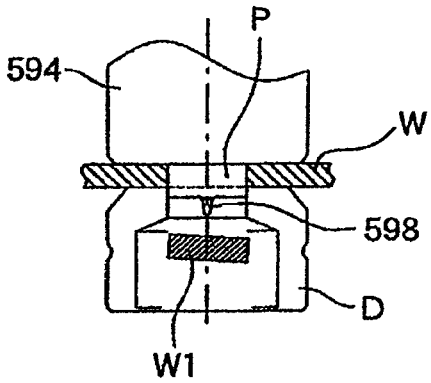
Prior Art FIG.6
Figure 7:
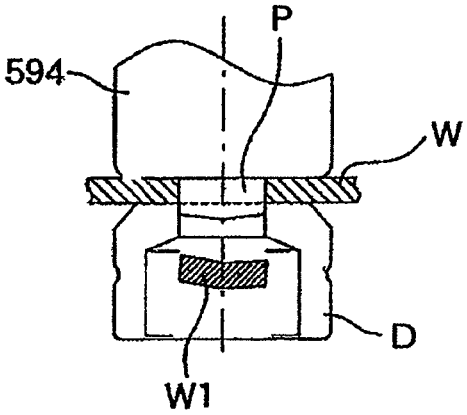

With this structure, when the turrets 6 and 7 are rotated in synchronism with each other and the die holder 23 on which two die D to be selected are mounted is positioned on the punch center C, two air introducing ports 29 on the lower surface of the lower turret 7 are positioned directly above the uppermost one and a middle one of the three air supply ports 28 on the upper surface of the disk support 24 as viewed from FIG. 4, and only the uppermost air supply port 28 is connected to the air source 25. Air A is injected toward only the scrap discharge hole 35 below the selected die D, a negative pressure is generated based on this operation, the scrap W1 is strongly sucked by the negative pressure toward a location below the die hole 53, and the scrap floating is prevented. Air A is injected only to the scrap discharge hole 35 (FIG. 17) below a selected outer side die D, a negative pressure is generated based on this operation, the scrap W1 is strongly sucked by the negative pressure to a location below the die hole 53 (FIG. 18), and the scrap floating is prevented.

The scrap discharge holes 35 are provided below the three dies D mounted on each die holder 23 (FIG. 17), and ejector pipes 33 for pushing the die D when the metal mold is to be replaced are inserted into the scrap discharge holes 35. That is, as shown in FIG. 18, an opening 41 formed in the die holder 23 below the die D, an opening 42 formed in the lower turret 7, an opening 43 formed in the disk support 24 and an opening 44 formed in the lower frame 18 constitute the scrap discharge hole 35. A flange of the ejector pipe 33 on which the die D is placed is engaged with a shoulder 40A of an insertion hole 40. The ejector pipe 33 extends downward and inserted into the scrap discharge hole 35.

A communication pipe 30 extends upwardly from the air introducing port 29 on the lower surface of the lower turret 7 and penetrates the lower turret 7, and the communication pipe 30 is bent and enters into the die holder 23. The communication pipe 30 comes into communication with an annular groove 31 formed in an outer surface of the ejector pipe 33. A plurality of injecting ports 32 are formed in the annular groove 31. The injecting ports 32 downwardly incline inward of the ejector pipe 33. With this structure, air A supplied from the corresponding air supply port 28 (FIG. 18) connected to the air source 25 in accordance with the track positions C1, C2, and C3 (FIG. 13) of the striker 2 passes through the communication pipe 30 from the air introducing port 29 and then, the air A is injected toward the scrap discharge hole 35 through the annular groove 31 of the ejector pipe 33 from the injecting port 32 which is inclined downward. As a result, a negative pressure is generated below the die hole 53 formed in the die D which punches the workpiece W, and outside air is sucked through the die hole 53.

Therefore, a scrap W1 generated when a workpiece W is worked is strongly sucked downward from the die hole 53 by a negative pressure generated based on air A from the downwardly inclined injecting port 32 of the ejector pipe 33, and the scrap W1 is forcibly discharged out from the scrap escape hole 45 through the scrap discharge hole 35.

As shown in FIG. 19, when the ejector pipe 33 is not inserted into the scrap discharge hole 35, the die holder 23 is formed with a plurality of downwardly inclined injecting ports 32, the communication pipe 30 which extends from the air introducing port 29 to the die holder 23 is branched and brought into communication with each injecting port 32. With this structure, similarly, air A supplied from the corresponding air supply port 28 (FIG. 19) connected to the air source 25 such as to match the track positions C1, C2, and C3 (FIG. 13) of the striker 2 passes through the communication pipe 30 from the air introducing port 29 and then, the air A is branched off and injected toward the scrap discharge hole 35 from the downwardly inclined injecting port 32 of the die holder 23. As a result, a negative pressure is generated below the die hole 53 formed in the die D which punches the workpiece W, and outside air is sucked through the die hole 53.

Accordingly, the scrap W1 generated when a workpiece W is worked is strongly sucked downward of the die holder 23 by the negative pressure generated based on air A from the downwardly inclined injecting port 32 of the die holder 23, and the scrap W1 is forcibly discharged out from the scrap escape hole 45 through the scrap discharge hole 35.

Figure 20:
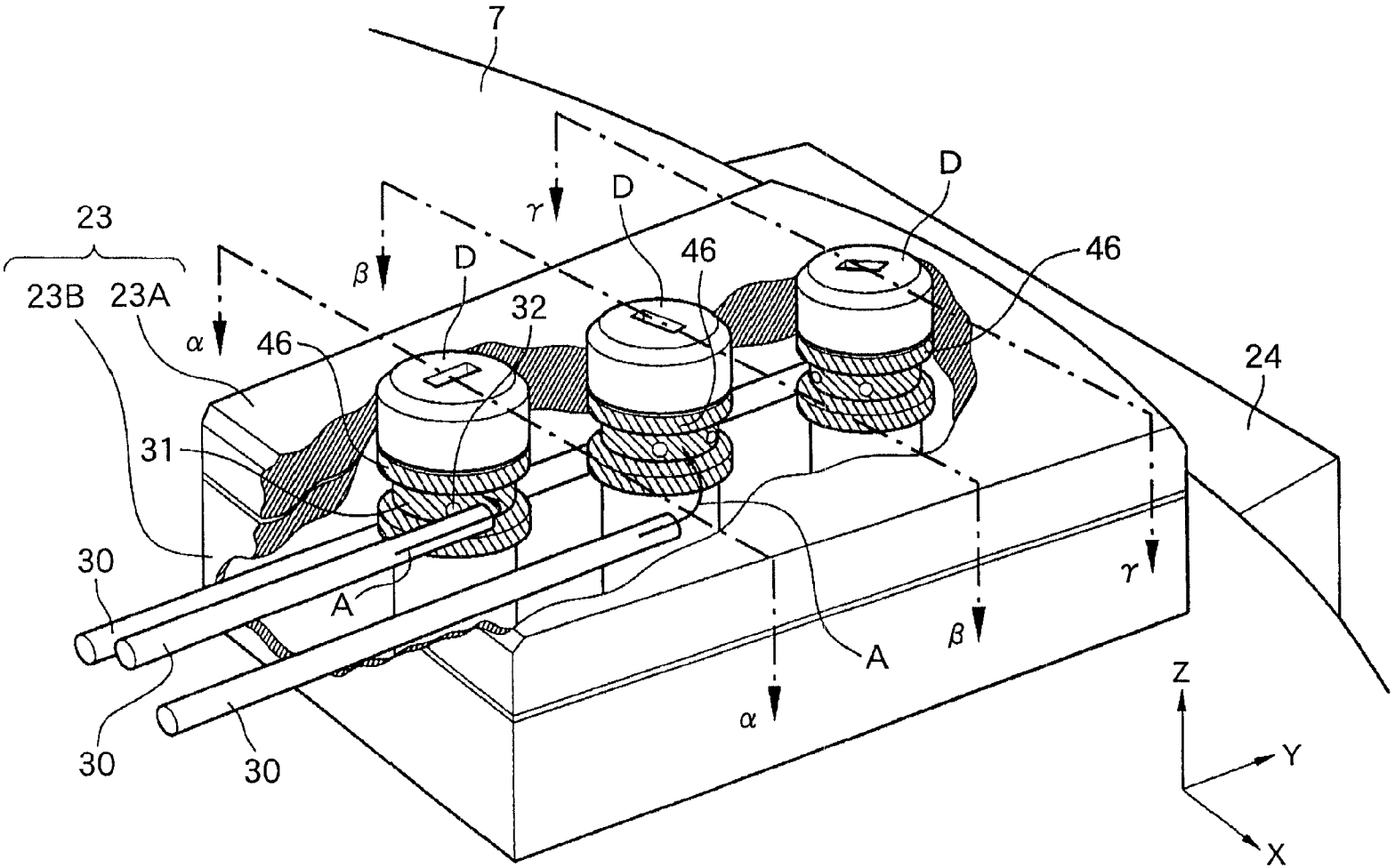
FIG. 20 is a diagram showing an embodiment where the injecting port is provided using a nozzle member (in the case of the three track system)
Figure 21:
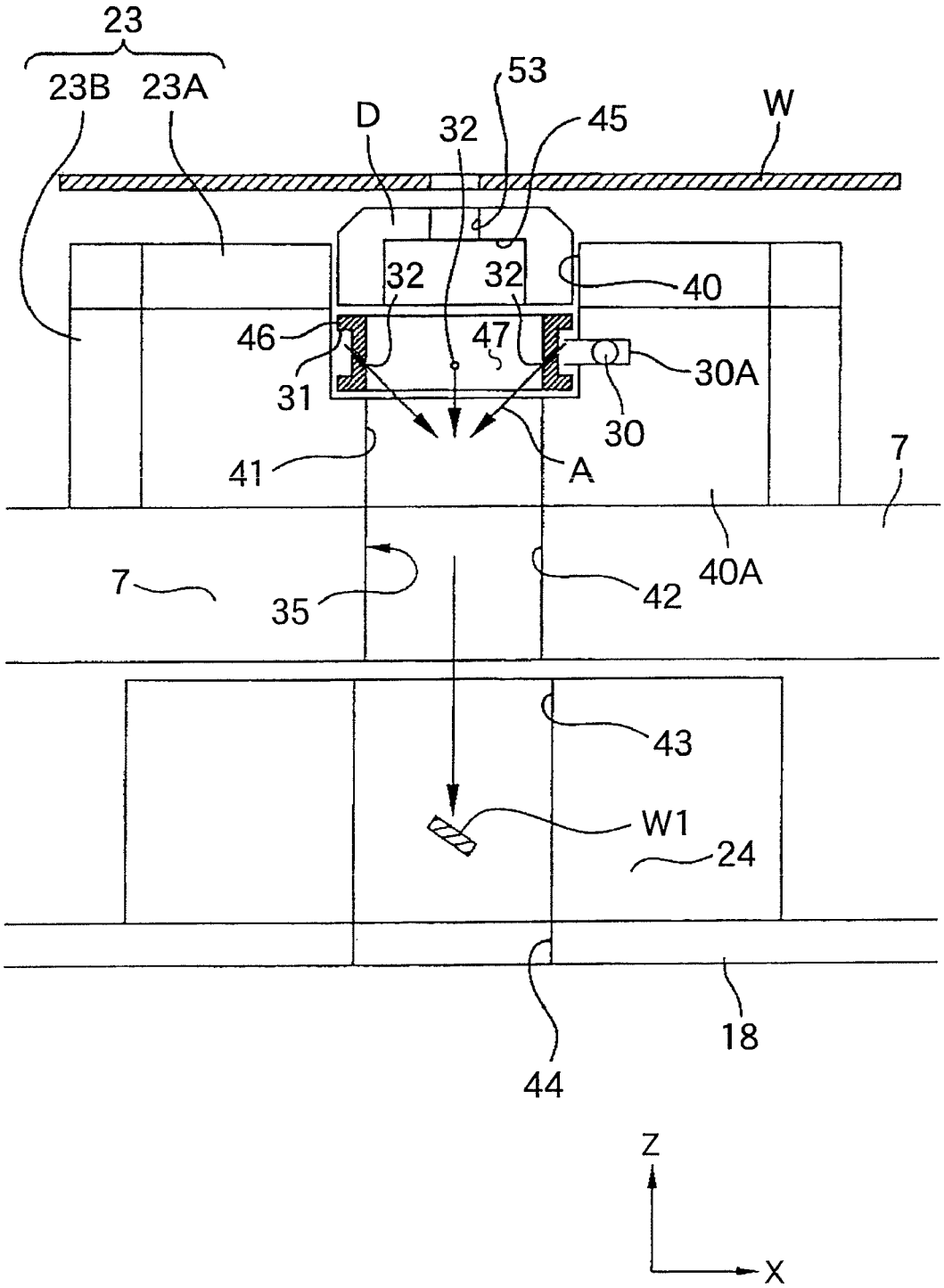
FIG. 21 is a diagram showing an air supply path formed by a nozzle member to a scrap discharge hole of the innermost die D in FIG. 20 (sectional view taken along the α-α line)
Figure 22:
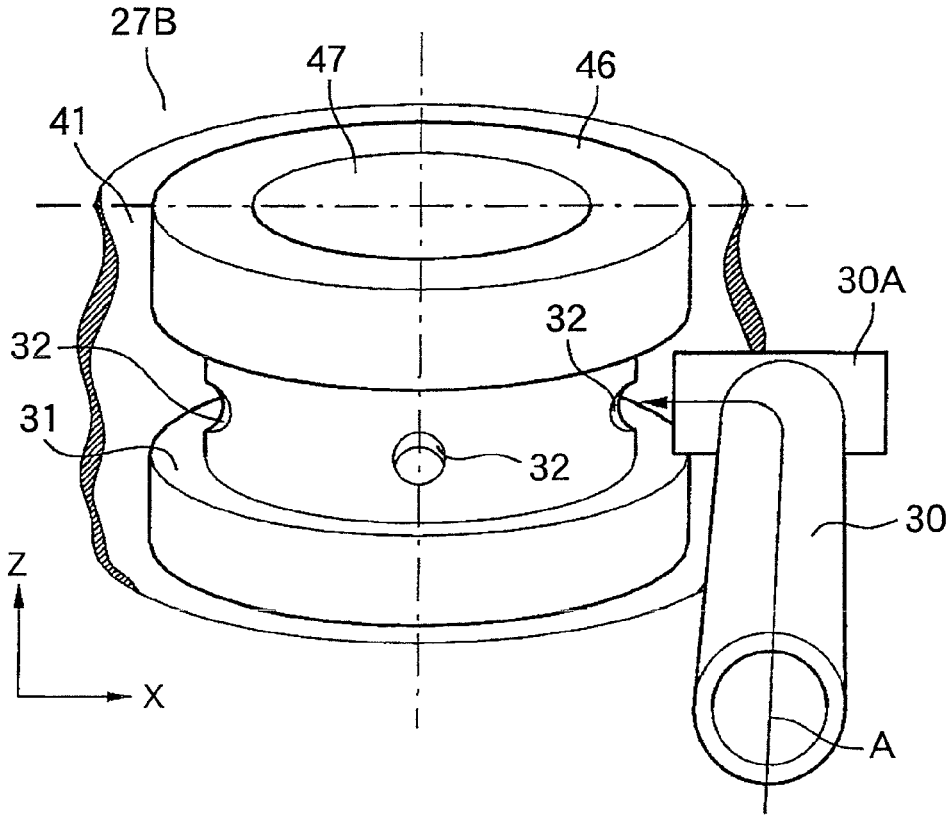
FIG. 22 is a diagram showing a relation between the nozzle member and a communication pipe in FIG. 21.

FIGS. 20 to 27 show concrete examples in which the ejector pipe 33 is not inserted into the scrap discharge hole 35 explained with reference to FIG. 19. In any of the examples, a nozzle member 46 is used instead of the ejector pipe 33, and the nozzle member 46 is provided with a plurality of injecting ports 32. In FIG. 20, a die D is disposed on an upper die holder 23A of the die holders 23 on the lower turret 7, and the nozzle member 46 is disposed on a lower die holder 23B of the die holders 23.

The lower die holder 23B (FIGS. 21, 23, and 25) is formed with the opening 41 which constitutes the scrap discharge hole 35. An upper portion of the opening 41 is slightly wider as shown in the drawings, and the nozzle member 46 is inserted into this widened portion. The die D is placed on the nozzle member 46, and the die D upwardly projects from a die insertion hole 40 of the upper die holder 23A.

Figure 23:
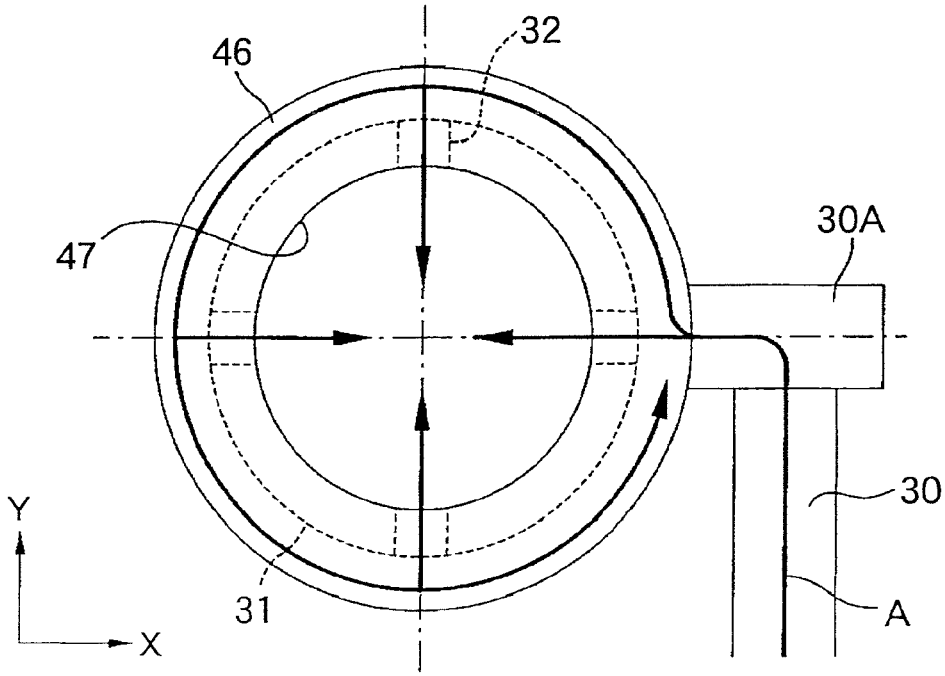
FIG. 23 is a diagram showing a relation between the nozzle member and the communication pipe in FIG. 21.
Figure 24:
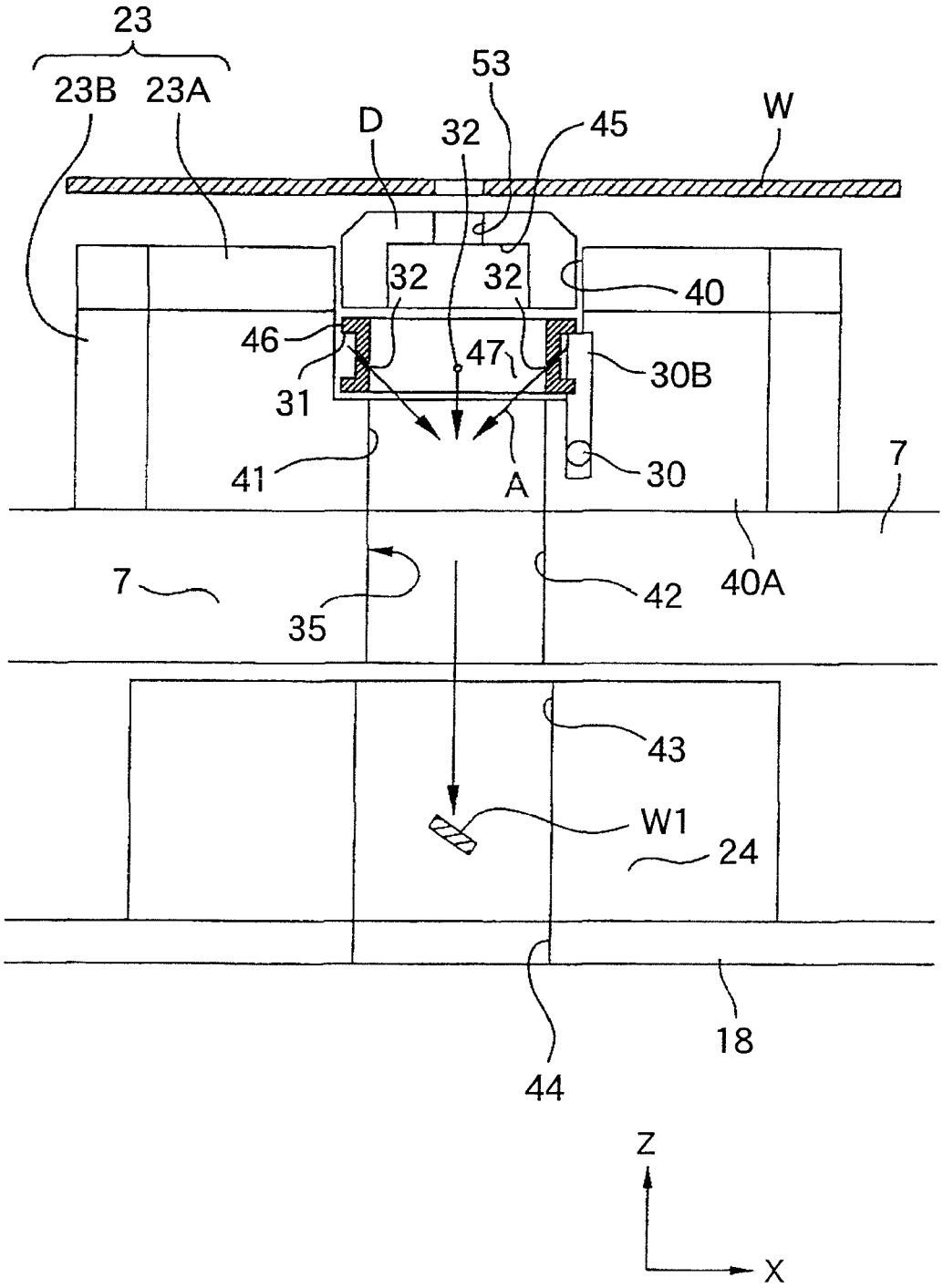
FIG. 24 is a diagram showing an air supply path formed by a nozzle member to a scrap discharge hole of a middle die D in FIG. 20 (sectional view taken along the β-β line)
Figure 25:
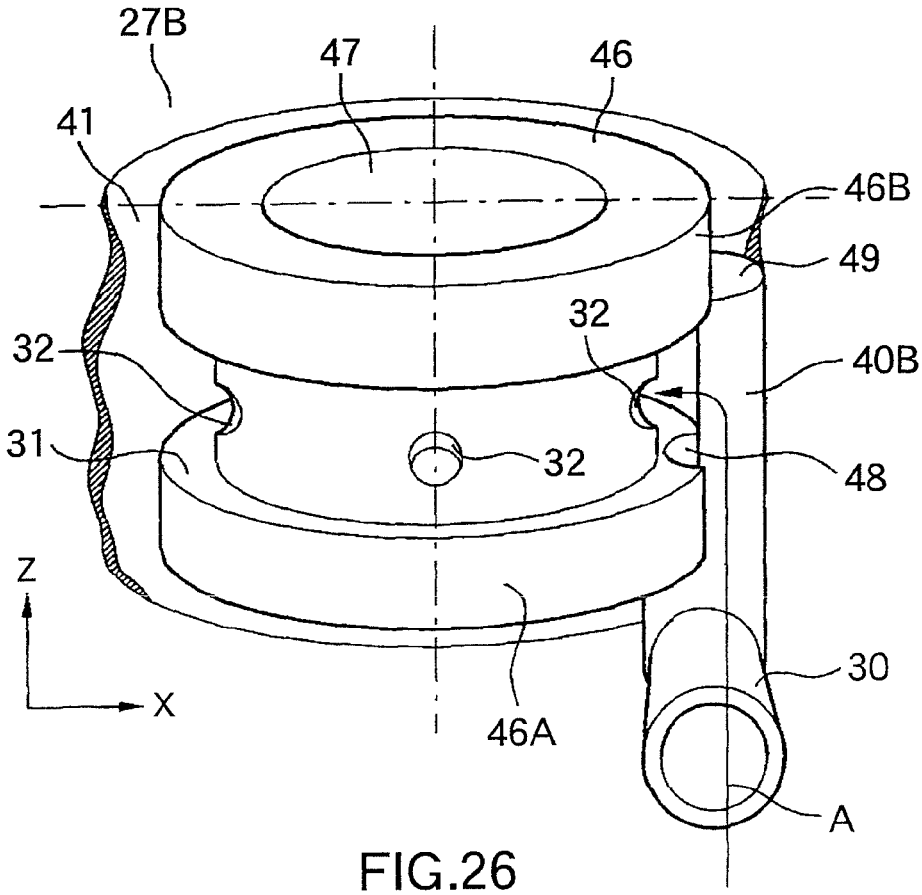
FIG. 25 is a diagram showing a relation between the nozzle member and the communication pipe in FIG. 24.
Figure 26:
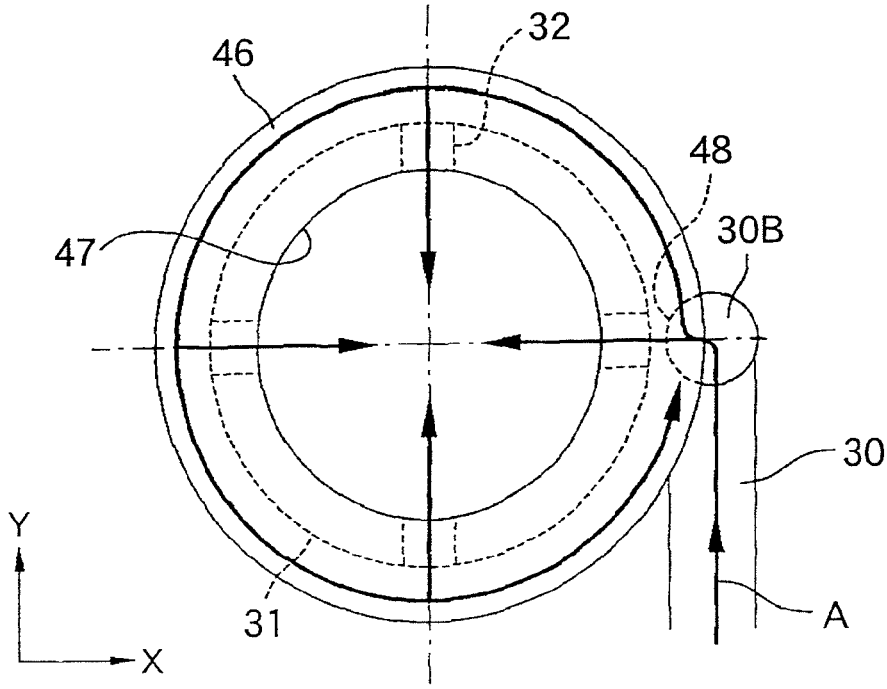
FIG. 26 is a diagram showing a relation between the nozzle member and the communication pipe in FIG. 24.
Figure 27:
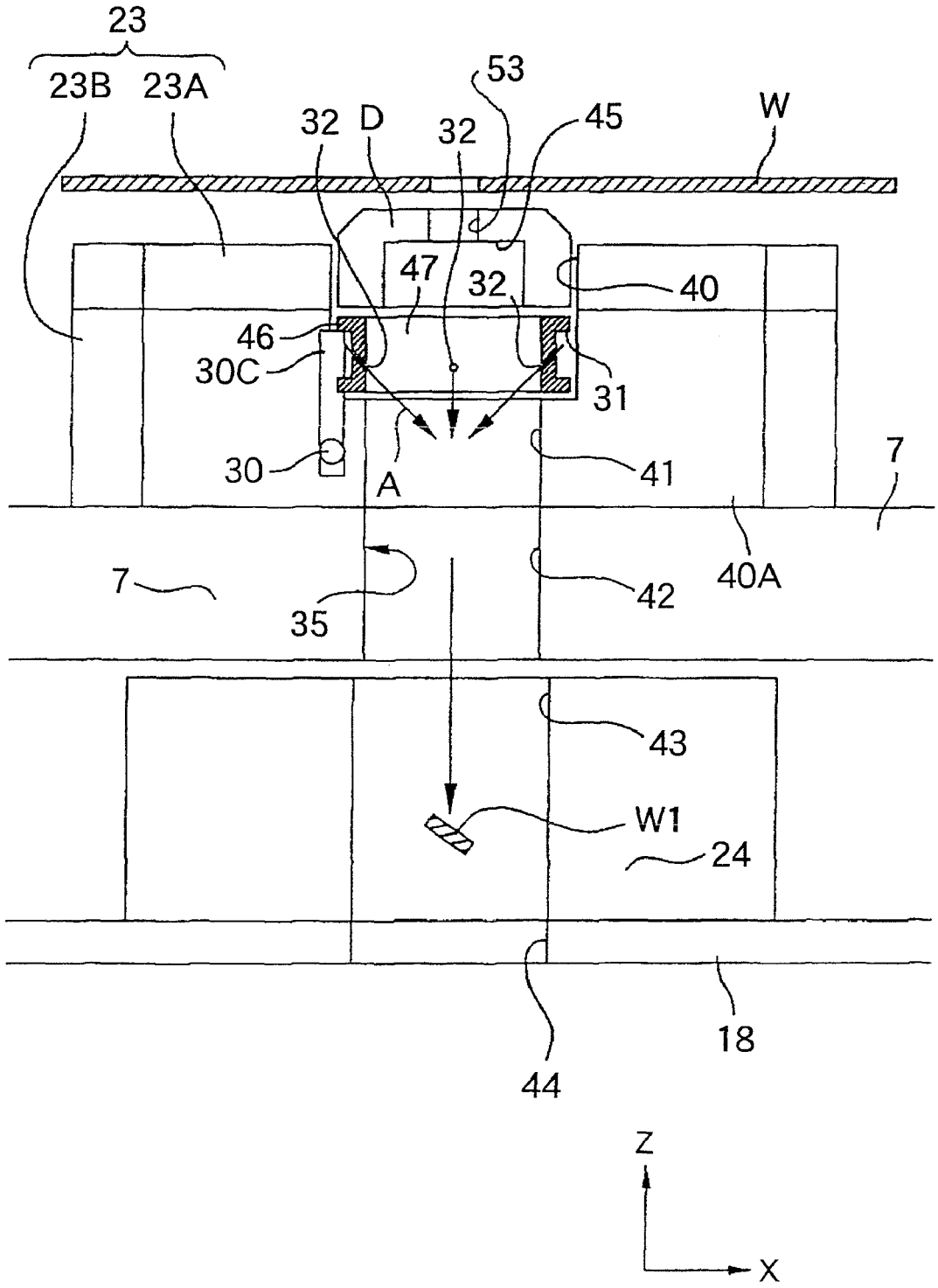
FIG. 27 is a diagram showing an air supply path formed by a nozzle member to a scrap discharge hole of the outermost die D in FIG. 20 (sectional view taken along the γ-γ line)

The nozzle members 46 (FIGS. 22, 24, and 26) have the same structures for the dies D and are formed into substantially cylindrical shape. The nozzle member 46 is formed therein with a discharge hole 47 which is in communication with the die hole 53 and which constitutes a portion of the scrap discharge hole 35 (FIGS. 12, 23, and 25). A groove 31 is annularly formed in an outer peripheral surface. The annular groove 31 constitutes an introducing portion for introducing air A into the later-described injecting port 32. A plurality of injecting ports 32 are formed in the annular groove 31. The injecting ports 32 are inclined downwardly toward the inside discharge hole 47 and inject air A as described above.

On the other hand, the three communication pipes 30 (FIG. 20) extends from the air introducing port 29 on the lower surface of the lower turret 7 (FIG. 13). One of the communication pipes 30 supplies air A (FIG. 21) to the scrap discharge hole 35 of the innermost die D. This communication pipe 30 extends enters the lower die holder 23B and straightly extends to a portion near the nozzle member 46 while maintaining the height of the communication pipe 30 at substantially the same level as the groove 31 of the nozzle member 46. This communication pipe 30 (FIG. 22A) is coupled to the intersecting horizontal pipe 30A in the vicinity of the nozzle member 46, and an outlet of the horizontal pipe 30A enters the groove 31 of the nozzle member 46.

With this structure, when the innermost die D (FIG. 20) is selected, the air A (FIG. 22) which passed through the air supply port 28 connected to the air source 25 (FIG. 13) and the air introducing port 29 corresponding to the air supply port 28 and which enters this communication pipe 30 is bent at right angles at the horizontal pipe 30A and is supplied to the groove 31 of the nozzle member 46 from the outlet of the horizontal pipe 30A, and is injected to the scrap discharge hole 35 (FIG. 21) from the downwardly inclined injecting ports 32. As a result, similarly, a negative pressure is generated below the die hole 53 and the outside air is sucked through the die hole 53.

Therefore, the scrap W1 generated when a workpiece W is worked is strongly sucked downward from the die holder 53 by the negative pressure generated based on air A from the downwardly inclined injecting port 32 of the nozzle member 46, and the scrap W1 is forcibly discharged out from the scrap escape hole 45 through the scrap discharge hole 35. One of the three communication pipes 30 (FIG. 20) which supplies air A (FIG. 23) to the scrap discharge hole 35 of the middle die D enters the lower die holder 23B and extends straightly to a portion in the vicinity of the nozzle member 46 while maintaining the height of this communication pipe 30 at a level lower than that of the communication pipe 30 for the innermost die D (FIG. 20).

In this case, the communication pipe 30 (FIG. 23) which entered the lower die holder 23B is displaced toward the groove 31 of the nozzle member 46 by about half as viewed from the Y-axis. This communication pipe 30 (FIG. 25) is coupled to a vertical pipe 30B which intersecting the communication pipe 30 in the vicinity of the nozzle member 46. The vertical pipe 30B extends upward and a substantially half portion 48 of the vertical pipe 30B enters a lower flange 46A of the nozzle member 46 and then, passes through the groove 31 in a state where the other half of the vertical pipe 30B is opened as shown in the drawing, and the vertical pipe 30B abuts against an upper flange 46B, and a top 49 of the vertical pipe 30B is closed. In this manner, the communication pipe 30 which supplies air A to the scrap discharge hole 35 (FIG. 24) of the middle die D effectively utilizes a space in the narrow lower die holder 23B, and comes into communication with the groove 31 of the nozzle member 46 in cooperation with the vertical pipe 30B.

With this structure, when the middle die D is selected, air A (FIGS. 25 and 26) which passed through the corresponding air supply port 28 connected to the air source 25 (FIG. 13) and the air introducing port 29 corresponding to this air supply port 28 and which enters this communication pipe 30 is bent at right angles at the vertical pipe 30B. The air A is supplied to the groove 31 of the nozzle member 46 from the opening including the half portion 48 of the vertical pipe 30B which enters the lower flange 46A of the nozzle member 46, and the air A is injected to the scrap discharge hole 35 (FIG. 24) from the downwardly inclined injecting ports 32.

As a result, a negative pressure is generated below the die hole 53, and outside air is sucked through the die hole 53. Therefore, the scrap W1 generated when a workpiece W is worked is strongly sucked downward from the die hole 53 by the negative pressure generated based on air A from the downwardly inclined injecting port 32 of the nozzle member 46, and the scrap W1 is forcibly discharged out from the scrap escape hole 45 through the scrap discharge hole 35.

One of the three communication pipes 30 (FIG. 20) which supplies air A (FIG. 27) to the scrap discharge hole 35 of the outermost die D enters the lower die holder 23B and straightly extends to a portion in the vicinity of the outermost nozzle member 46 while maintaining the height of the communication pipe 30 substantially at the same level on the opposite side from the communication pipe 30 (FIGS. 24 to 26) for the middle die D with respect to the opening 41.

Figure 28:
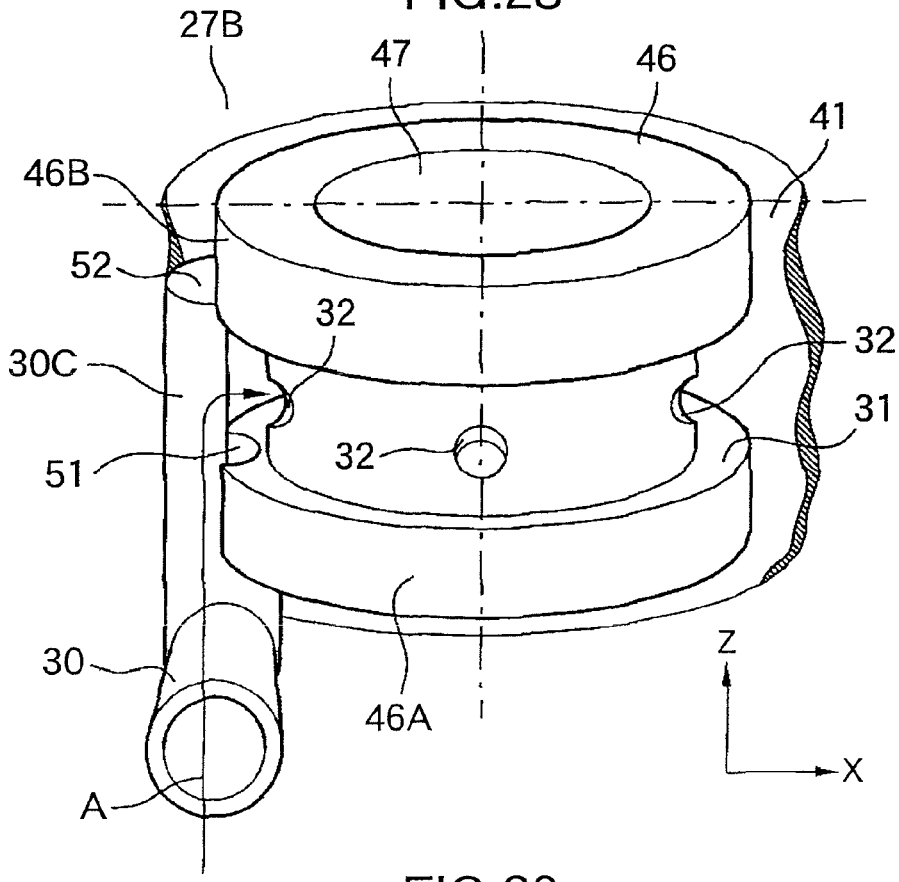
FIG. 28 is a diagram showing a relation between the nozzle member and the communication pipe in FIG. 27.

In this case, the communication pipe 30 (FIG. 27) which entered the lower die holder 23B is disposed on the opposite side from the communication pipe 30 (FIG. 24) for the middle die D as viewed from the Y-axis as described above, but the former communication pipe 30 is displaced toward the groove 31 of the nozzle member 46 (FIG. 27) by about half. This communication pipe 30 (FIG. 28) is coupled to an intersecting vertical pipe 30C in the vicinity of the nozzle member 46.

The vertical pipe 30C upwardly extends, a substantially half portion 51 of the vertical pipe 30C enters the lower flange 46A of an outer layer 46 and then, the vertical pipe 30C passes through the groove 31 in a state where the other half portion of the vertical pipe 30C is opened, the vertical pipe 30C abuts against the upper flange 46B and a top portion 52 of the vertical pipe 30C is closed. In this manner, similarly, the communication pipe 30 which supplies air A to the scrap discharge hole 35 (FIG. 27) of the outermost die D effectively utilizes a space in the narrow lower die holder 23B, and comes into communication with the groove 31 of the nozzle member 46 in cooperation with the vertical pipe 30C.

Figure 29:
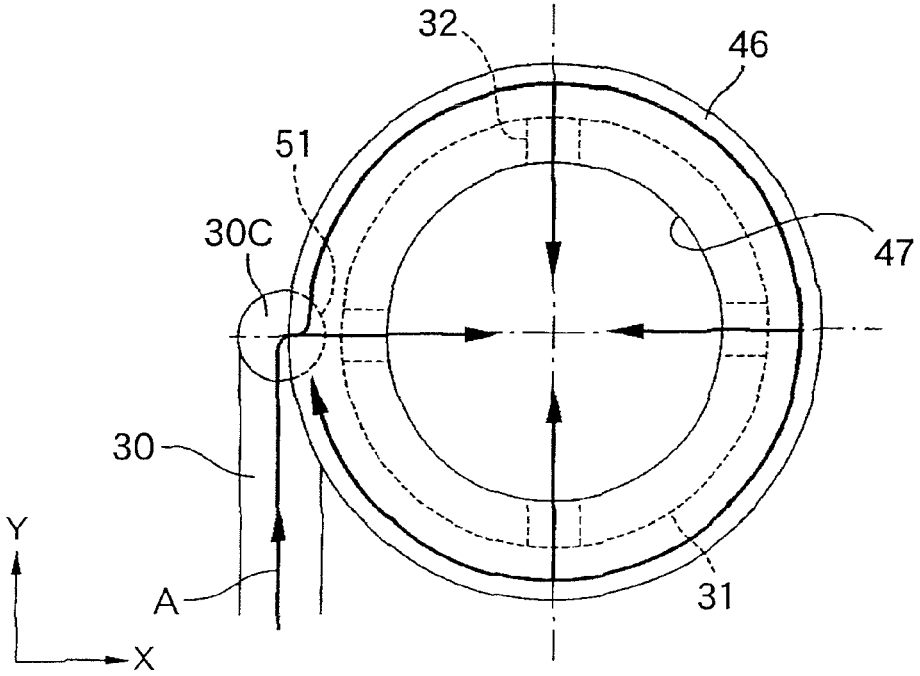
FIG. 29 is a diagram showing a relation between the nozzle member and the communication pipe in FIG. 27.

With this structure, when the outermost die D is selected, air A (FIGS. 28 and 29) which passed through the corresponding air supply port 28 connected to the air source 25 (FIG. 13) and the air introducing port 29 corresponding to this air supply port 28 and which enters this communication pipe 30 is bent upward at right angles at the vertical pipe 30C. The air A is supplied to the groove 31 of the nozzle member 46 from the opening including the half portion 51 of the vertical pipe 30C which enters the lower flange 46A of the nozzle member 46, and the air A is injected to the scrap discharge hole 35 (FIG. 27) from the downwardly inclined injecting ports 32.

As a result, a negative pressure is generated below the die hole 53, and outside air is sucked through the die hole 53. Therefore, the scrap W1 generated when a workpiece W is worked is strongly sucked downward from the die hole 53 by the negative pressure generated based on air A from the downwardly inclined injecting port 32 of the nozzle member 46, and the scrap W1 is forcibly discharged out from the scrap escape hole 45 through the scrap discharge hole 35.

Figure 30:
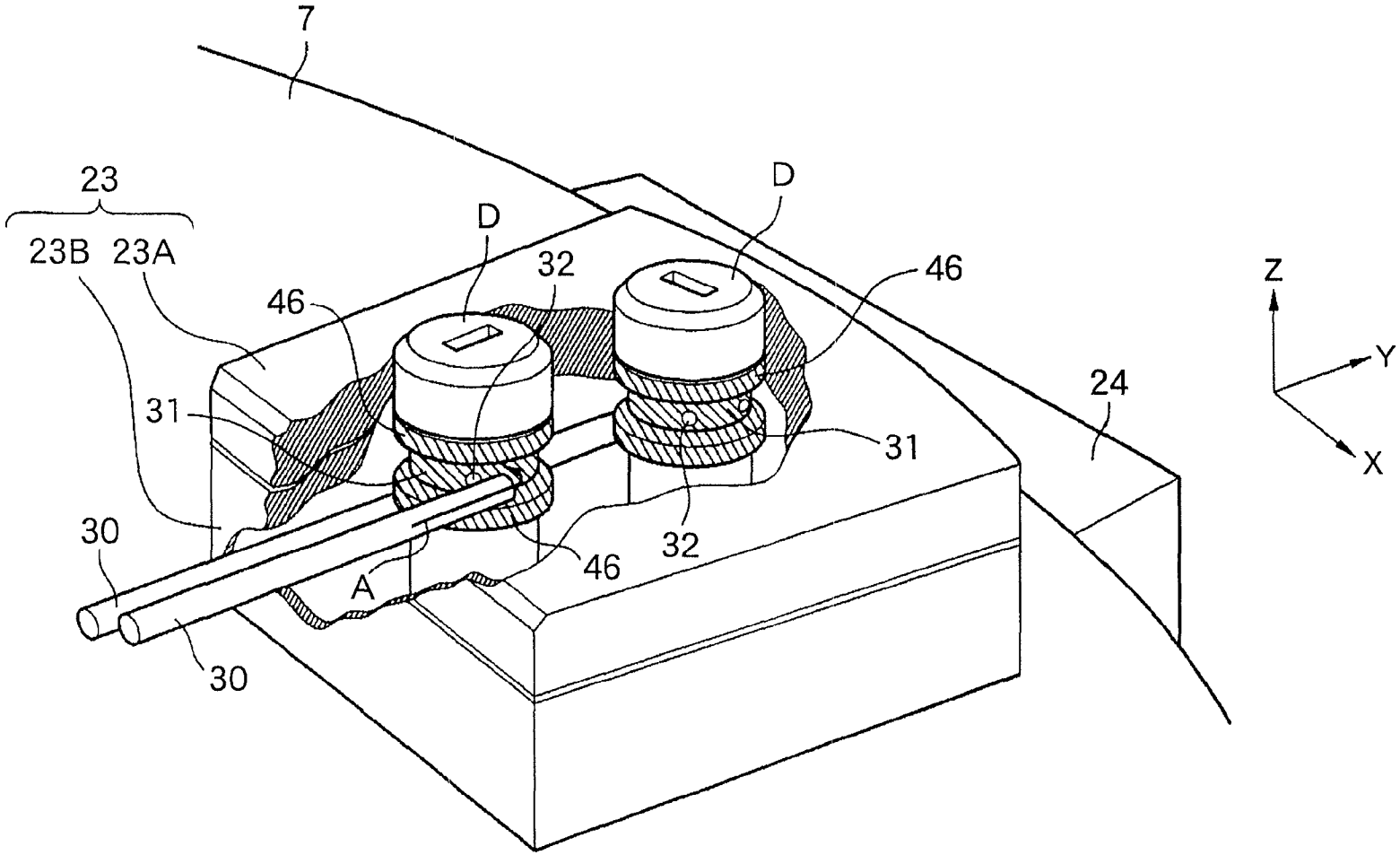
FIG. 30 is a diagram showing another embodiment when the injecting port is provided using the nozzle member in FIG. 19 (in the case of the two track system)

FIG. 30 shows another embodiment in which the injecting port 32 is provided using the nozzle member 46. Unlike FIG. 8, FIG. 30 shows a two track system in which two metal molds P and D can be selected in the radial direction. In this case, as described above (FIG. 16), two air introducing ports 29 on the lower surface of the lower turret 7 are provided for each die holder 23 on the lower turret 7, and two communication pipes 30 (FIG. 30) extending from the air introducing ports 29 enter the lower die holder 23B.

With the same structure as that of the communication pipes 30 for the innermost and outermost dies D shown in FIG. 20, the two communication pipes 30 for the inner and outer dies D enter the lower die holder 23B and then come into communication with the groove 31 of the nozzle member 46. That is, the communication pipe 30 (FIG. 30) for the inner die D enters the lower die holder 23B and straightly extends to a portion in the vicinity of the nozzle member 46 as shown in the drawing while maintaining the height of the communication pipe 30 at substantially the same level as the groove 31 of the nozzle member 46 of the die D and then, the communication pipe 30 is coupled to the intersecting horizontal pipe 30A (corresponding to FIGS. 22 and 23) similarly, and an outlet of the horizontal pipe 30A enters the groove 31 of the nozzle member 46.

The communication pipe 30 (FIG. 30) for the outer die D is located lower than the communication pipe 30 for the inner die D and is slightly displaced toward the nozzle member 46, i.e., displaced toward the groove 31 (corresponding to FIG. 27) of the nozzle member 46 by about half and in this state, the former communication pipe 30 enters the lower die holder 23B and extends straightly to a portion near the nozzle member 46 and then, similarly, the communication pipe 30 is coupled to the intersecting vertical pipe 30C (corresponding to FIGS. 28 and 29), and the vertical pipe 30C comes into communication with the groove 31 (FIG. 28) with the above-described structure.

Other structures shown in FIG. 30 are quite the same as those shown in FIG. 20 and thus, explanation thereof is omitted. In the case of a one track system (FIG. 15), one die D is mounted on each die holder 23, and the air introducing port 29 and the communication pipe 30 are provided one each. The relation between the communication pipe 30 and the nozzle member 46 as well as the structure of the nozzle member 46 are quite the same as those explained concerning the innermost die D shown in FIG. 20 and the inner die D shown in FIG. 30.

The original workpiece W from which the scrap W1 is sheared is grasped by a clamp 13 (FIG. 13) during working. The clamp 13 is mounted on a carriage 12. The carriage 12 is mounted on a carriage base 11 through an X-axis guide rail 16. A ball screw 15 of an X-axis motor Mx is threadedly engaged with the carriage 12. The carriage base 11 is slid and coupled to a Y-axis guide rail 17 on the lower frame 18, and a ball screw 14 of a Y-axis motor My is threadedly engaged with the carriage base 11.

With this structure, when the X-axis motor Mx and the Y-axis motor My are operated, the carriage 12 moves on the carriage base 11 in the X-axis direction and the carriage base 11 moves in the Y-axis direction. Therefore, the workpiece W grasped by the clamp 13 mounted on the carriage 12 can be transferred on a work table 10 and positioned on the punch center C, and punching operation is carried out, for example. A control apparatus of the turret punch press having the above-described structure comprises an NC apparatus 50 (FIG. 13). The NC apparatus 50 comprises a CPU 50A, a work controller 50B, a turret rotation controller 50C, a striker position controller 50D, an input/output unit 50E, a storage 50F and a workpiece positioning controller 500.

Figure 1:
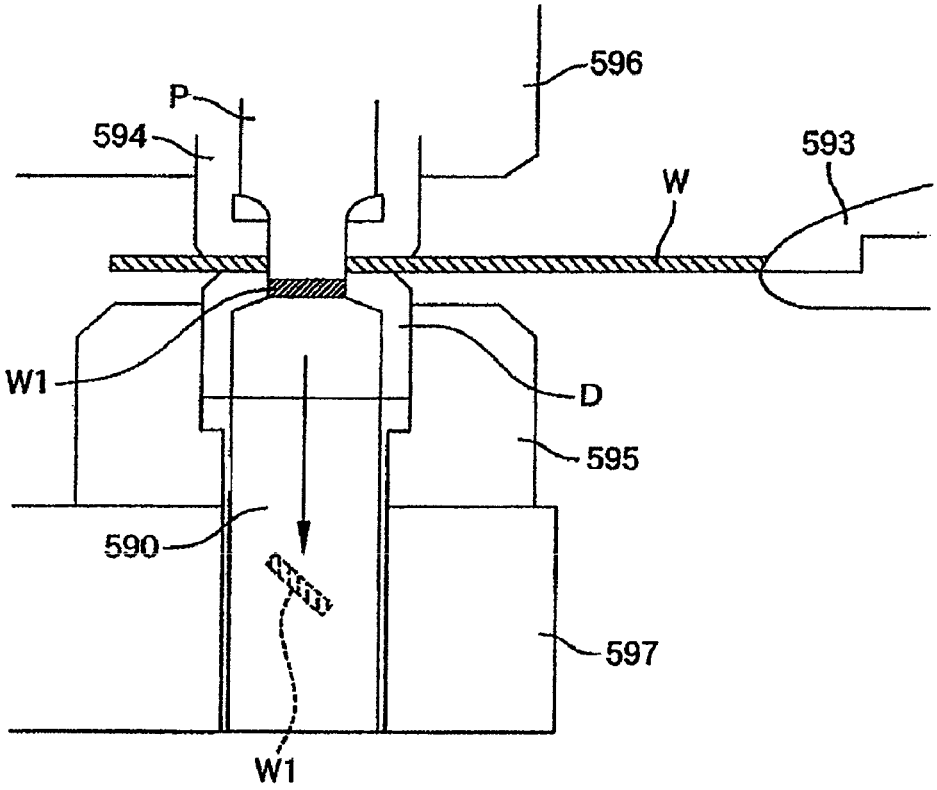
Prior Art FIG.1
FIG. 1 is a general explanatory view of a conventional turret punch press.
Figure 2:
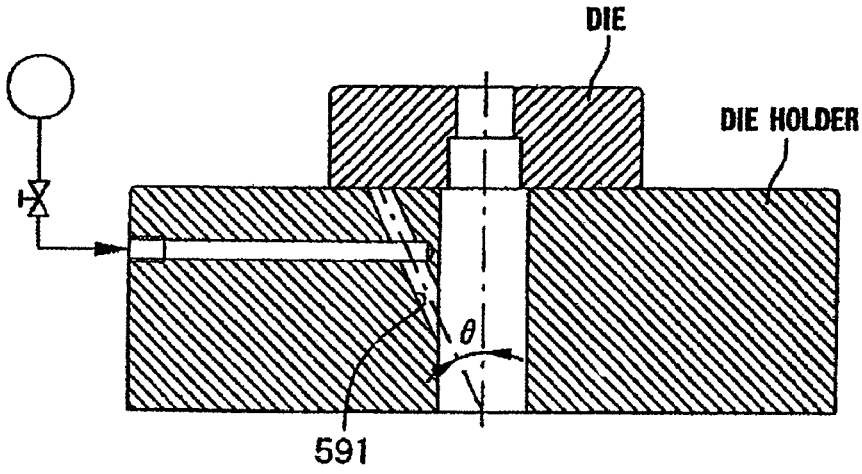
Prior Art FIG.2
FIG. 2 is an explanatory view of a first conventional technique.
Figure 3:
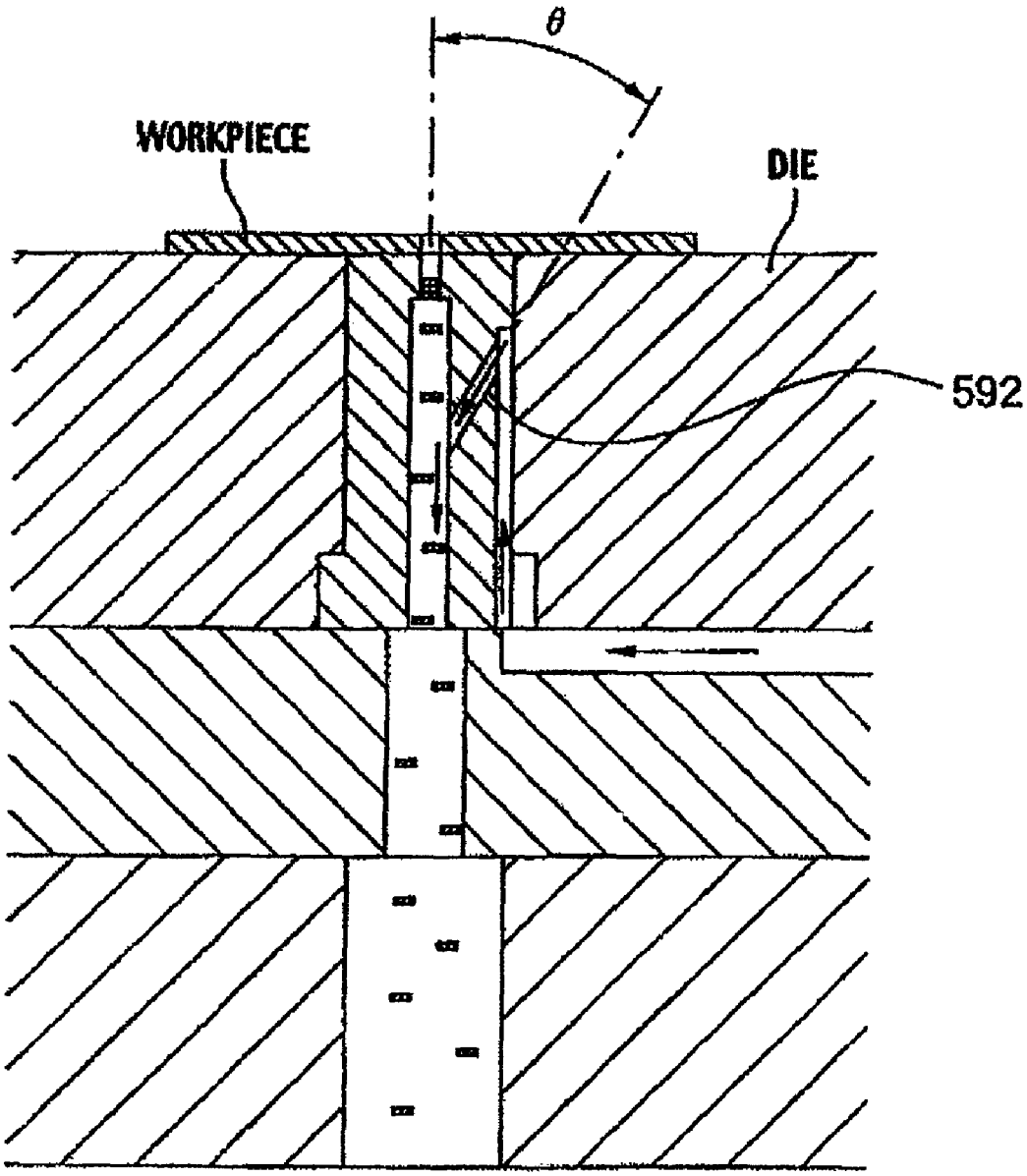
Prior Art FIG.3
FIG. 3 is an explanatory view of a second conventional technique.

The CPU 50A is a determination main unit of the NC apparatus 50. The CPU 50A controls the entire apparatus shown in FIG. 1 such as the work controller 50B and the turret rotation controller 50C. The work controller 50B operates the ram cylinder 19, and lowers the striker 2 positioned on the predetermined one of the track positions C1, C2, and C3, allows the striker 2 to strike a selected punch P, carries out predetermined work for the workpiece W in cooperation with a corresponding die D, or the work controller 50B operates the air source 25 during working, and supplies air A through the air supply port 28 connected to the air source 25.

The turret rotation controller 50C operates the motor M to rotate the turrets 6 and 7 around a turret center R, and positions the holders 22 and 23 on which desired metal molds P and D to be selected are mounted on the punch center C. The striker position controller 50D operates the striker cylinder 21 to position the striker 2 on predetermined one of the track positions C1, C2, and C3, switches the switching valve 34 such as to match the track positions C1, C2, and C3 of the striker 2 based on a feedback signal from the encoder of the striker cylinder 21 as described above, and connects only the corresponding air supply port 28 on the upper surface of the disk support 24 to the air source 25.

The input/output unit 50E inputs a work program, data and the like using keys or a mouse, a user confirms this input on a screen, and the input work program and the like are stored in the storage 50F. The workpiece positioning controller 50G operates the X-axis motor Mx and the Y-axis motor My, and positions a workpiece W grasped by the clamp 13 on the punch center C.

The operation of this invention having the above structure will be explained below. For example, when a workpiece W is transferred from a workpiece transfer apparatus (not shown) to the turret punch press (FIG. 13), the CPU 50A detects this operation. The CPU 50A controls the workpiece positioning controller 50G and drives the X-axis motor Mx and the Y-axis motor My, and positions the workpiece W grasped by the clamp 15 on the punch center C.

The CPU 50A then operates the motor M through the turret rotation controller 50C, rotates the turrets 6 and 7 in synchronism with each other, and positions the holders 22 and 23 on which desired metal molds P and D to be selected on the punch center C.

The CPU 50A then operates the striker cylinder 21 through the striker position controller 50D, positions the striker 2 on predetermined track positions C1, C2, and C3 of the metal molds P and D to be selected and then, controls the work controller 50B to operate the ram cylinder 19, and lowers the positioned striker 2 to strike the selected punch P, and carries out predetermined work for the workpiece W in cooperation with the corresponding die D.

At the same time, the CPU 50A controls the striker position controller SOD, switches the switching valve 34 such as to match the track positions C1, C2, and C3 of the striker 2 based on a feedback signal from the encoder of the striker cylinder 21, and connects only the corresponding air supply port 28 on the upper surface of the disk support 24 to the air source 25.

With this structure, air A supplied from the corresponding air supply port 28 (for example, FIG. 18) connected to the air source 25 passes through the communication pipe 30 from the air introducing port 29, and is injected toward the scrap discharge hole 35 from the downwardly inclined injecting port 32 through the annular groove 31 of the ejector pipe 33.

Therefore, a negative pressure is generated below the die hole 53 based on the air A from the downwardly inclined injecting port 32 of the ejector pipe 33, the scrap W1 generated when a workpiece W is worked is strongly sucked downward from the die hole 53, and the scrap W1 is forcibly discharged out from the scrap escape hole 45 through the scrap discharge hole 35.

As described above, according to the present invention, there is an effect that it is possible to provide a scrap floating prevention mechanism which can be applied to a turret punch press, to a standard metal mold, and a small metal mold, and it is possible to provide a nozzle member, a die, and a die apparatus.

A second embodiment of the present invention will be explained next, with reference to FIGS. 31 to 37.

Figure 31:
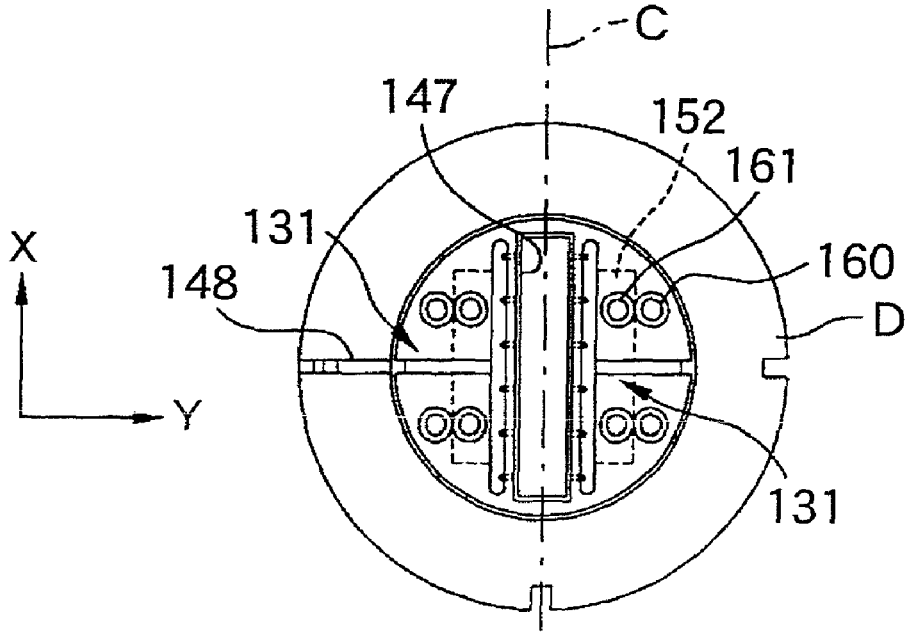
FIG. 31 is a partial sectional plan view showing a second embodiment of the present invention (in the case of metal molds P and D of 3.5 inches)
Figure 32:
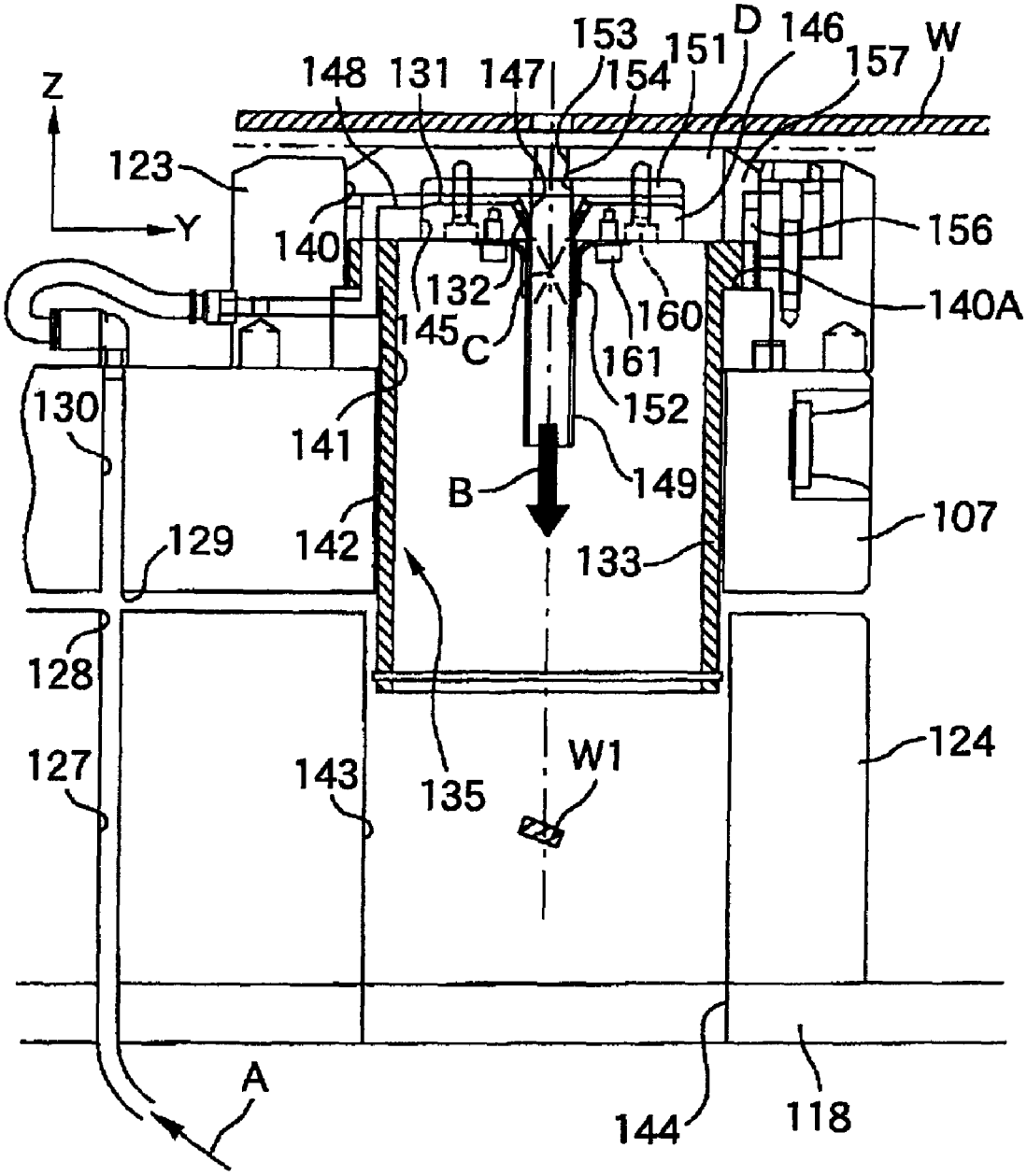
FIG. 32 is a partial sectional front view showing a second embodiment of the present invention (in the case of metal molds P and D of 3.5 inches)
Figure 33:
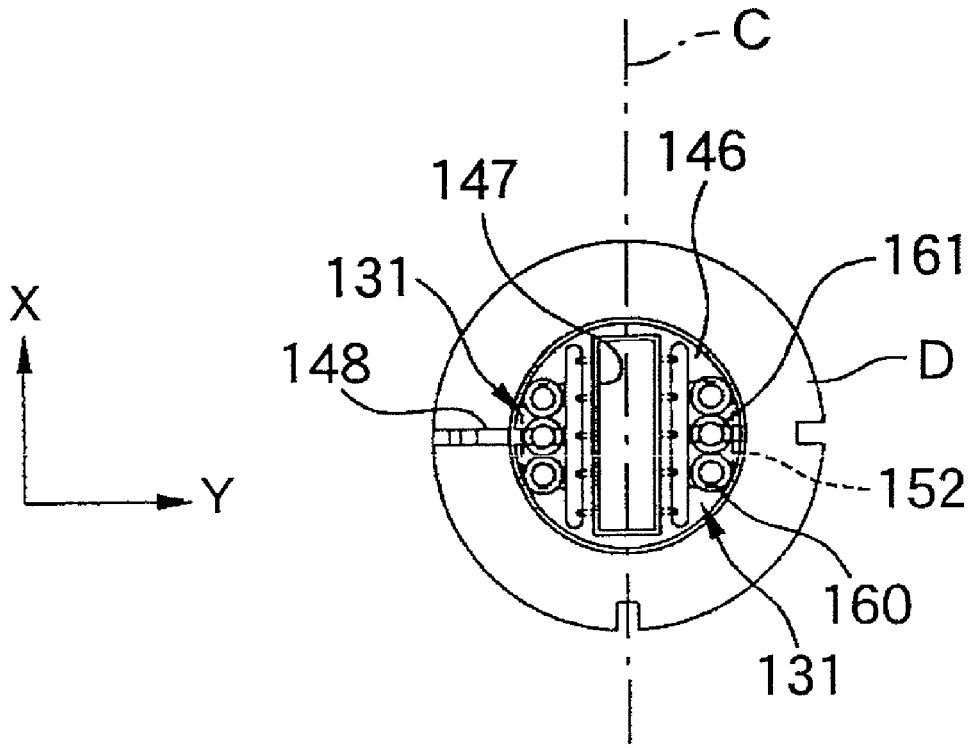
FIG. 33 is a partial sectional plan view showing an embodiment in which the second embodiment is partially modified (in the case of metal molds P and D of 2 inches)
Figure 34:
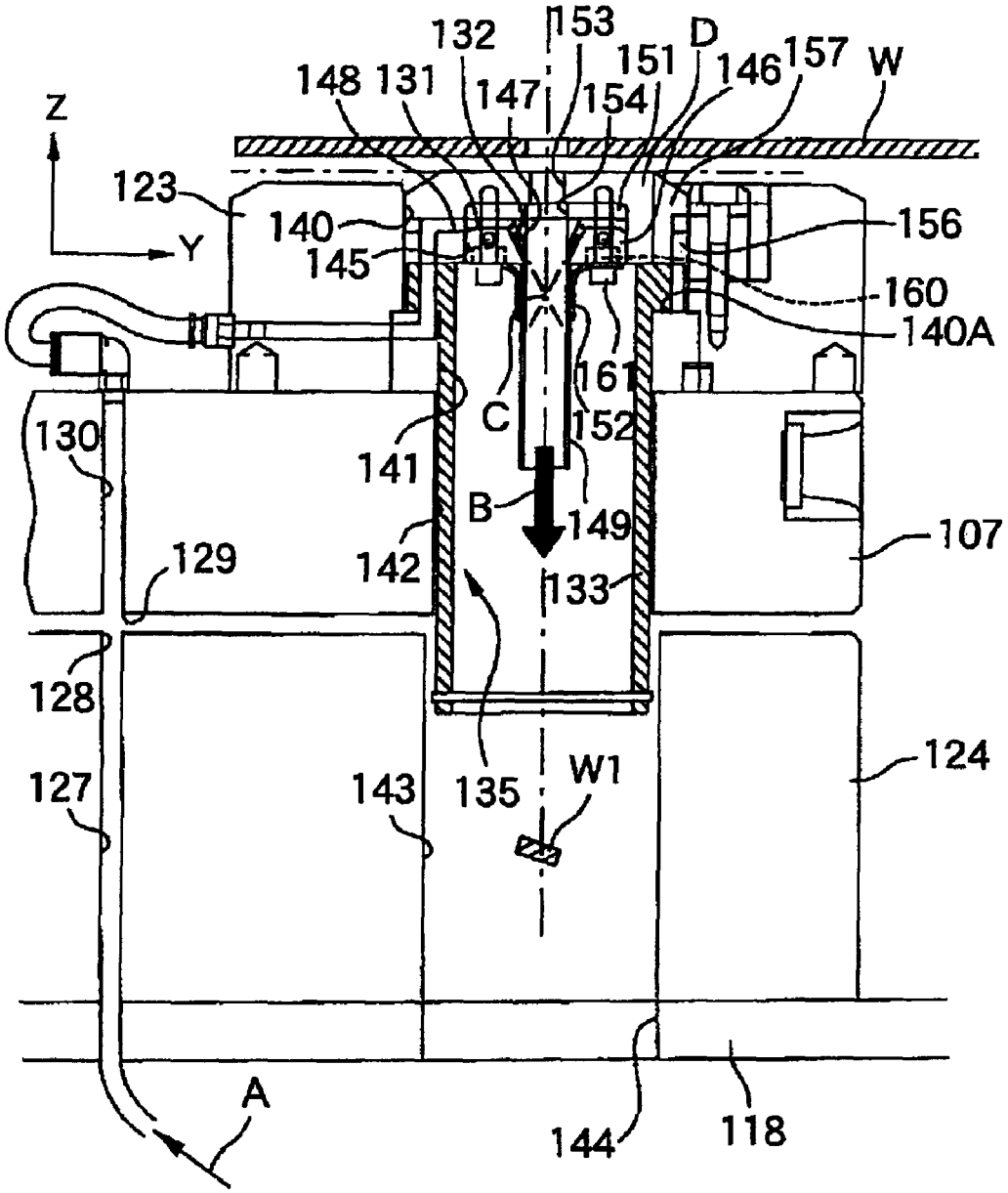
FIG. 34 is a partial sectional front view showing an embodiment in which the second embodiment is partially modified (in the case of metal molds P and D of 2 inches)
Figure 35:
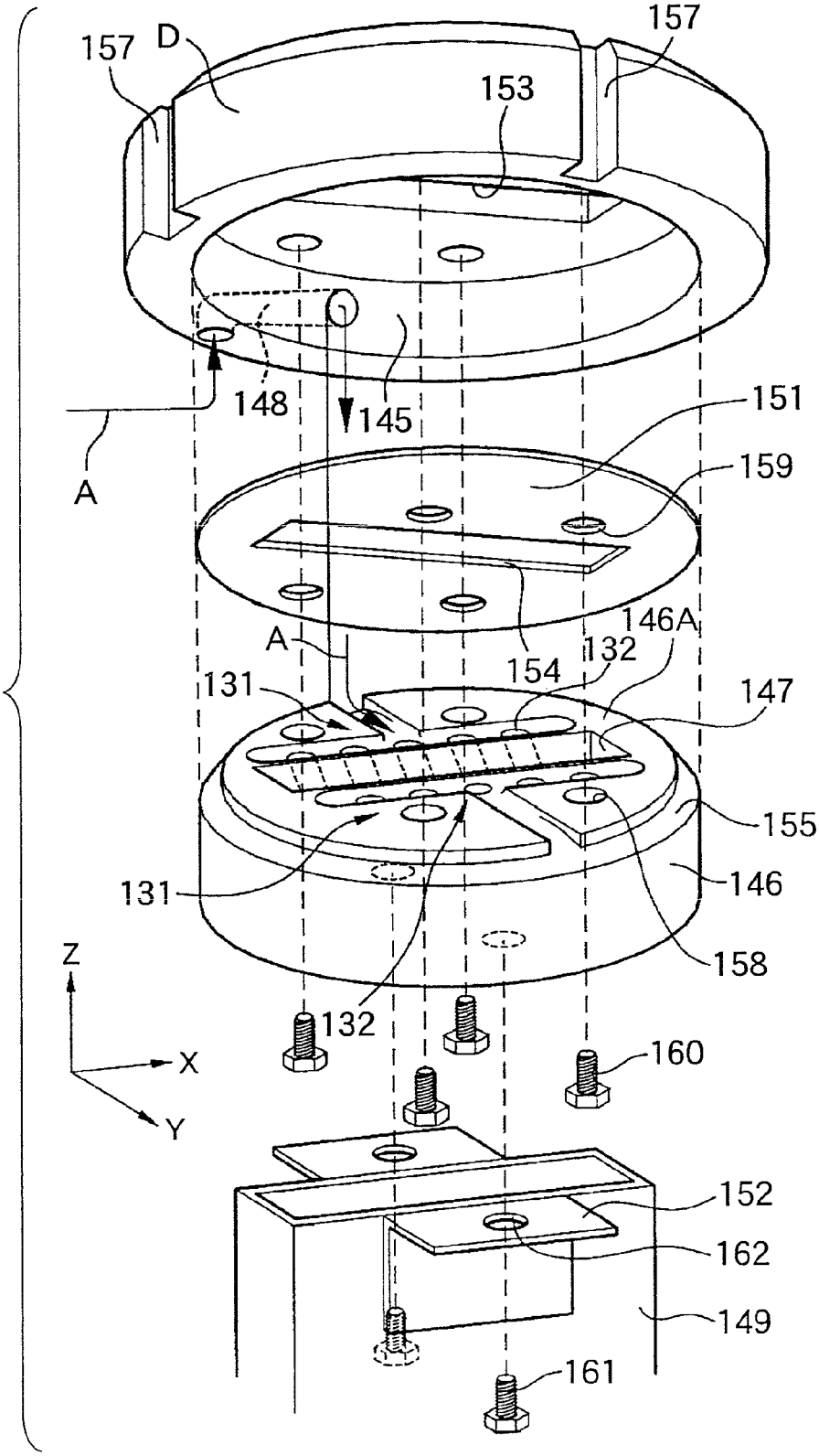
FIG. 35 is a perspective view of an apparatus shown in FIGS. 34 and 35.
Figure 36:
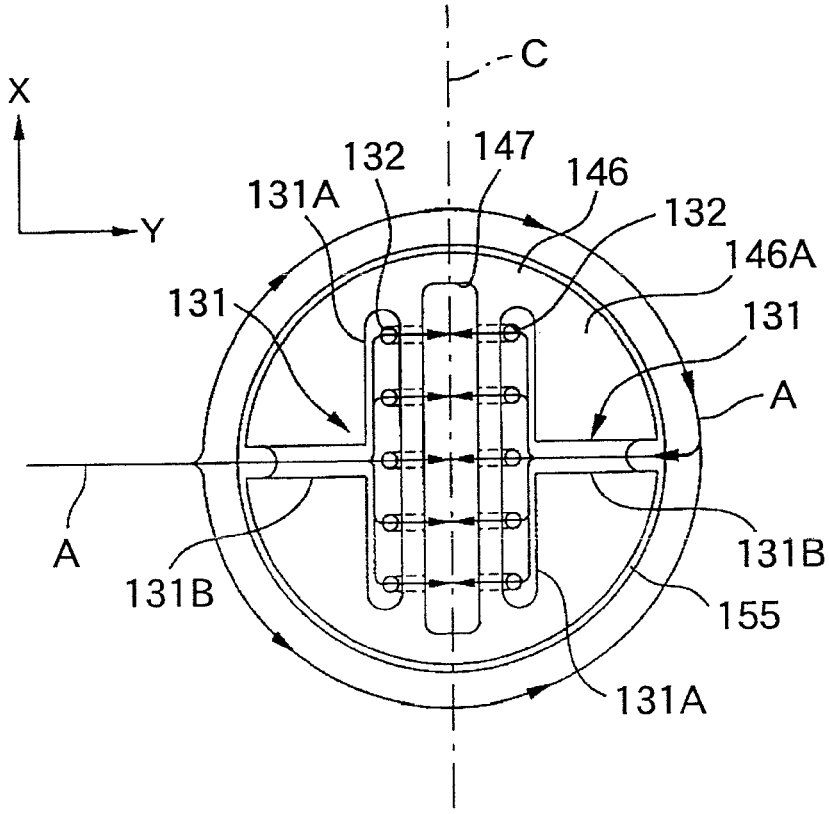
FIG. 36 is a partial sectional plane view for explaining the effect of the of the present invention.
Figure 37:
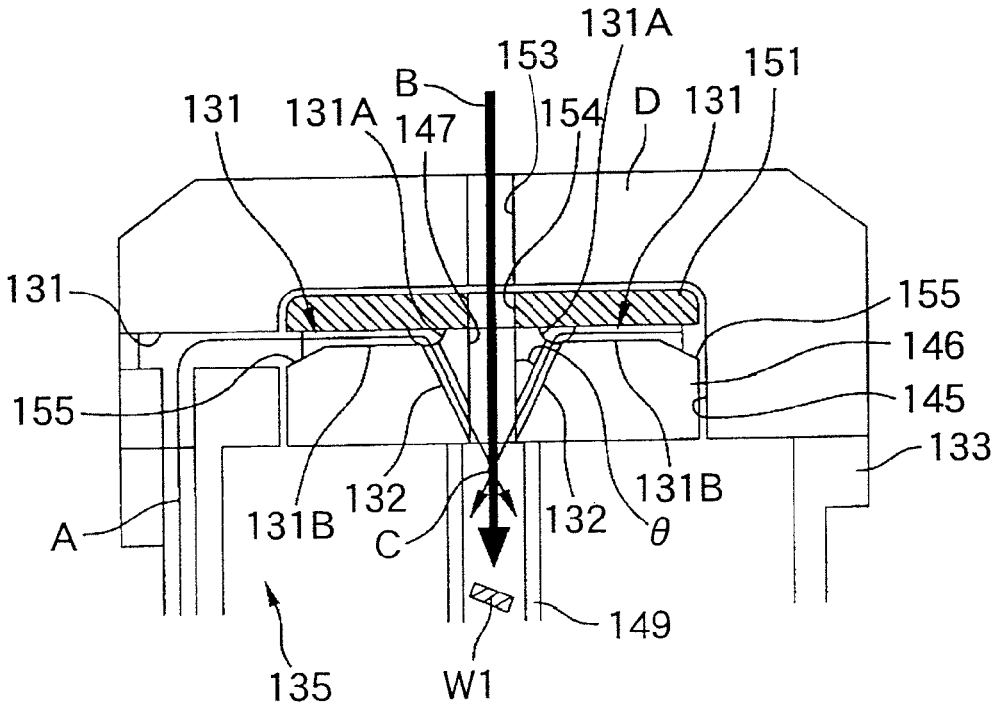
FIG. 37 is a partial sectional front view for explaining the effect of the invention.

FIGS. 31 and 32 show the second embodiment of the present invention, and FIGS. 33 and 34 show an embodiment in which the second embodiment of the invention is partially modified. The former embodiment is for 3.5 inches, and the latter embodiment is for 2 inches. In any of the cases, a die D constitutes a large more and thin blade metal mold, a shielding plate 151 and a nozzle member 146 are incorporated in the die D, and the nozzle member 146 is provided with a duct 149.

In these drawings, only sizes of the die D, the shielding plate 151, the nozzle member 146, the duct 149 and the ejector pipe 133 are different, and the coupling relations therebetween are the same. FIGS. 33 and 34 (2 inches) will be mainly explained below.

In FIGS. 33 and 34, a die D is mounted on a die holder 123 through keys 156 (FIG. 34) and key grooves 157. A scrap discharge hole 135 is provided below the die D. An ejector pipe 133 is inserted into the scrap discharge hole 135. The ejector pipe 133 pushes up the die D when the metal mold is to be replaced. That is, an opening 141 formed in the die holder 123 into which the die D is inserted, an opening 142 formed in the lower turret 107, an opening 143 formed in the disk support 124 and an opening 144 formed in the lower frame 118 constitute the scrap discharge hole 135.

A flange of the ejector pipe 133 on which the die D is placed is engaged with a shoulder 140A of an insertion hole 140. In the ejector pipe 133, a duct 149 mounted on a lower surface of the nozzle member 146 extends to a half-height position as compared with the ejector pipe 133.

A communication pipe 130 upwardly extends from an air introducing port 129 on the lower surface of the lower turret 107 and penetrates the lower turret 7 and is bent and enters into the die holder 23. The communication pipe 130 penetrates the ejector pipe 133 and comes into communication with an air inlet 148 formed in the die D.

Further, the air inlet 148 is in communication with introducing portions 131 formed in the nozzle member 146. The introducing portion 131 is formed with a plurality of injecting ports 132 which downwardly inclined toward inside of the discharge hole 147 of the nozzle member 146. In the die D, the nozzle member 146 is incorporated through the shielding plate 151. The duct 149 is mounted on the nozzle member 146. The nozzle member 146 has a flat cylindrical shape (FIG. 35), and the die hole 153 and a discharge hole 147 which comes into communication with a through hole 154 of the later-described shielding plate 151 are formed in the nozzle member 146.

An opening of the discharge hole 147 is slightly larger than that of the die hole 153, and is of 7 mm×44 mm, for example. On both sides of the discharge hole 147 (FIG. 36) and on an upper surface 146A of the nozzle member 146, a T-shaped groove 131 is formed. The T-shaped groove 131 constitutes an introducing portion for introducing air A to a later-described ejecting port 132.

The T-shaped groove 131 comprises a portion 131A which provided in the vicinity of the discharge hole 147 and is in parallel thereto, and a portion 131B which comes into communication with the parallel portion 131A and intersects with the parallel portion 131A and extends outward.

As shown in the drawing, the parallel portion 131A (FIG. 36) is formed with the plurality of injecting ports 132 in the longitudinal direction, and the injecting ports 132 are downwardly inclined toward the discharge hole 147. In this case, the inclination angle θ (FIG. 37) of the injecting ports 132 on both sides of the discharge hole 147 is set to such an angle that air A injected from injecting ports 132 on both sides converges to a position C in the duct 149 directly below the outlet of the discharge hole 147.

A step or level is formed on an outer periphery (FIG. 35) of the upper surface 146A of the nozzle member 146 and this portion is lowered by one level as shown in the drawing, and an annular downwardly inclined air passage 55 is formed. The intersecting portion 131B constituting the T-shaped groove 131 is in communication with the annular air passage 155.

The shielding plate 151 is made of nylon, for example. The shielding plate 151 shields the upper surface 146A of the nozzle member 146 so that the T-shaped groove 131 and the air passage 155 on the outer periphery are closed. The shielding plate 151 has a function for bringing the nozzle member 146 into tight contact with a wall surface of a scrap escape hole 145 of the die D. The shielding plate 151 is formed at its central portion with a through hole 154 having an opening (for example, 7 mm×44 mm) which is substantially the same size as that of the discharge hole 147 of the nozzle member 146.

For example, the duct 149 is of rectangular parallelepiped as a whole. Its opening is slightly larger than that of the discharge hole 147 of the nozzle member 146 and is of 8 mm×45 mm, for example. Brackets 152 are mounted on both sides of the duct 149.

The duct 149 converges air A injected from the injecting ports 132 to the position C (FIGS. 36 and 37), and generates a great negative pressure generated around the position C. The duct 149 converges outside air sucked from the die hole 153 with the negative pressure to a narrow region, thereby strengthening the suction, and allowing the scrap W1 sucked by the strengthened suction to pass.

With this structure, the shielding plate 151 is placed on the upper surface 146A (FIG. 35) of the nozzle member 146, the through hole 154 is aligned with the discharge hole 147 of the nozzle member 146, the shielding plate 151 is abutted against a ceiling of the scrap escape hole 145, and an inlet of the duct 149 is aligned with an outlet of the discharge hole 147 of the nozzle member 146. In this state, the bracket 152 is abutted against the lower surface of the nozzle member 146.

In this state, bolts 160 are inserted through holes 158 and 159 from below the nozzle member 146 and threadedly engaged with the ceiling of the scrap escape hole 145 of the die D, and bolts 161 are inserted through holes 62 from below the bracket 152 and engaged with the lower surface of the nozzle member 146. With this structure, in a state where the duct 149 is mounted through the shielding plate 151, the nozzle member 146 is brought into tight contact with the wall surface of the scrap escape hole 145, and the nozzle member 146 can be incorporated in the die D. Accordingly, for example, the inlet of the intersecting portion 131B constituting the left T-shaped groove 131 (FIG. 37) comes into communication with the air inlet 148 of the die D, the T-shaped grooves 131 on both sides of the discharge hole 147 are closed by the shielding plate 151, and the annular air passage 155 on the outer periphery of the nozzle member 146 is closed by the wall surface of the scrap escape hole 145 of the die D and the shielding plate 151.

Therefore, the air A (FIG. 36) which entered from the air inlet 148 of the die D passes through the intersecting portion 131B of the left T-shaped groove 131 and enters the parallel portion 131A and is injected from the injecting ports 132 on the one hand, and the air A circulates through the annular air passage 155 and passes through the intersecting portion 131B of the right T-shaped groove 131 and then enters the parallel portion 131A and is injected from the injecting ports 132 on the other hand.

As described above, air A injected from the injecting ports 132 on the both sides of the discharge hole 147 (FIG. 37) of the nozzle member 146 is converged to the position C in the duct 149 directly below the outlet of the discharge hole 147. Thus, a great negative pressure is generated around the position C.

Therefore, based on this great negative pressure, a large amount of outside air B is sucked through the die hole 153, the large amount of air B passes through the through hole 154 of the shielding plate 151 and the discharge hole 147 of the nozzle member 146 and then, is concentrated in the duct 149 and passes therethrough. With this structure, a scrap W1 generated when the workpiece W is worked (FIG. 34) is strongly sucked downward from the die hole 153, and the scrap W1 is forcibly discharged outside through the through hole 154 of the shielding plate 151 and the discharge hole 147 of the nozzle member 146. Even when the scrap W1 is large and is made of large bore and thin blade metal mold, scrap floating can be prevented easily.

Figure 38:
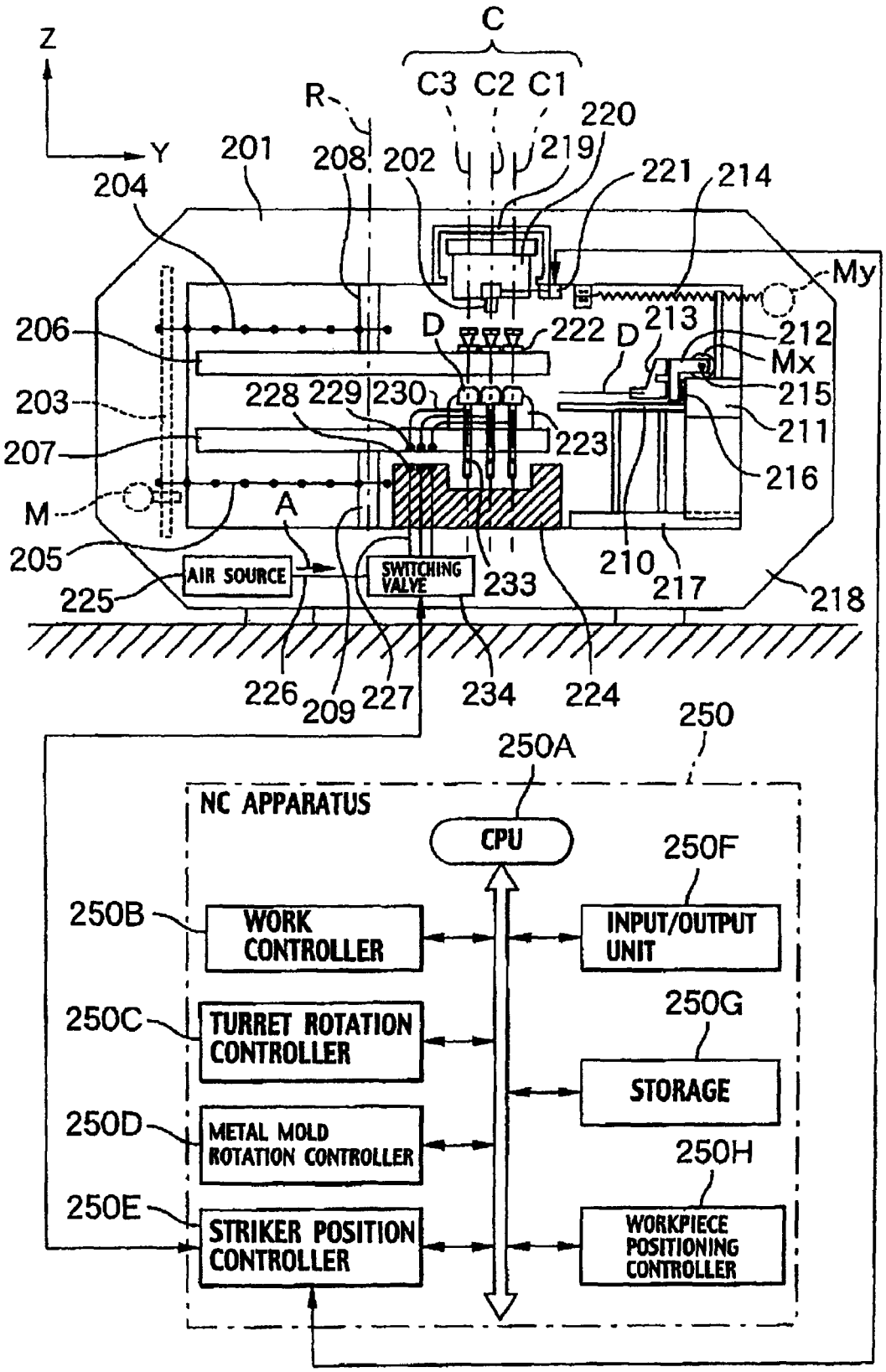
FIG. 38 is a diagram showing an entire turret punch press of a third embodiment of the present invention.

The turret punch press shown in FIG. 38 includes an upper turret 206 and a lower turret 207. A metal mold comprising a plurality of punches P and dies D is disposed on the upper turret 206 and the lower turret 207 through a punch holder 222 and a die holder 223, respectively.

As shown in the drawing, chains 204 and 205 are respectively wound around a rotation shaft 208 of the upper turret 206 and a rotation shaft 209 of the lower turret 207, and the chains 204 and 205 are wound around a drive shaft 203.

With this structure, when the motor M is operated to rotate the drive shaft 203 and the chains 204 and 205 are rotated, the upper turret 206 and the lower turret 207 rotate in synchronism with each other, and desired one of metal molds can be selected at the punch center C.

The turret punch press shown in FIG. 38 rotates the turrets 206 and 207 and positions metal molds of three tracks, which includes a desired mold, for example in the radial direction at the punch centers C.

A later-described striker cylinder 221 is then driven, a striker 202 is positioned on corresponding one of track positions C1, C2, and C3, the striker 202 strikes the punch P of the selected metal mold, and carries out the punching operation of the workpiece W in cooperation with the die D.

The striker 202 can be positioned on the punch center C in the Y-axis, the striker 202 is slid and coupled to a ram 220, the striker cylinder 221 mounted on an outer surface of the ram 220, and the ram 220 is vertically by a ram cylinder 219 provided on the upper frame 1.

With this structure, when the striker cylinder 221 is driven, the striker 202 can be positioned on the track positions C1, C2, and C3 directly above the metal molds P and D to be selected. In this state, when the ram cylinder 219 is driven, the ram 220 is lowered, and the striker 202 strikes the selected punch P and a predetermined punching work is carried out.

In this case, the fact as to which one of the track positions C1, C2, and C3 the striker 202 is positioned depends on the number of metal molds P and D mounted on the holders 222 and 223. In the case of the three track system, the striker 202 is positioned on any one of the three track positions C1, C2, and C3. In the case of the two track system, the striker 202 is positioned on one of the track positions C1 and C3. In the case of the one track system, the striker 202 is positioned on the middle track position C2.

A disk support 224 is disposed on the punch center C below the lower turret 207. The disk support 224 receives pressure which is received by the turret 207 when the striker 202 strikes the punch P.

Air supply ports 228 as many as the metal molds P and D which can be selected at the punch center C are provided on the upper surface of the disk support 224.

For example, as shown in the drawing, when one of three metal molds of three tracks in the radial direction can be selected at the punch center C, three air supply ports 228 are provided on the upper surface of the disk support 224 (FIG. 38).

The three air supply ports 228 are coupled to a switching valve 234 (for example, solenoid valve) through a branch pipe 227. The switching valve 234 is coupled to an air source 225 through a main pipe 226.

With this structure, when a striker position controller 250D constituting a later-described NC apparatus 250 detects the track positions C1, C2, and C3 of the striker 202 based on a feedback signal from an encoder of the striker cylinder 221, the switching valve 234 is switched such as to match the track positions C1, C2, and C3, and only corresponding one of the three air supply ports 228 can be connected to the air source 225.

An air introducing port 229 which is in communication with a later-described injecting port 232 (for example, FIG. 41) is provided at a position on the lower surface of the lower turret 207 corresponding to a position directly above the air supply ports 228 of the disk support 224.

The air introducing port 229 is provided for each die holder 223. The number of air introducing ports 229 provided in the die holders 223 corresponds to the number of dies D mounted on the die holders 223, i.e., the number of tracks.

In FIG. 38, for example, one of the three metal molds in the radial direction of three tracks can be selected. With this structure, a die D is mounted on each die holder 223 on the lower turret 207 in the radial direction for each of the tracks T1, T2, and T3.

Three air introducing ports 229 are provided in each die holder 223 at a position above the lower surface of the lower turret 207 and directly above the air supply ports 228 in correspondence with the three dies D mounted on the die holder 223.

When one of metal molds P and D of two tracks T1 and T2 can be selected, the number of air introducing ports 229 on the lower surface of the lower turret 207 is two with respect to the three air supply ports 228 on the upper surface of the disk support 224.

When only metal molds P and D of one track T can be selected, the number of air introducing ports 229 on the lower surface of the lower turret 207 is one with respect to the three air supply ports 228 on the upper surface of the disk support 224.

With this structure, when the turrets 206 and 207 are rotated in synchronism with each other and the die holder 223 on which one die D to be selected is positioned on the punch center C (FIG. 38), one of the air introducing ports 229 on the lower surface of the lower turret 207 is positioned directly above the uppermost air supply port 228 of the three air supply ports 228 on the upper surface of the disk support 224 as viewed in FIG. 4, and only the uppermost air supply port 228 is connected to the air source 225 (FIG. 38).

In the case of the one track system, the punch holder 222 and the die holder 223 on which the punch P and the die D are mounted can rotate in some cases. With this structure, the punch P and the die D positioned on the punch center C can be rotated through desired angle. According to the present invention, as will be described later (FIGS. 41 to 49), air A can be supplied no matter which angle the punch P and the die D are positioned, and scrap floating can be prevented using air.

In this case, the punch holder 222 and the die holder 223 are mounted on a punch receiver 263 and a die receiver 264 provided on the upper turret 206 (FIG. 35) and the lower turret 207, respectively. Worm wheels 265 and 266 are provided around outer peripheries of the punch receiver 263 and the die receiver 264. The worm wheels 265 and 266 mesh with worms 267 and 268, respectively.

As shown in the drawing, two punch receivers 263 and two die receivers 264 are disposed on the upper turret 206 and the lower turret 207 such that they are opposed to each other. Clutches 271B and 272B are mounted on outer sides of the worms 267 and 268, and outer sides thereof are connected to universal joints 271A and 272A through connection shafts 271 and 272 having vibration suppressing brakes 273 and 274, respectively.

Figure 39:
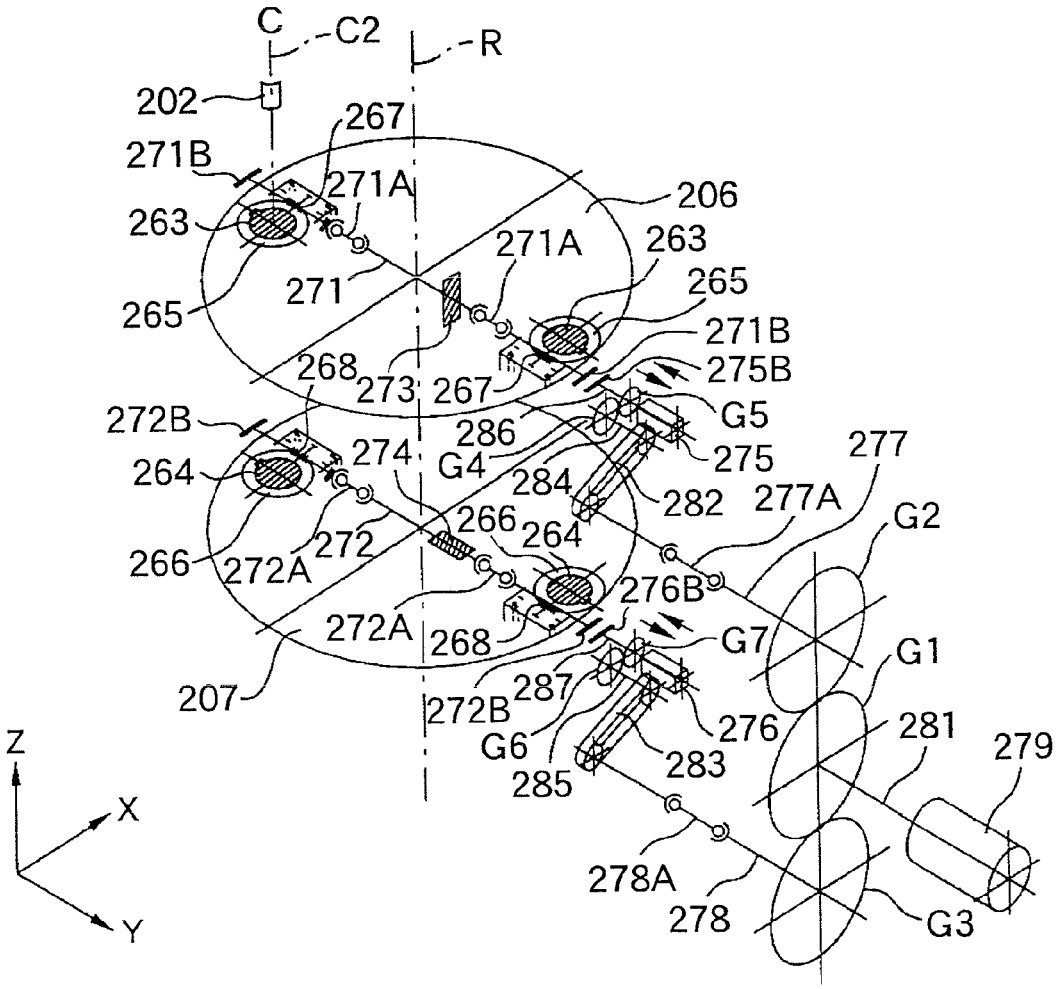
FIG. 39 is a diagram showing a metal mold rotation mechanism used in the invention.

In FIG. 39, follower clutches 271B and 272B of the front worms 267 and 268 are opposed to driving clutches 275B and 276B. The driving clutches 275B and 276B can be engaged with and disengaged from the follower clutches 271B and 272B by means of intermediate driving units 275 (for example, cylinder) and 276, respectively as is well known. A rotating apparatus using a rotating unit 279 (for example, motor) as a driving source is disposed behind the intermediate driving units 275 and 276 as shown in the drawing.

With this structure, when the corresponding punch P and die D are positioned on the punch center C, the cylinders 275 and 276 are driven, power-transmitting shafts 286 and 287 coupled thereto project, power-transmitting gears G5 and G7 slide on intermediate gears G4 and G6 which are long in the Y-axis, and the driving clutches 275B and 276B on the tip ends of the power-transmitting shafts 286 and 287 engage with the follower clutches 271B and 272B.

When the motor 279 is driven in this state, the rotation of a drive shaft 281 is transmitted to input shafts 277 and 278 having universal joints 277A and 278A through vertical gears G2 and G3 from the tip end gear G1. Rotation of the input shafts 277 and 278 is transmitted to intermediate shafts 284 and 285 through toothed timing belts 282 and 283, and transmitted to the power-transmitting shafts 286 and 287 through the intermediate gears G4 and G6 and the power-transmitting gears G5 and G7, and transmitted to the connection shafts 271 and 272 from the engaged clutches 275B and 271B as well as 276B and 272B as described above.

With this structure, since the worms 267 and 268 rotate, the worm wheels 265 and 266 which mesh with the worms also rotate, the punch receiver 263 and the die receiver 264 also rotate, and the punch P and the die D can be rotated through desired angle.

Figure 40:
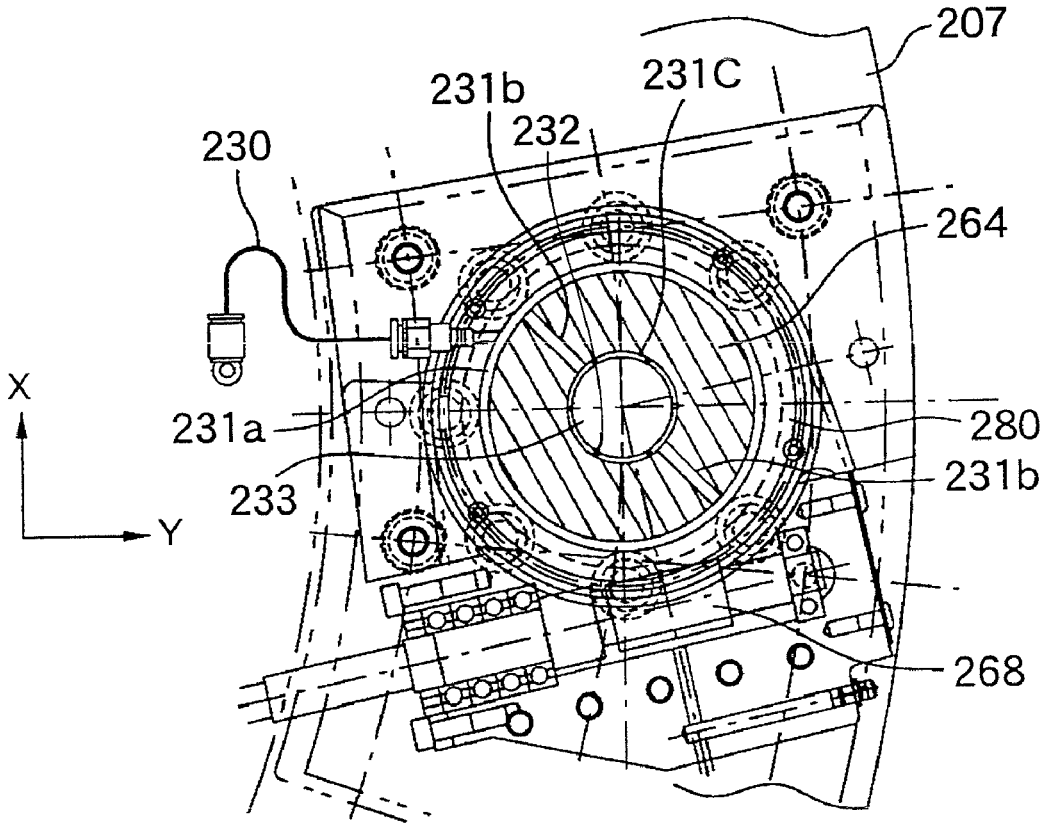
FIG. 40 is a plan view showing an essential portion of the third embodiment (in the case of metal molds P and D of 1·¼ inches)
Figure 41:
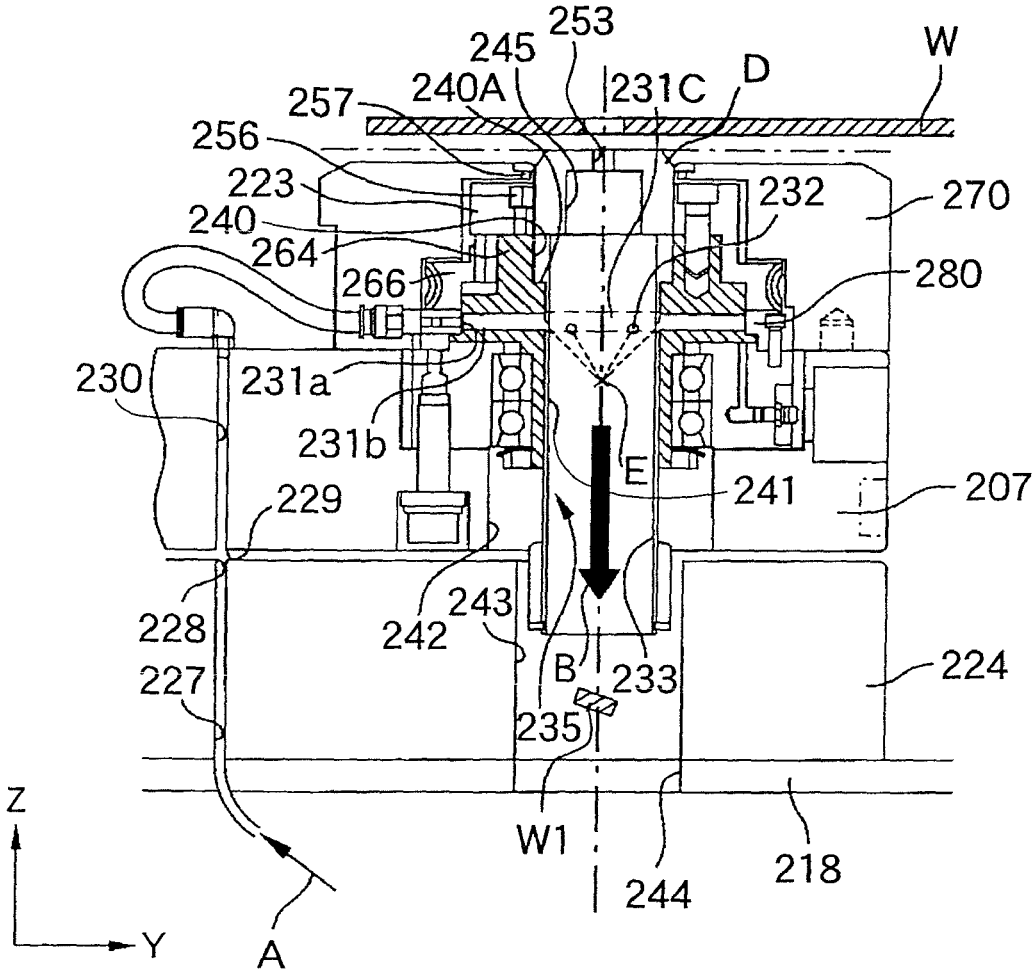
FIG. 41 is a partial sectional front view showing an essential portion of the third embodiment (in the case of metal molds P and D of 1·¼ inches)
Figure 42:
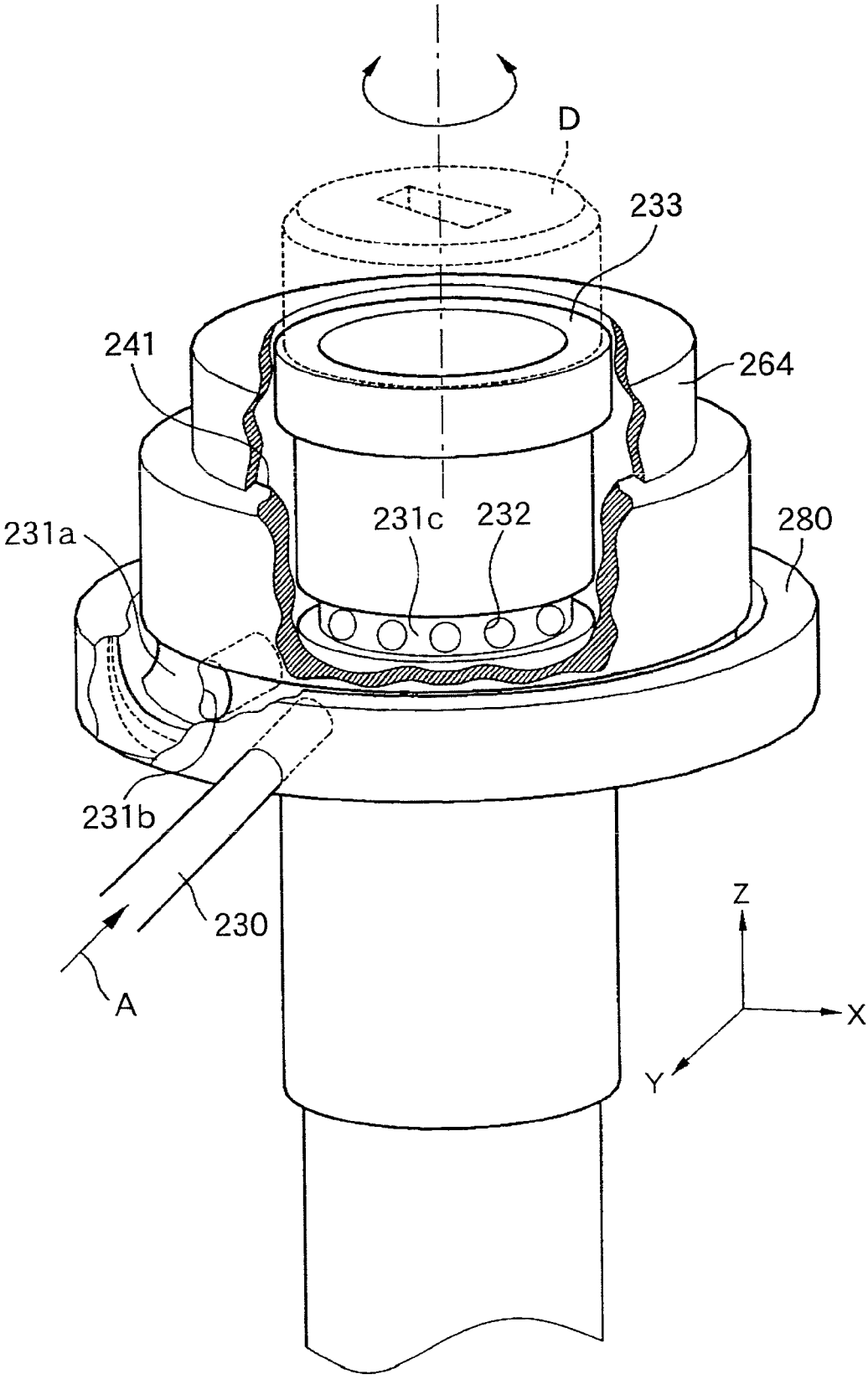
FIG. 42 is a diagram showing an air introducing portion shown in FIGS. 40 and 41.
Figure 45:
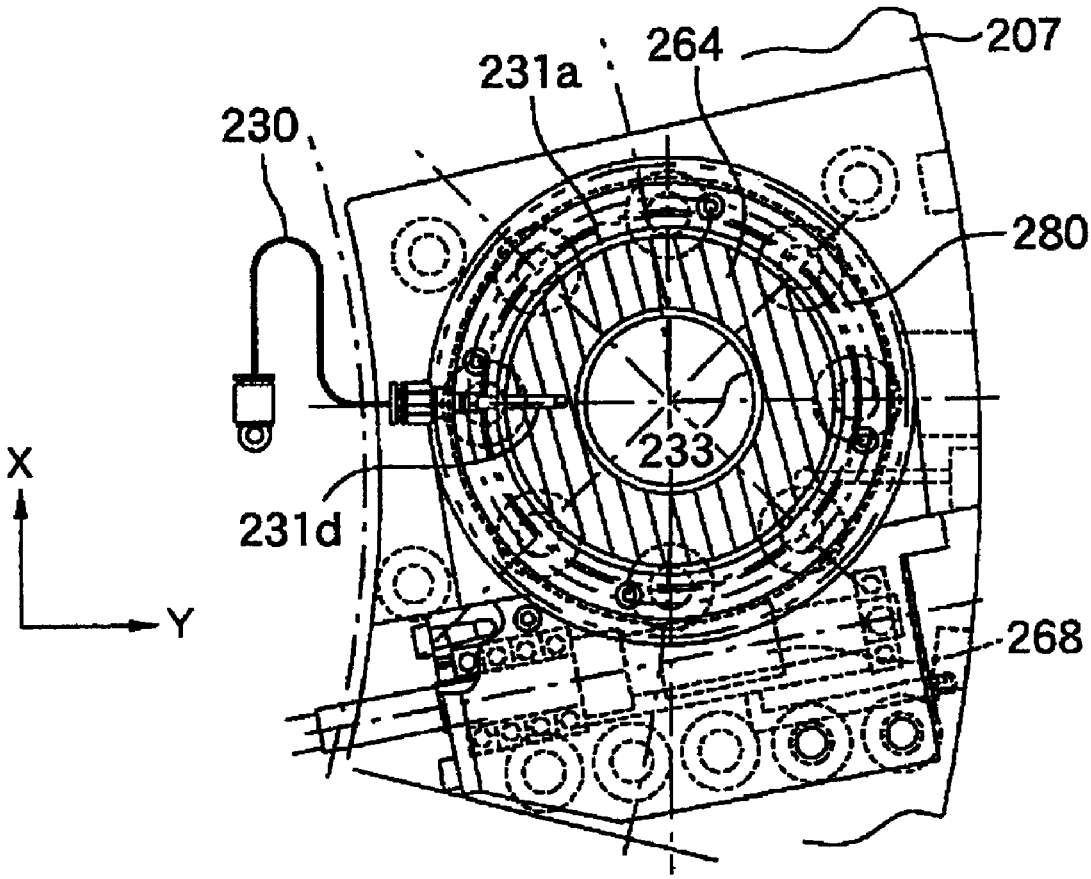
FIG. 45 is a plan view showing a fourth embodiment of the present invention (in the case of metal molds P and D of 2 inches)
Figure 46:
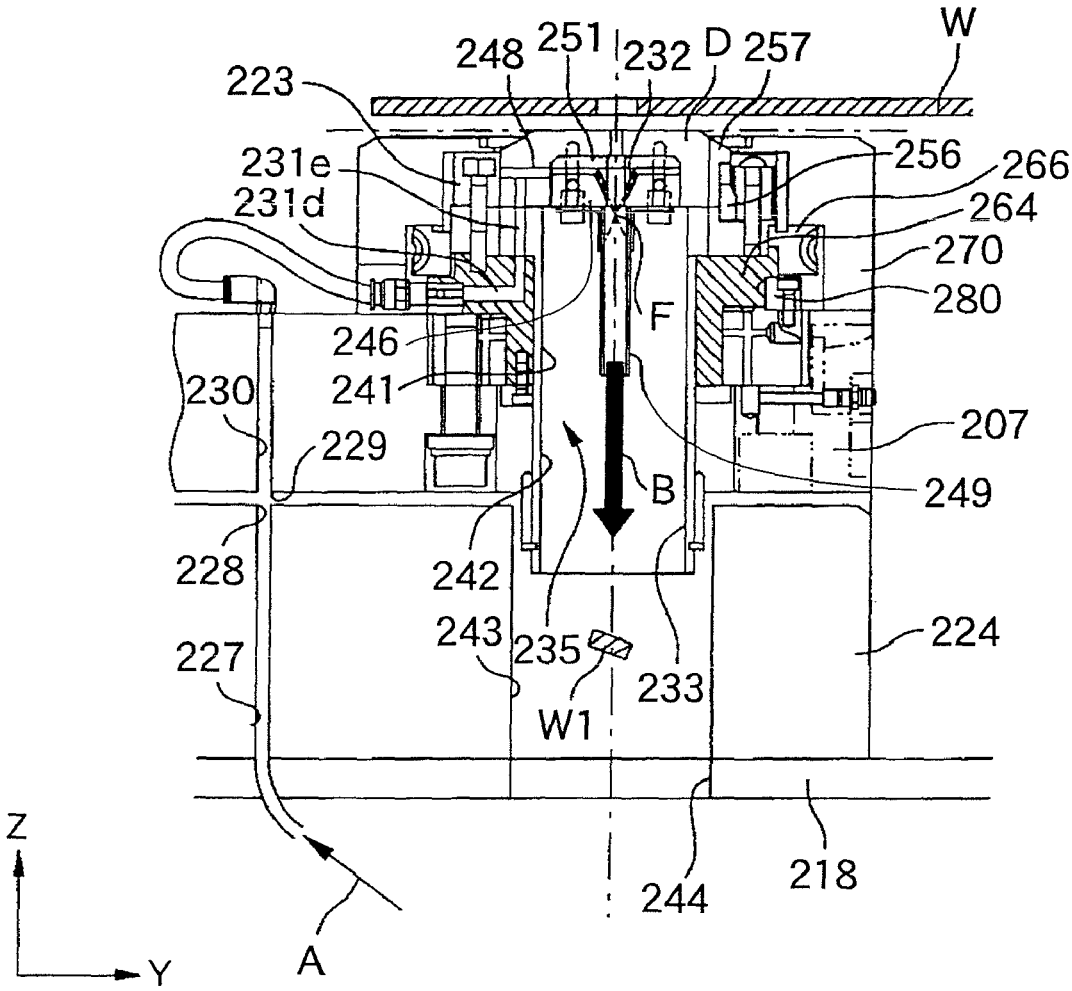
FIG. 46 is a partial sectional front view showing the fourth embodiment (in the case of metal molds P and D of 2 inches)

FIGS. 40 and 41 show a third embodiment of the present invention, and FIGS. 45 and 46 show a fourth embodiment in which the third embodiment is modified. The third embodiment is for a small diameter (for example, 1·¼ inches) and the fourth embodiment is for a large diameter (for example, 2 inches). In the drawings, communication pipes 230 upwardly extend from the air introducing port 229 on the lower turret 207 and penetrate the lower turret 207 and enter a later-described annular groove 231*a*.

The third embodiment of the invention will be explained with reference to FIGS. 38 to 49.

In FIGS. 40 and 41, a die D is mounted on a die holder 223 through a key 256 and a key groove 257. The die holder 223 includes the worm wheel 266 and is threadedly engaged with the rotatable die receiver 264. The die receiver 264 is provided at its outer surface with the annular groove 231*a*.

A flange of an ejector pipe 233 on which the die D is placed is engaged with a shoulder 240A of an insertion hole 240 of the die receiver 264. The ejector pipe 233 extends downward and is concentrically disposed with respect to a scrap discharge hole 235. The scrap discharge hole 235 comprises and opening 241 of the die receiver 264, an opening 242 of the lower turret 207, an opening 243 of the disk support 224 and an opening 244 of the lower frame 218. With this structure, the die D is pushed up when the metal mold is replaced as is well known.

The die D is placed on the ejector pipe 233 and is mounted on the die holder 223. The die holder 223, the die receiver 264, the worm wheel 266 and a ring member 280 are covered with a housing 270 on the lower turret 207.

The annular groove 231*a* formed in the outer surface of the die receiver 264 is closed with the ring member 280 fixed to the lower turret 207. With this structure, an annular air passage is formed. The air passage is in communication with the communication pipe 230 connected to the air source 225 (FIG. 38).

Holes 231*b* horizontally penetrating between the die receiver 264 and the opening 241 are provided in the annular groove 231*a* on the outer surface of the die receiver 264.

Two through holes 231*b* are provided (FIG. 40). Each of the through holes 231*b* is in communication with an annular groove 231*c* on the outer surface of the ejector pipe 233. The through hole 231*b* is formed with a plurality of injecting ports 232 which downwardly incline toward the inside of the ejector pipe 233.

Figure 43:
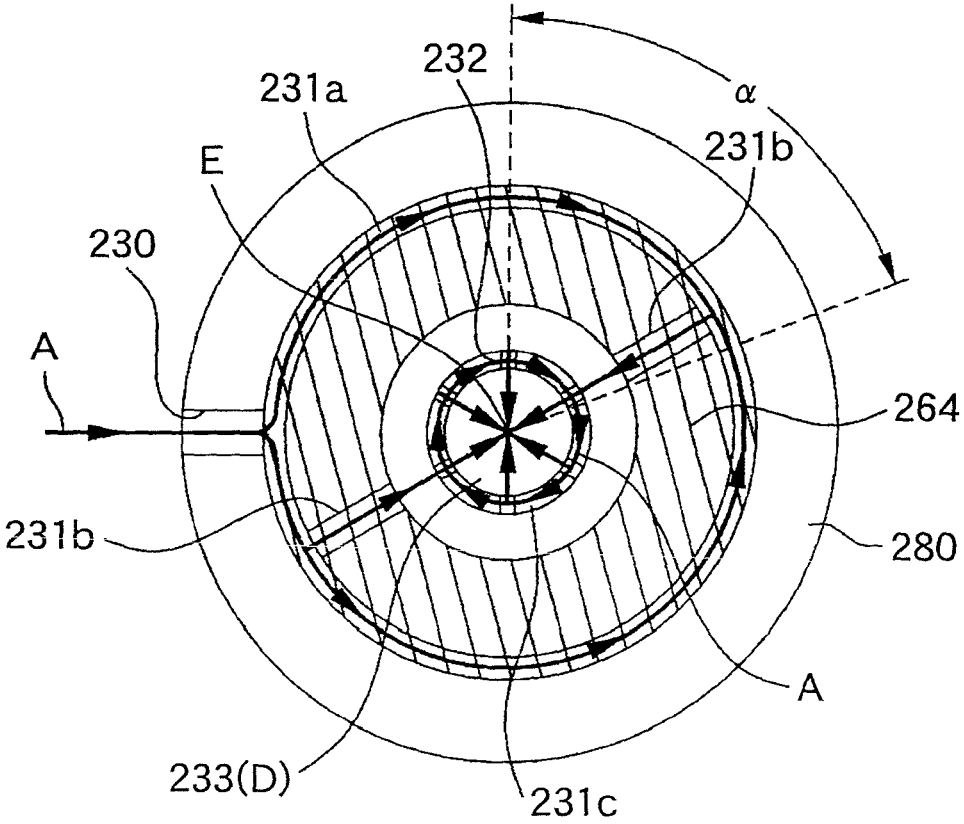
FIG. 43 is a plan view for explaining the effect of an apparatus shown in FIGS. 40 and 41.
Figure 44:
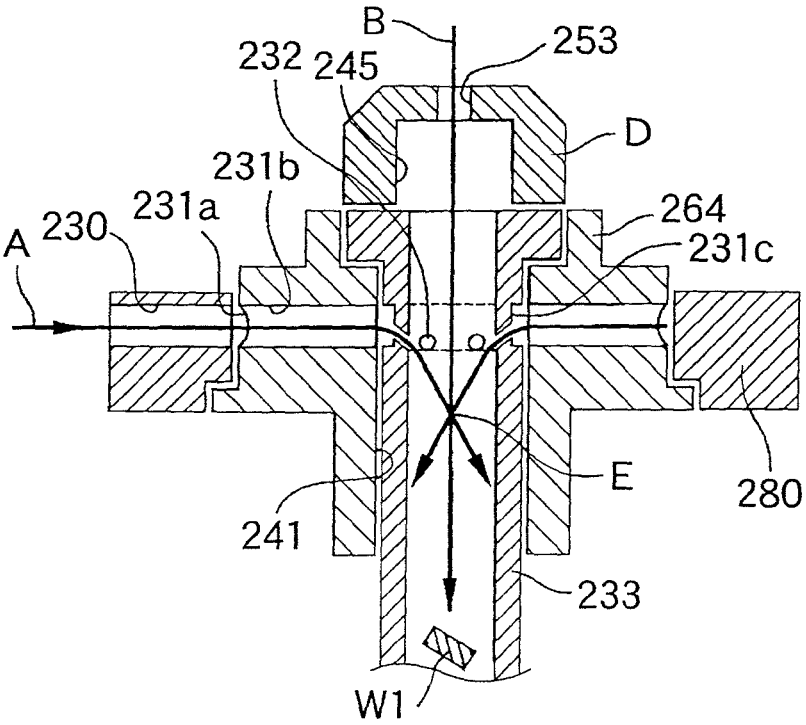
FIG. 44 is a partial sectional front view for explaining the effect of the apparatus shown in FIGS. 40 and 41.

With this structure, the punch P and the die D are positioned on the punch center C and then, when the punch receiver 263 and the die receiver 264 are rotated, the die D is rotated through desired angle α (FIG. 43).

When the work is started in this state, air A passes through the communication pipe 230 and circulates through the annular groove 231*a* of the die receiver 264 which rotated through the desired angle α.

With this structure, no matter which angle α (FIG. 43) the die receiver 264, i.e., the die D is positioned, air A supplied from outside passes through the two horizontal through holes 231*b* from the annular groove 231*a* of the die receiver 264, and enters the annular groove 231*c* of the ejector pipe 233 and is injected to inside of the ejector pipe 233 from the injecting ports 232.

With this structure, since the air A injected from the injecting ports 232 (FIG. 44) is converged to the position E in the ejector pipe 233, a negative pressure is generated below a die hole 253, and the outside air B is sucked through the die hole 253 with the negative pressure.

Therefore, a scrap W1 generated when the workpiece W (FIG. 41) is worked is strongly sucked downward from the die hole 253, and the scrap W1 is forcibly discharged outside from the scrap escape hole 245 through the scrap discharge hole 235, and the scrap floating is prevented.

FIGS. 45 and 46 correspond to the third embodiment in that the die D is mounted on the die holder 223, the die holder 223 is mounted on the rotatable die receiver 264, and the annular groove 231*a* is provided in the outer surface of the die receiver 264. However, FIGS. 45 and 46 are different as the third embodiment mainly in that the nozzle member 246 is incorporated in the die D, the nozzle member 246 is provided with the injecting ports 232, the introducing portion which introduces air A from the annular groove 231*a* to the injecting ports 232 extends upward (FIG. 49), and the lower surface of the nozzle member 246 is provided with the duct 249.

With this structure, as is well known, a negative pressure generating position F is set closer to the die hole 253, the negative pressure is increased, suction of air B sucked from outside through the die hole 253 is increased, thereby preventing the large scrap floating.

That is, the nozzle member 246 is incorporated in the die D shown in FIGS. 45 and 46 through the shielding plate 251, the duct 249 is mounted on the nozzle member 246, and the duct 249 extends to about half-height position of the ejector pipe 233.

Figure 47:
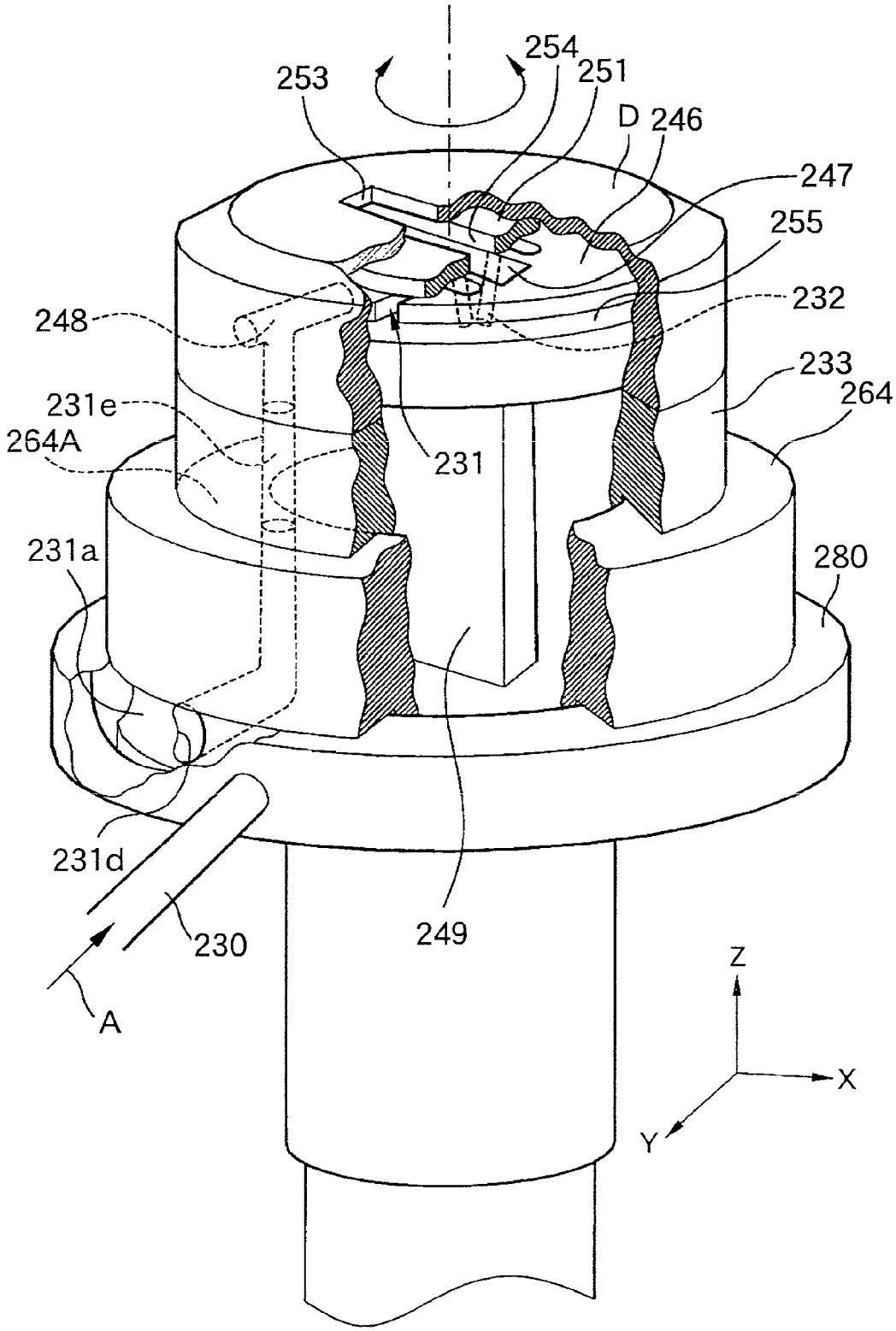
FIG. 47 is a diagram showing an air introducing portion of an apparatus shown in FIGS. 45 and 46.

The nozzle member 246 has a flat cylindrical shape (FIG. 47). The die hole 253 and a discharge hole 247 are formed in the nozzle member 246. The discharge hole 247 is in communication with a through hole 254 of the later-described shielding plate 251.

T-shaped grooves 231 are formed on both sides of the discharge hole 247 (FIG. 48) and on an upper surface 246A of the nozzle member 246. The T-shaped groove 231 constitutes a portion of an introducing portion which introduces air A to the later-described injecting ports 232 from the air circulation path 280.

The T-shaped groove 231 (FIG. 48) comprises a parallel portion 231A which is provided in the vicinity of the discharge hole 247 and which is in parallel thereto, and a portion 231B which is in communication with the parallel portion 231A and which intersects with the parallel portion 231A and extends outward.

As shown in the drawing, the parallel portion 231A is formed with the plurality of injecting ports 232 in the longitudinal direction. Each injecting port 232 is downwardly inclined toward the discharge hole 247.

A step or level is formed on an outer periphery of the upper surface 246A of the nozzle member 246 and this portion is lowered by one level, and an annular downwardly inclined air passage 255 is formed.

The intersecting portion 231B constituting the T-shaped groove 231 is in communication with this annular air passage 255.

The shielding plate 251 is made of nylon, for example. The shielding plate 251 shields the upper surface 246A of the nozzle member 246 so that the T-shaped groove 231 and the air passage 255 on the outer periphery are closed. The shielding plate 251 has a function for bringing the nozzle member 246 into tight contact with a wall surface of a scrap escape hole 245 of the die D. The shielding plate 251 is formed at its central portion with a through hole 254 having an opening which is substantially the same size as that of the discharge hole 247 of the nozzle member 246.

The duct 249 is of rectangular parallelepiped as a whole. Its opening is slightly larger than that of the discharge hole 247 of the nozzle member 246. Brackets 252 are mounted on both sides of the duct 249.

The duct 249 converges air A injected from the injecting ports 232 to the position F (FIG. 49), and generates a great negative pressure generated around the position F. The duct 249 converges outside air sucked from the die hole 253 with the negative pressure to a narrow region, thereby strengthening the suction, and allowing the scrap W1 sucked by the strengthened suction to pass.

In the case of FIGS. 45 and 46, similarly, the die holder 223 is mounted on the die receiver 264 and the die receiver 264 is provided at its outer surface with the annular groove 231*a*.

The die receiver 264 is provided with an L-shaped through hole 231*d* which passes through between the annular groove 231*a* and an upper surface 264A. The L-shaped through hole 231*d* is in communication with a vertical through hole 231*e* provided in a flange of the ejector pipe 233. The vertical through hole 231*e* is in communication with a reversed L-shaped through hole 248 provided in the die D. The reversed L-shaped through hole 248 is in communication with an intersecting portion 231B of the left T-shaped groove 231 (FIG. 48).

Figure 48:
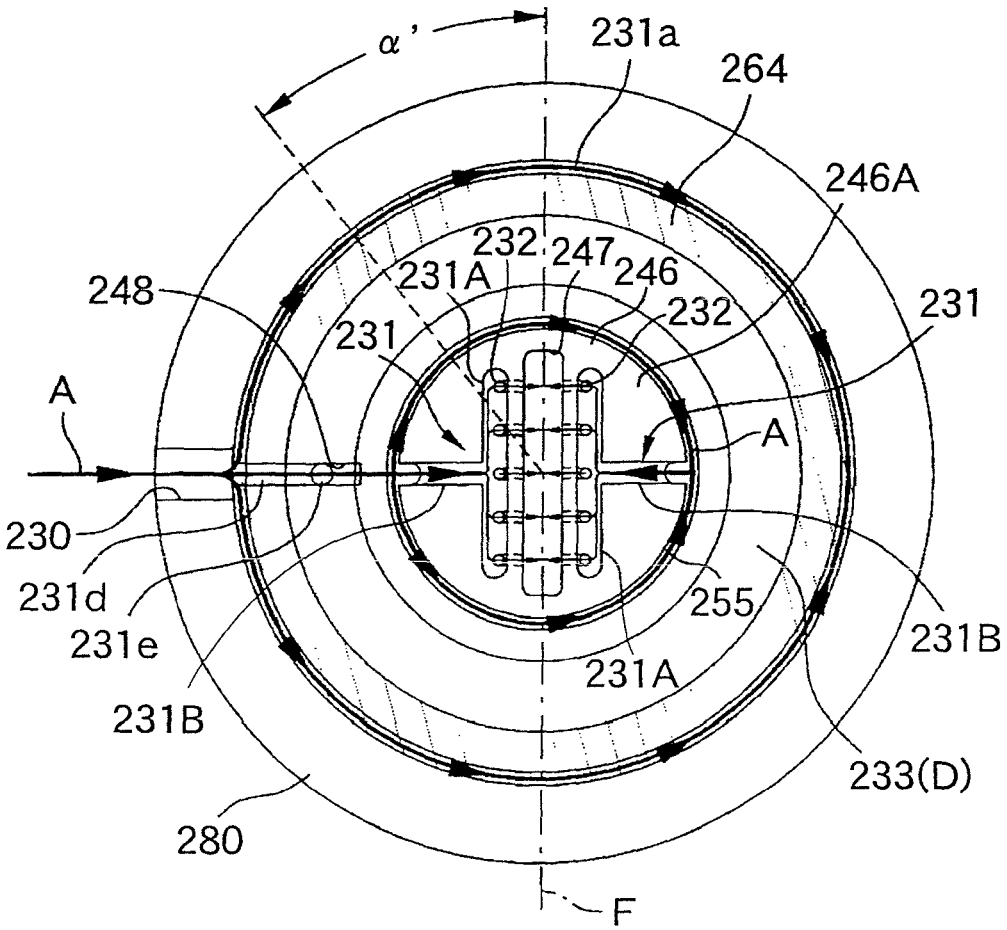
FIG. 48 is a plan view for explaining the effect of the apparatus shown in FIGS. 45 and 46.
Figure 49:
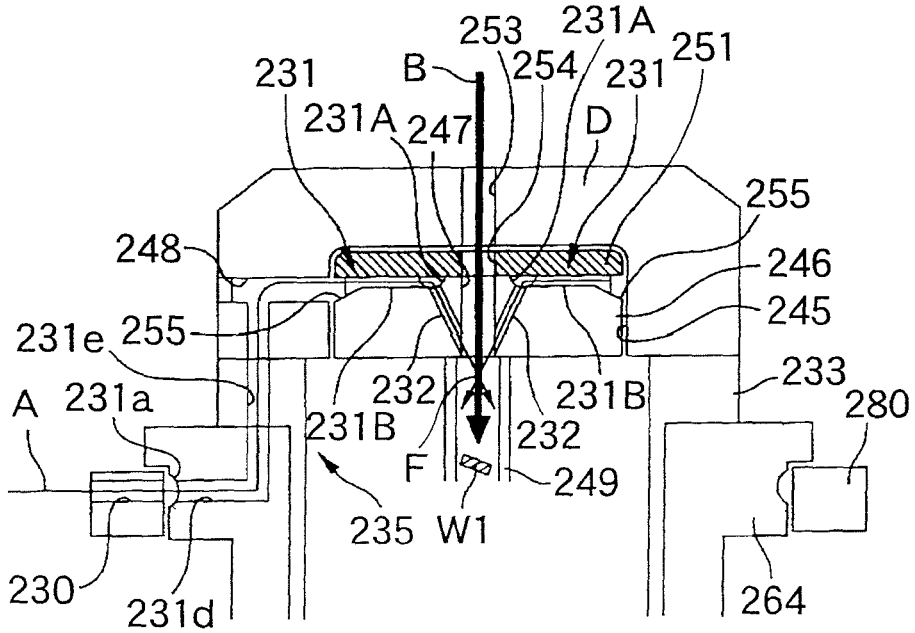
FIG. 49 is a partial sectional front view for explaining the effect of the apparatus shown in FIGS. 45 and 46.

With this structure, after the punch P and the die D are positioned on the punch center C, when the punch receiver 263 and the die receiver 264 are rotated, the die D is rotated through desired angle α' (FIG. 48).

When the work is started in this state, air A passes through the communication pipe 230 and circulates through the annular groove 231*a* of the die receiver 264 which rotated through the desired angle α'. With this structure, no matter which angle α' (FIG. 48) the die receiver 264, i.e., the die D is positioned, air A supplied from outside passes through the L-shaped through hole 231*d* (FIG. 49) of the die receiver 264 while circulating through the annular groove 231*a* of the die receiver 264 and flows upward, and the air A enters the vertical through hole 231*e* of the flange of the ejector pipe 233. The air A passes through the T-shaped groove 231 on the nozzle member 246 from the reversed L-shaped through hole 248 of the die D and is injected from the injecting ports 232.

In this case, air A (FIG. 48) entering from the reversed L-shaped through hole 248 of the die D passes through the intersecting portion 231B of the left T-shaped groove 231, enters the parallel portion 231A and is injected from the injecting ports 232. On the other hand, air A circulates through the annular air passage 255 and passes through the intersecting portion 231B of the right T-shaped groove 231 and then, enters the parallel portion 231A and is injected from the injecting ports 232 similarly.

With this structure, as described above, air A injected from the injecting ports 232 on both sides of the discharge hole 247 (FIG. 49) of the nozzle member 246 is converged to the position F in the duct 249 directly below the outlet of the discharge hole 247. Thus, a great negative pressure is generated below the die hole 253.

Therefore, based on this great negative pressure, a large amount of outside air B is sucked through the die hole 253, the large amount of air B passes through the through hole 254 of the shielding plate 251 and the discharge hole 247 of the nozzle member 246 and then, is concentrated in the duct 249 and passes therethrough.

With this structure, a scrap W1 generated when the workpiece W is worked (FIG. 46) is strongly sucked downward from the die hole 253, the scrap W1 is forcibly discharged outside through the through hole 254 of the shielding plate 251 and the discharge hole 247 of the nozzle member 246. Even when the scrap W1 is large and is made of large bore metal mold, scrap floating can be prevented easily.

When the nozzle member 246 is incorporated in the die D, as is well known, the shielding plate 251 is placed on the upper surface 246A of the nozzle member 246, its through hole 254 is aligned with the discharge hole 247 of the nozzle member 246, the shielding plate 251 is abutted against the ceiling of the scrap escape hole 245, the inlet of the duct 249 is aligned with the outlet of the discharge hole 247 of the nozzle member 246 and in this state, a bracket 252 is abutted against the lower surface of the nozzle member 246.

In this state, bolts 260 are inserted through holes 258 and 259 from below the nozzle member 246 and threadedly engaged with the ceiling of the scrap escape hole 245 of the die D, and bolts 261 are inserted through holes 262 from below the bracket 252 and threadedly engaged with the lower surface of the nozzle member 246. With this structure, in a state where the duct 249 is mounted through the shielding plate 251, the nozzle member 246 is brought into tight contact with the wall surface of the scrap escape hole 245, and the nozzle member 246 can be incorporated in the die D.

With this structure, the inlet of the intersecting portion 231B constituting the left T-shaped groove 31 (FIG. 49) comes into communication with the air inlet 248 of the die D, the T-shaped grooves 231 on both sides of the discharge hole 247 are closed by the shielding plate 251, and the annular air passage 255 on the outer periphery of the nozzle member 246 is closed by the wall surface of the scrap escape hole 245 of the die D and the shielding plate 251.

The original workpiece W from which the scrap W1 is sheared is grasped by a clamp 213 (FIG. 38) during working. The clamp 213 is mounted on a carriage 212.

The carriage 212 is mounted on a carriage base 211 through an X-axis guide rail 216. A ball screw 215 of an X-axis motor Mx is threadedly engaged with the carriage 212.

The carriage base 211 is slid and coupled to a Y-axis guide rail 217 on the lower frame 218, and a ball screw 214 of a Y-axis motor My is threadedly engaged with the carriage base 211.

With this structure, when the X-axis motor Mx and the Y-axis motor My are operated, the carriage 212 moves on the carriage base 211 in the X-axis direction and the carriage base 211 moves in the Y-axis direction. Therefore, the workpiece W grasped by the clamp 213 mounted on the carriage 212 can be transferred on a work table 210 and positioned on the punch center C, and punching operation is carried out, for example.

A control apparatus of the turret punch press having the above-described structure comprises an NC apparatus 250 (FIG. 38). The NC apparatus 250 comprises a CPU 250A, a work controller 250B, a turret rotation controller 250C, a metal mold rotation controller 250D, a striker position controller 250E, an input/output unit 250F, a storage 250G, a workpiece positioning controller 250H.

The CPU 250A is a determination main unit of the NC apparatus 250. The CPU 250A controls the entire apparatus shown in FIG. 38 such as the work controller 250B, the turret rotation controller 250C and the metal mold rotation controller 250D.

The work controller 250B operates the ram cylinder 219, and lowers the striker 202 positioned on the predetermined one of the track positions C1, C2, and C3, allows the striker 202 to strike a selected punch P, carries out predetermined work for the workpiece W in cooperation with a corresponding die D, or the work controller 250B operates the air source 225 during working, and supplies air A through the air supply port 228 connected to the air source 225.

The turret rotation controller 250C operates the motor M to rotate the turrets 206 and 207 around a turret center R, and positions the holders 222 and 223 on which desired metal molds P and D to be selected are mounted on the punch center C.

After the desired metal molds P and D is positioned on the punch center C, the metal mold rotation controller 250D operates the motor 279 (FIG. 39) to rotate the punch receiver 263 and the die receiver 264, thereby rotating the metal molds P and D through desired angle.

The striker position controller 250E operates the striker cylinder 221 to position the striker 202 on predetermined one of the track positions C1, C2, and C3, switches the switching valve 234 such as to match the track positions C1, C2, and C3 of the striker 202 based on a feedback signal from the encoder of the striker cylinder 221 as described above, and connects only the corresponding air supply port 228 on the upper surface of the disk support 224 to the air source 225.

The input/output unit 250F inputs a work program, data and the like using keys or a mouse, a user confirms the input on a screen, and the input work program and the like are stored in the storage 250G.

The workpiece positioning controller 250H drives an X-axis motor Mx and a Y-axis motor My, and positions the workpiece W grasped by the clamp 15 on the punch center C.

The operation of the present invention having the above structure will be explained below.

For example, when a workpiece W is transferred from a workpiece transfer apparatus (not shown) to the turret punch press (FIG. 38), the CPU 250A detects this operation. The CPU 250A controls the workpiece positioning controller 250G and drives the X-axis motor Mx and the Y-axis motor My, and positions the workpiece W grasped by the clamp 15 on the punch center C.

The CPU 250A then operates the motor M through the turret rotation controller 250C, rotates the turrets 206 and 207 in synchronism with each other, and positions the holders 222 and 223 on which desired metal molds P and D to be selected on the punch center C.

The CPU 250A operates the motor 279 (FIG. 39) through the metal mold rotation controller 250D to rotate the punch receiver 263 and the die receiver 264, thereby rotating the metal molds P and D through desired angle α (FIG. 43) or α' (FIG. 48), for example.

The CPU 250A then operates the striker cylinder 221 through the striker position controller 250E, positions the striker 202 on predetermined track positions C1, C2, and C3 of the metal molds P and D to be selected and then, controls the work controller 250B to operate the ram cylinder 219, and lowers the positioned striker 202 to strike the selected punch P, and carries out predetermined work for the workpiece W in cooperation with the corresponding die D.

For example, the number of tracks is one as in this invention (FIGS. 40, 41, 45, and 46), the striker 2 is positioned on the middle track position C2. In this state, when the ram cylinder 219 is operated, the workpiece W (FIGS. 41 and 46) is subjected to the punching work in cooperation with the punch P and the die D, and a scrap W1 is generated.

At the same time, the CPU 250A (FIG. 38) controls the striker position controller 250E, switches the switching valve 234 such as to match the track position C2 of the striker 202 based on a feedback signal from the encoder of the striker cylinder 221, and connects only the corresponding air supply port 228 on the upper surface of the disk support 224 to the air source 225.

With this structure, air A supplied from the corresponding air supply port 228 connected to the air source 225 passes through the communication pipe 230 from the air introducing port 229, and the air A circulates through the annular groove 231*a* of the die receiver 264 which is rotated through the desired angle α or α'.

With this structure, no matter which angle α or α' the die receiver 264, i.e., the die D is positioned, air A supplied from outside passes through the introducing portion from the air circulation path 280 and is injected from the downwardly inclined injecting ports 232 and converged to the position E or F. Thus, air B is sucked from the die hole 253 from a negative pressure generated below the die hole 253, and the scrap W1 generated when the workpiece W is worked is strongly sucked downward of the die hole 253 and is forcibly discharged outside.

According to the present invention as described above, in a die apparatus in which a die having a die hole for punching the workpiece is mounted on the die holder, and the die holder is mounted on the rotatable die receiver, the annular groove is provided in the outer surface of the rotatable die receiver for circulating air supplied from outside. The injecting ports downwardly inclined from the annular groove toward the scrap discharge hole are provided with the air introducing portions for introducing air. With this structure, in the turret punch press having the metal mold rotation mechanism, no matter which angle the metal mold is positioned, air can be supplied. Therefore, there is an effect that the scrap floating prevention mechanism using air can also be applied to the rotating metal mold and the application range is widened.

A fifth embodiment of the present invention will be explained with reference to FIGS. 50 to 54.

Figure 50:
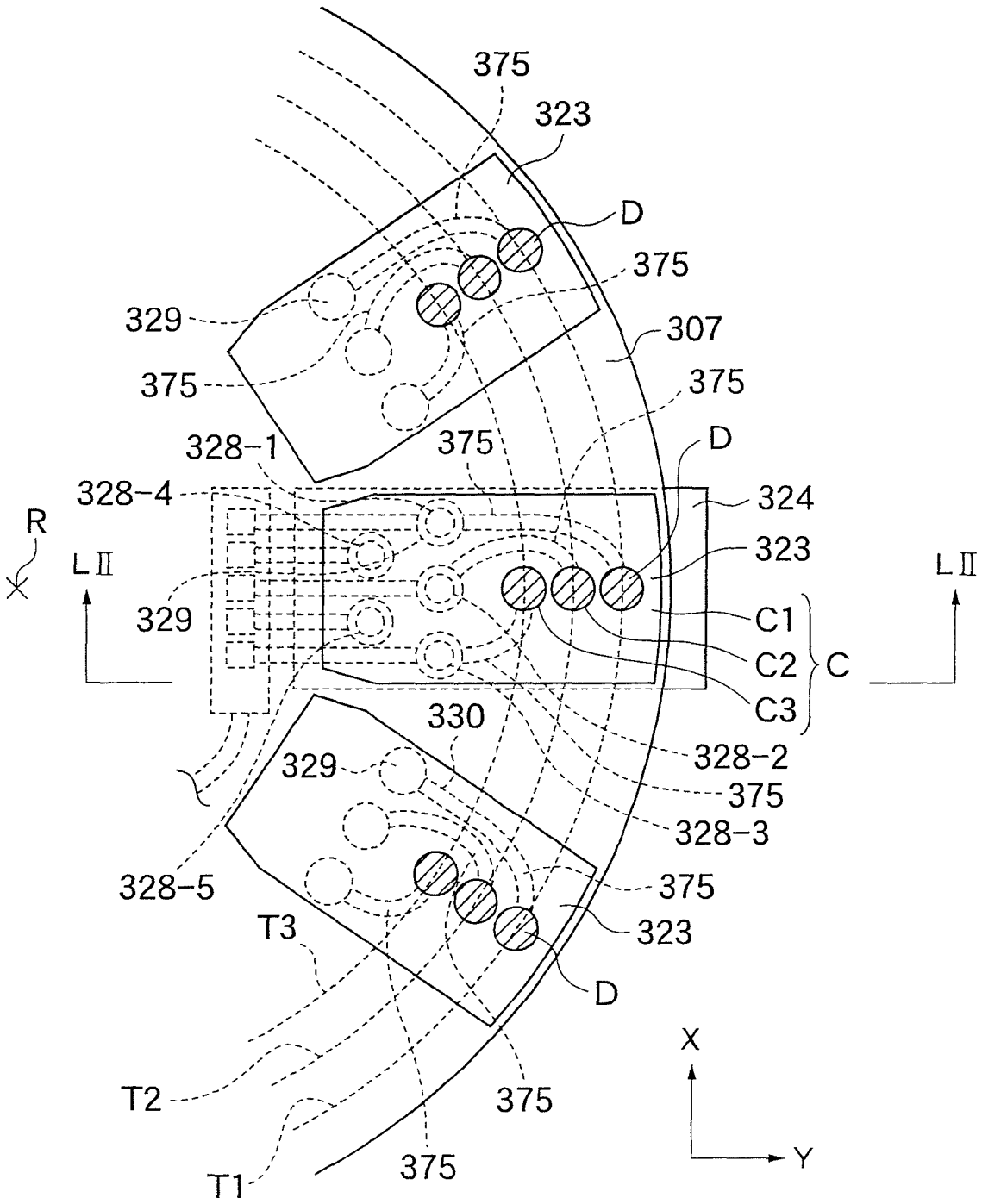
FIG. 50 is a partial plan view showing an air introducing portion according to a fifth embodiment of the present invention.
Figure 52:
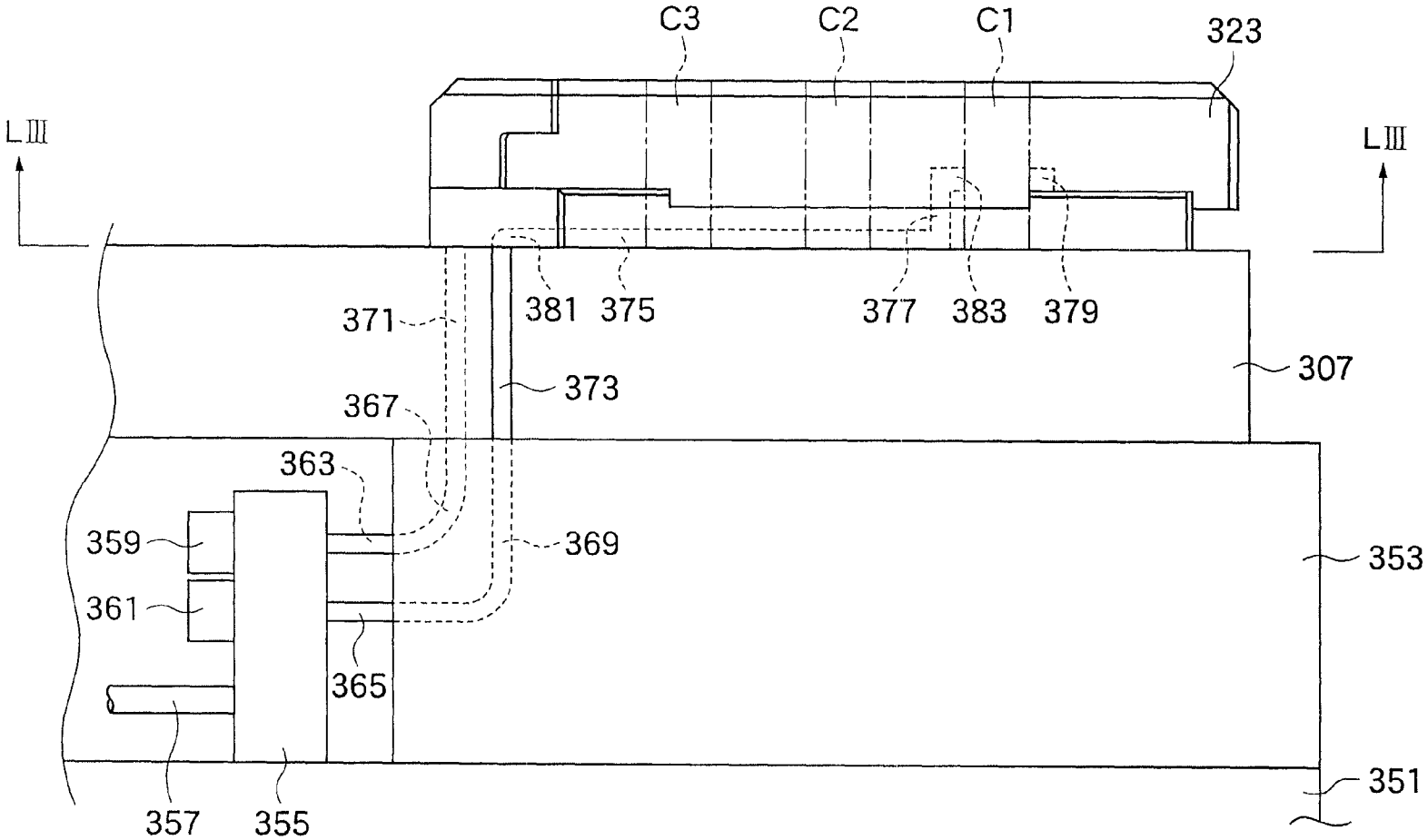
FIG. 52 is a sectional view taken along the arrows LII-LII in FIG. 50.
Figure 53:
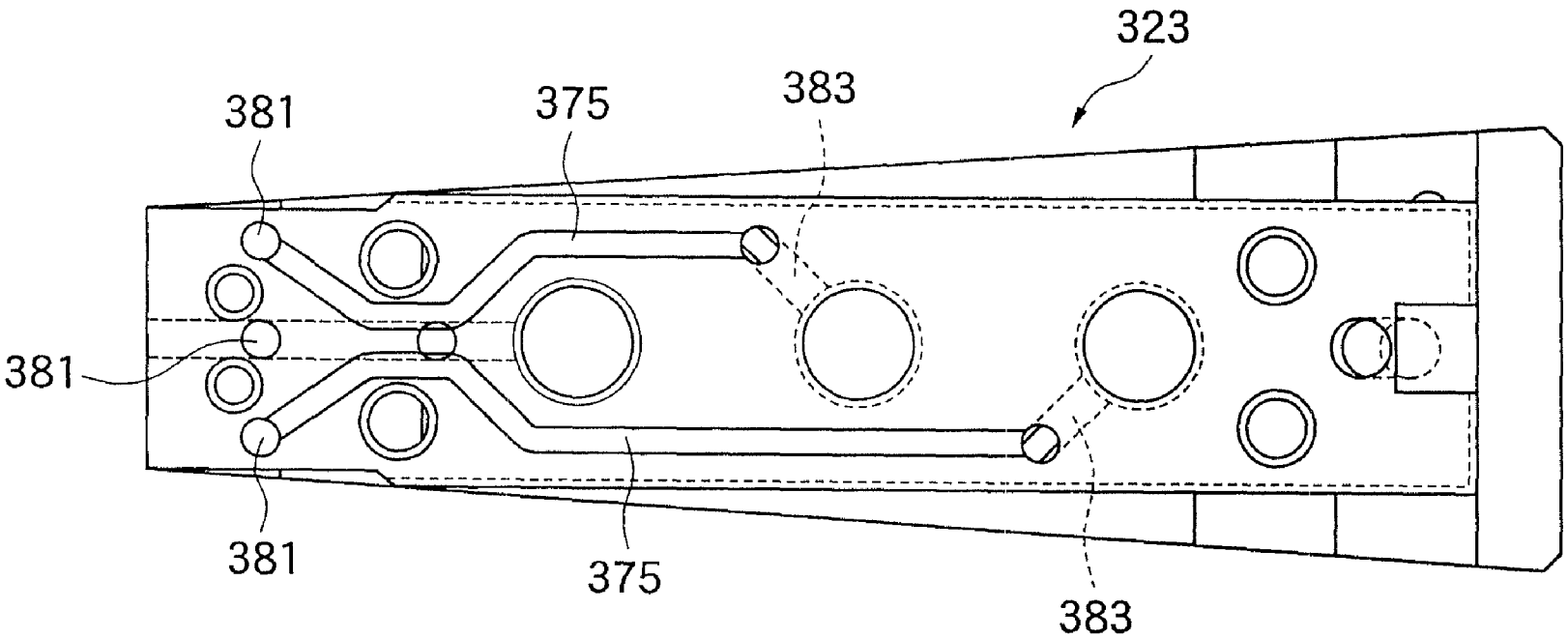
FIG. 53 is a sectional view taken along the arrows LIII-LIII in FIG. 52.

In this embodiment, as shown in FIGS. 50 and 52, an air supply pipe 357 is connected to a manifold 355, and air is supplied to communication holes 367 and 369 formed in a disk support 353 by communication pipes 363 and 365 through switching valves 359 and 361. Air supplied to the communication holes 367 and 369 is supplied to communication holes 371 and 373 formed in a lower turret 307.

There exist three vertical communication holes 373 formed up to the upper surface of the lower turret 307. The three communication holes 373 respectively have openings 328-1, 328-2, and 328-3 (FIG. 50). On the other hand, there exist two vertical communication holes 371 formed up to the upper surface of the lower turret 307 and their upper ends respectively have three openings 328-4 and 328-5.

Therefore, there are two communication holes 367 and three communication holes 369 formed in the disk support 353, and these communication holes are in communication with five communication holes 371 and 373.

For selectively supplying air to the five communication holes 367 and 369, there are configured two switching valves designated by the numeral 359, and three switching valves designated by the numeral 361.

While FIG. 50 shows three tracks as an example, a die holder 323 capable of incorporating three dies is mounted on the lower turret 307. When the lower turret 307 rotates and stops at a desired position, all three switching valves 361 are opened, air is supplied to the three communication holes 373 formed in the lower turret 307 through the three communication holes 369, and air is supplied to a connection groove 375. The connection groove 375 is formed into such a shape that air is introduced to three die holes C1 to C3 from an opening 29 formed in the die holder 323 (FIG. 52). The connection groove 375 comes into tight contact with an upper surface of the lower turret 307 to form a pipe shape and can supply air to a desired position.

Air supplied to the connection groove 375 is supplied to a circumferential groove 379 formed around a periphery of the die hole C3 through a vertical hole 377, and is introduced into a hole formed in the die. The shape of the connection groove 375 is specifically shown in FIG. 53.

Figure 51:
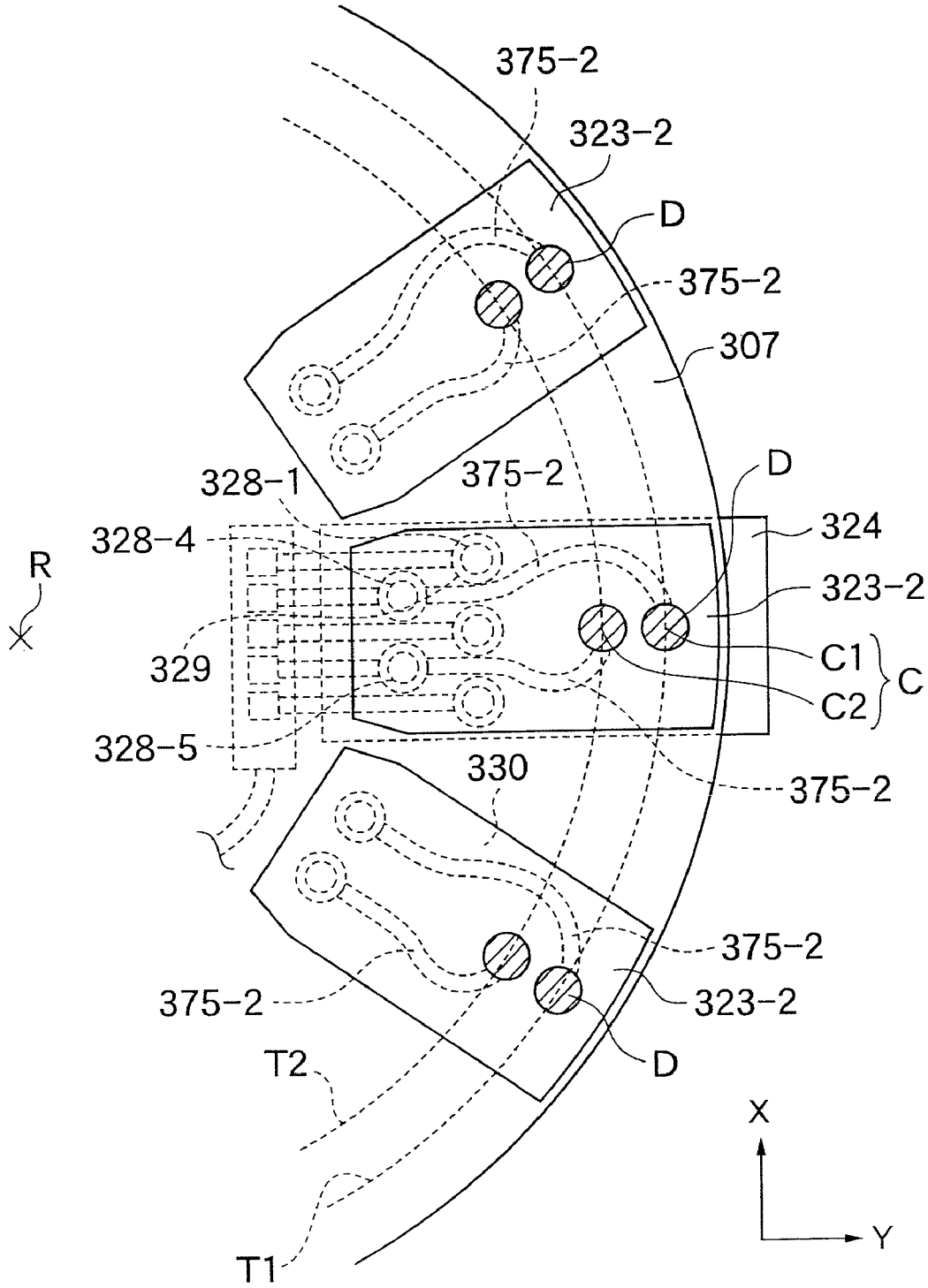
FIG. 51 is a partial plan view showing an example in which the air introducing portion according to the fifth embodiment is partially modified.

FIG. 51 shows an example in which the die holder 323-2 is formed with two die holes C1 and C2. This will be explained next.

When the lower turret 307 rotates and stops at a desired position, the two switching valves 359 are all opened, air is supplied to the two communication holes 371 formed in the lower turret 307 through the two communication holes 367, and supplied to the connection groove 375 formed in the die holder 323-2. The die holder 323-2 is formed into such a shape that air is introduced to the two die holes (C1, C2) from the opening 29 formed in the die holder 323-2.

Figure 54:
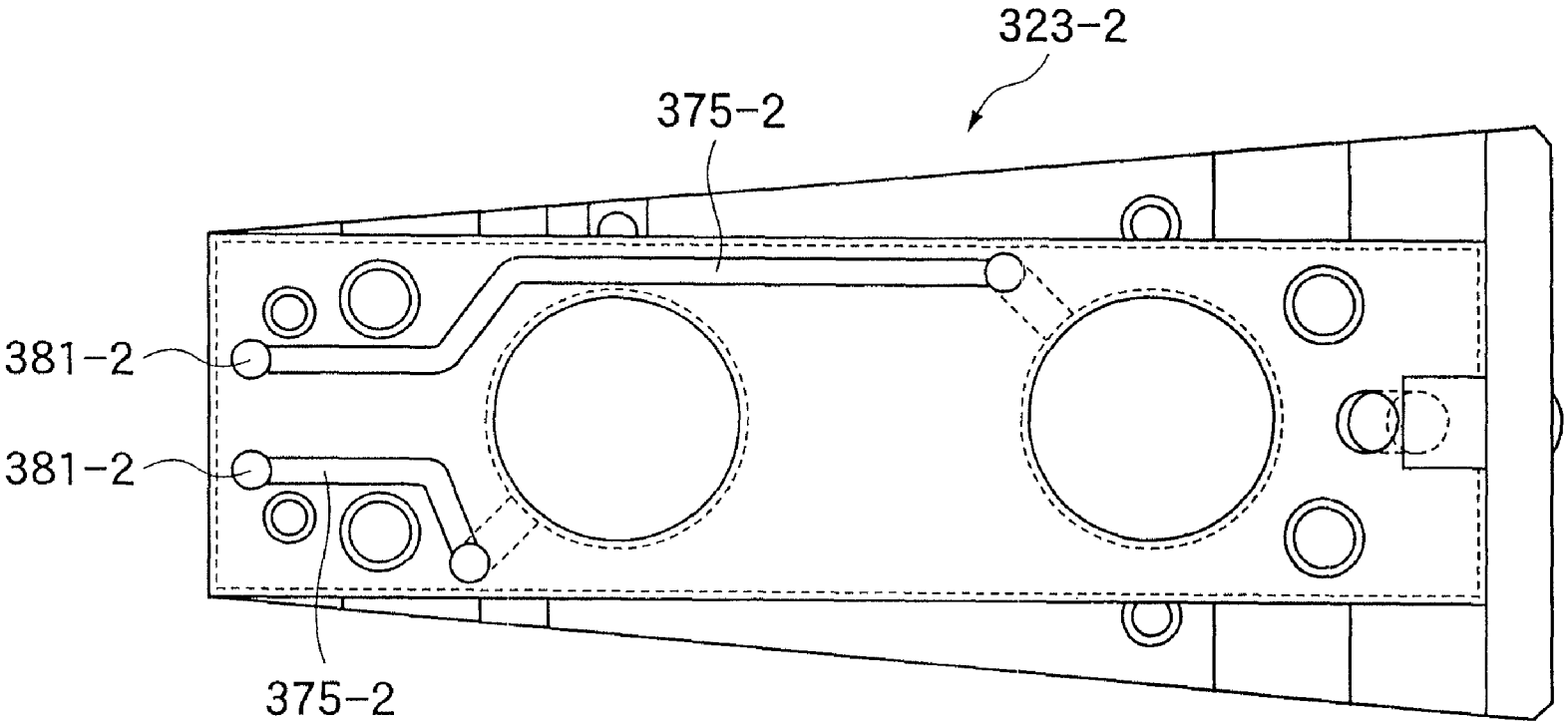
FIG. 54 is a diagram showing an example in which the air introducing portion in FIG. 53 is partially modified.

Air supplied to the connection groove 375-2 is supplied to a circumferential groove (379) formed around the periphery of the die hole through the vertical hole, and is introduced into the hole formed in the die. FIG. 54 shows the shape of the connection groove 375-2.

When one die holder (C1) is formed in the die holder 232, a connection groove can be formed in the lower surface of the die holder 323 such that air is introduced to the die holder (C1) from one of the openings 328-4 and 328-5 formed in the lower turret 307.

The two communication holes 371 and three communication holes 373 formed in the lower turret 307 can be total five communication holes including three communication holes 371 and three communication holes 373 at each corner where the die holder 323 of the lower turret 307 is placed, or a corner having three communication holes 373 and a corner having two communication holes 37 can be formed separately beforehand.

In any of the cases, since two switching valves 359 and three switching valves 361 are provided, when the five valves are appropriately switched, air can collectively be sent to a communication path for supplying air to a die where the punching work is carried out. Therefore, the effect of scrap floating prevention is enhanced.

A sixth embodiment in which a single station punch press is provided with the scrap floating prevention mechanism according to the present invention will be explained next.

Figure 55:
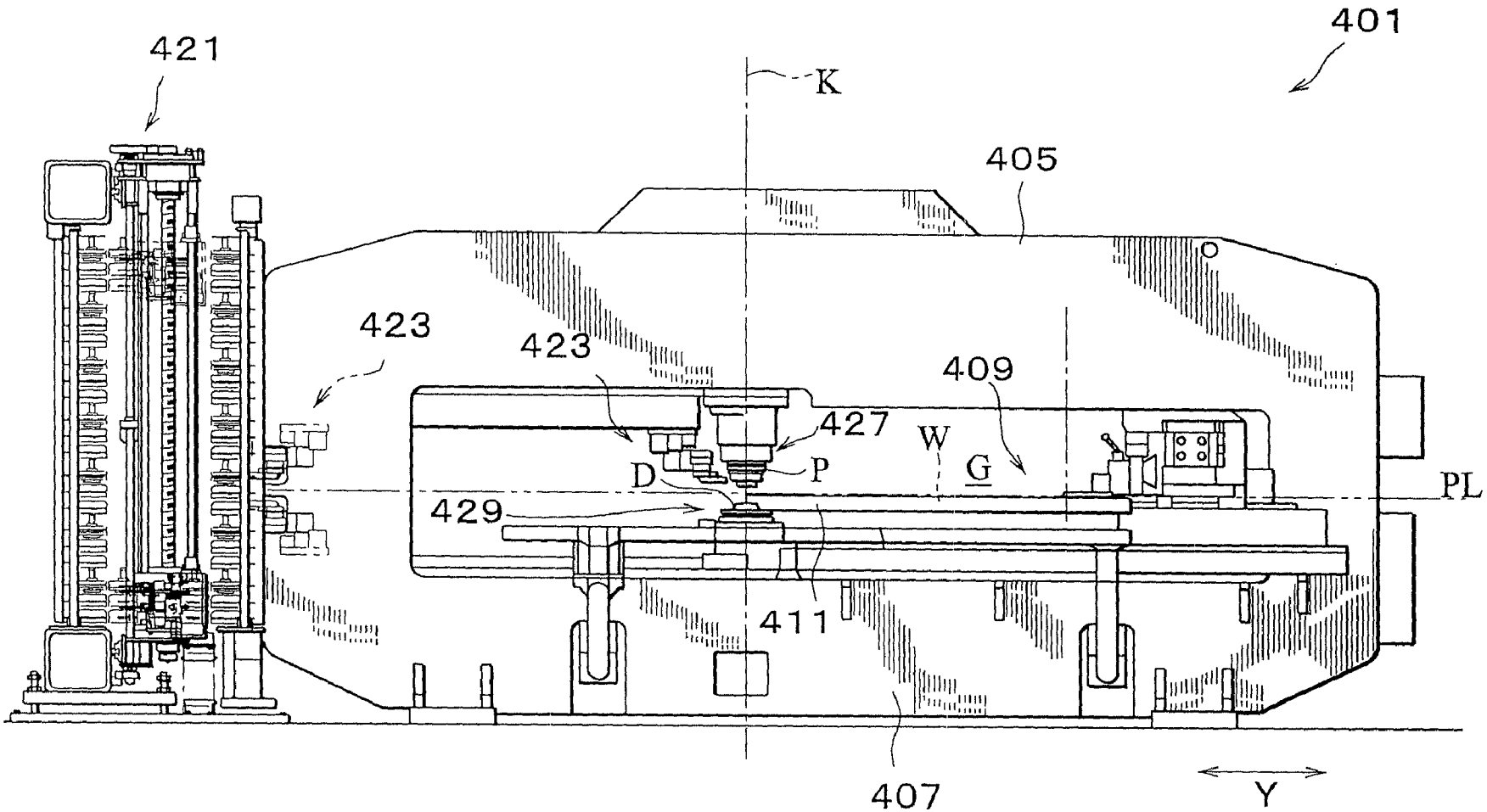
FIG. 55 is a front view of a single punch press for explaining a sixth embodiment having a scrap floating prevention mechanism according to the present invention.

FIG. 55 shows a punch press 401 of the invention. The punch press 401 has a gap G between an upper frame 405 and a lower frame 407 which constitute a portal frame. In a work position K in the gap G, a punch P is vertically supported by the upper frame 405 and a die D is vertically supported by the lower frame 407.

In the gap G, a workpiece moving/positioning apparatus 409 for supporting and positioning a workpiece W to be worked is provided in the gap G. The workpiece moving/positioning apparatus 409 is provided with a carriage base of a work table 411 at the right end in FIG. 55 so that the work table 411 moves along a pair of guide rails provided in the Y-axis (lateral direction in FIG. 55). The carriage base can moved and positioned in the Y-axis by a Y-axis motor (not shown). The carriage base includes an X carriage which can move and position in the X-axis (perpendicular direction in FIG. 55). The X carriage has a plurality of workpiece clampers for grasping the workpiece W.

With this structure, the workpiece W is grasped by the workpiece clamper and positioned on the K position and then, the punch P is struck to subject the workpiece W to the punching work in cooperation with the punch P and the die D.

On the left side of the punch press 401 in FIG. 55, there is provided a metal mold accommodating apparatus 421 for accommodating a large number of punches P and dies D. A metal mold exchanging apparatus 423 is provided between the metal mold accommodating apparatus 421 and the punch press 401. The metal mold exchanging apparatus 423 transfers a used metal mold from the punch press 401 and accommodates the same in the metal mold accommodating apparatus 421, and transfers a new metal mold to be used next to the punch press 401. On the right side of the punch press 401, there is provided a hydraulic unit for controlling hydraulic cylinder and the like.

Figure 56:
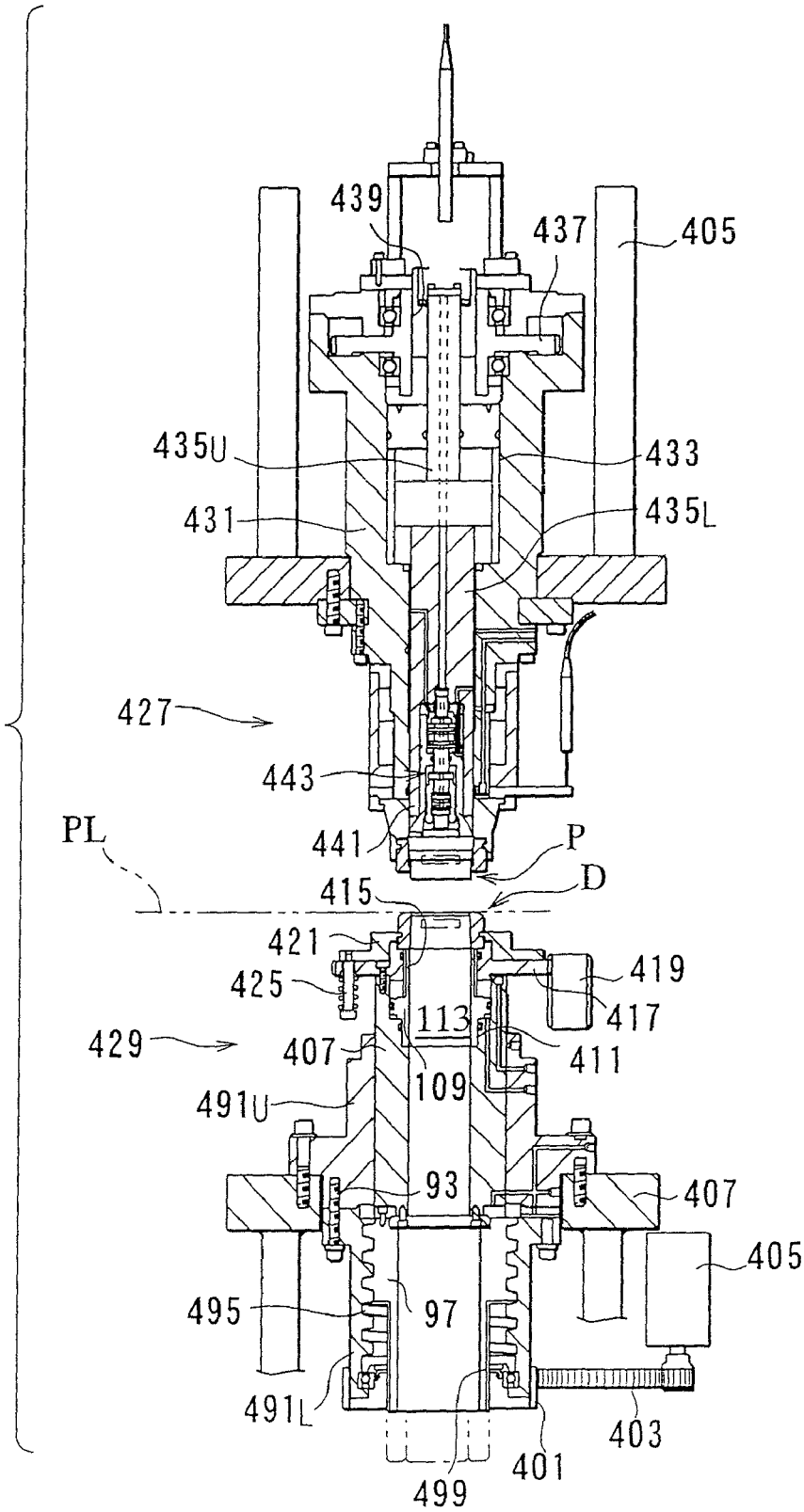
FIG. 56 is a sectional front view of a punch and a die respectively having a ram and a rotation mechanism of the single punch press.
Figure 57:
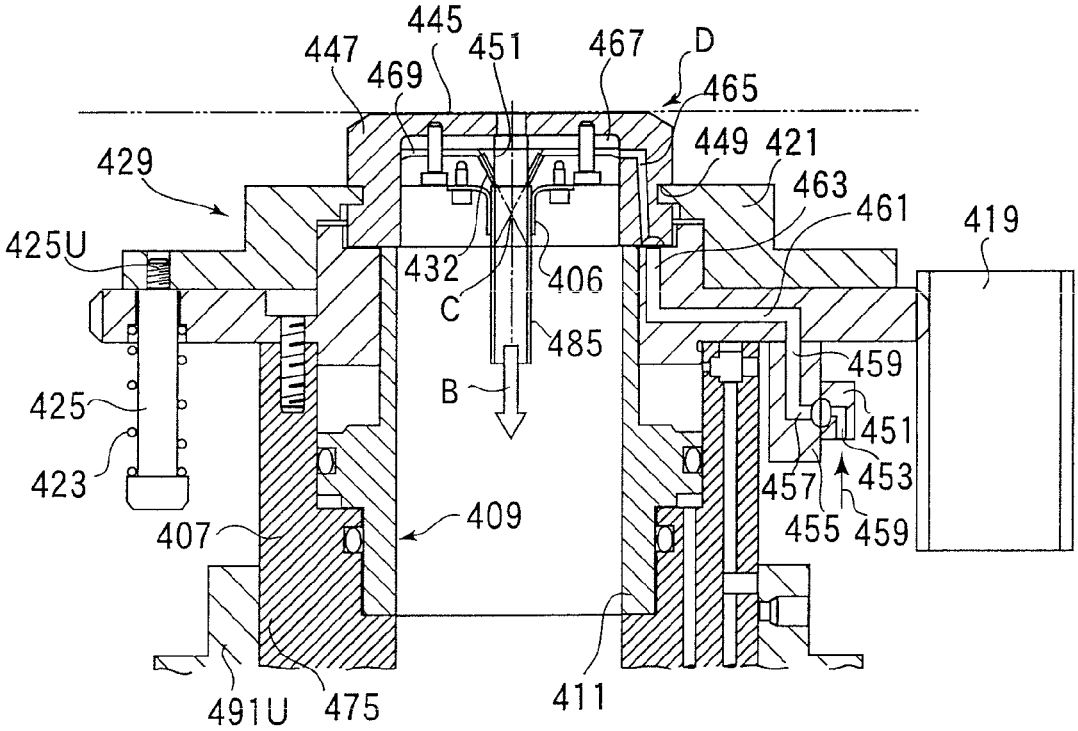
FIG. 57 is a sectional front view of a scrap floating prevention mechanism provided around the die of the single punch press.
Figure 58:
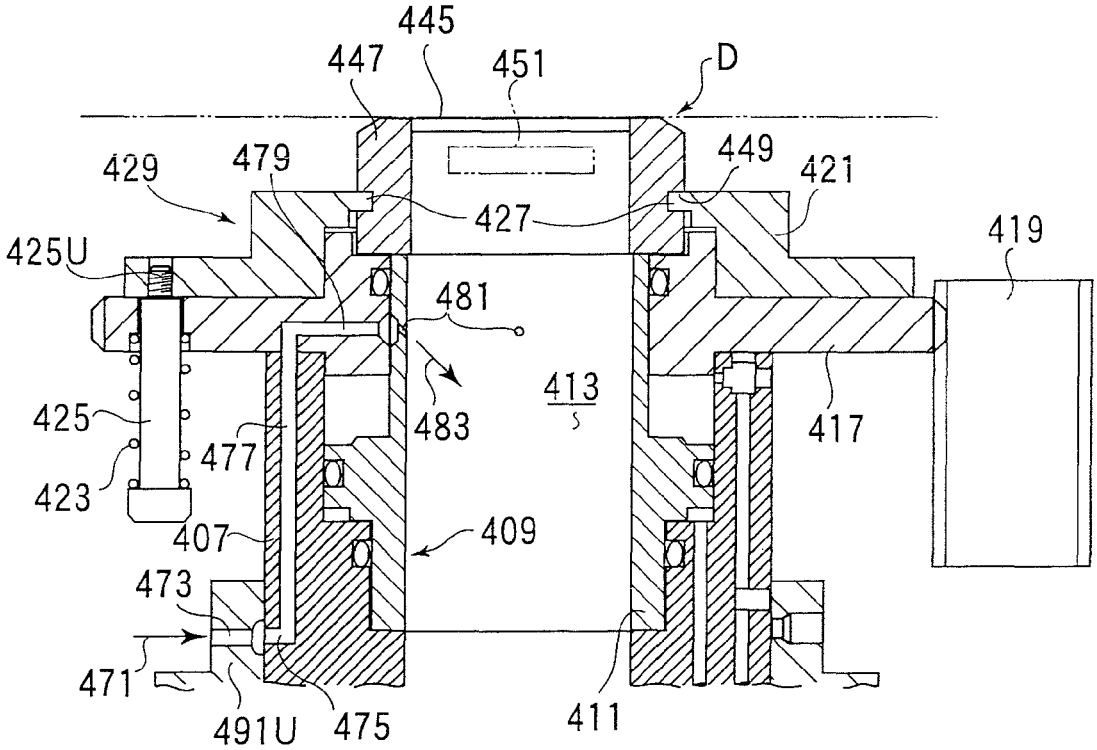
FIG. 58 is a sectional front view of a mechanism in which the scrap floating prevention mechanism shown in FIG. 57 is partially modified.

FIGS. 56 to 58 show a punch support portion 427 which supports the punch P and a die support portion 429 which supports the die D.

A cylindrical support body 431 has a step or level of the punch support portion 427. The support body 431 is fixed to the upper frame 405. A ram cylinder 433 is provided in a center space of the support body 431. An index gear 437 is mounted on an upper end of an upwardly extending upper piston rod 435U.

The index gear 437 is connected to the upper piston rod 435U by a splined portion 439 such that the index gear 437 rotates integrally with the upper piston rod 435U and relatively vertically moves. The index gear 437 is rotated through a gear (not shown) by an index motor (not shown) to rotate the punch P.

A lower piston rod 435L extends downward from the ram cylinder 433. The lower piston rod 435L is provided at its lower end with a press ram portion 441 as an upper main shaft. A workpiece W can be positioned at a work position and a metal mold exchanging height position by the ram cylinder 433. A lock mechanism 443, as a punch clamper is provided inside the press ram portion 441, and the lock mechanism 443 grasps and locks the punch P.

The lock mechanism 443 is provided such that a collet chuck can open and close. Therefore, when the collet chuck is opened and closed, punches P having desired shape and size can selectively be mounted and separated.

With reference to FIG. 56, according to the die support portion 429, cylindrical upper and lower support bodies 491U and 491L are integrally coupled to each other through a bolt 93 and fixed to the lower frame 407.

The lower support body 491L is formed at its inner peripheral surface with a screw portion 495. A vertically moving member 97 is threadedly engaged with the screw portion 495. The vertically moving member 97 can vertically move with respect to the lower support body 491L. The vertically moving member 97 is provided at its lower end with a vertically moving gear 401 through a splined portion 499 such that the vertically moving gear 401 can vertically move with respect to the vertically moving member 97 and rotate integrally with the vertically moving member 97. The vertically moving gear 401 rotates in a fixed position. The vertically moving gear 401 is rotated by a vertically moving motor 405 through a gear 403 or the like.

Therefore, when the vertically moving motor 405 rotates the vertically moving gear 401 through a gear 103 or the like, the vertically moving member 97 vertically moves along the lower support body 491L by the screw portion 495, and an upper surface of a die D at the time of work is positioned at a working height position (state shown in FIG. 57) corresponding to a pass line.

As shown in FIGS. 57 and 58, the vertically moving member 97 is provided at its upper side with a support table 407 as a lower main shaft. The support table 407 can vertically move along an inner peripheral surface of the upper support body 491U. The working height position and the metal mold exchanging height position can selectively be set. The support table 407 is provided at its upper end with a forming cylinder 409 as a fluid pressure cylinder. A space is vertically formed in the central portion of a piston rod member 411 of the forming cylinder 409 so that a scrap generated during the punching operation can be dropped and discharged.

The piston rod member 411 is provided at its upper outer peripheral surface with an index gear 417 (FIG. 56) through a splined portion 415 (FIG. 56) so that the index gear 417 can vertically move with respect to the piston rod member 411 and rotate integrally with the piston rod member 411. The index gear 417 rotates at a fixed position by an index motor 419.

The index gear 417 is provided at its upper side with a die support block 421 as a metal mold mounting portion. The die support block 421 penetrates the index gear 417 and is always biased downward by a spring 423, but an upper end screw portion 425U is threadedly inserted to the die support block 421 so that the die support block 421 rotates integrally with the index gear 417.

Therefore, when the index motor 419 rotates the index gear 417, it is possible to rotate and index the dies D.

This embodiment includes the scrap floating prevention mechanism according to the second embodiment of the present invention explained with reference to FIGS. 31 and 32. Therefore, detailed explanation of the scrap floating prevention mechanism will be omitted.

A 3.5 inch metal mold (die D) of large bore and thin blade metal mold is mounted on the scrap floating prevention mechanism shown in FIG. 57. A shielding plate 467 and a nozzle member 469 are incorporated in the die D, and the nozzle member 469 is provided with a duct 485.

A hollow cylindrical member 455 is provided below the index gear 417 of the die support portion 429. A laterally extending communication hole 457 and a vertically extending communication hole 459 are formed. The cylindrical member 455 is provided at its outer periphery with a swivel joint 451. The swivel joint 451 is flexibly jointed and supplies air to the communication hole 457. Therefore, even when the die support portion 429 is indexed at an arbitrary angle position by the index motor 419, air can be supplied to the communication hole 457 through the communication hole 453 of the swivel joint 451.

Further, air supplied to the communication hole 459 is supplied to the communication hole 465 formed in the die D through the communication holes 461 and 463 formed in the index gear 417.

The nozzle member 469 is formed with a discharge hole 451. A plurality of injecting ports 432 which are downwardly inclined toward the inside of the discharge hole 451 are formed in the nozzle member 469.

With this structure, as described in the previous embodiment based on FIG. 32, air injected from injecting ports 432 on both sides of the discharge hole 451 of the nozzle member 469 is converged to the position C in the duct 485 directly below the outlet of the discharge hole 451, a great negative pressure is generated around the position C.

Therefore, a large amount of outside air is sucked through the hole of the die D based on this great negative pressure, and the large amount of air passes through the discharge hole 451 and then, is converged to the inside of the duct 485 and passes therethrough. With this structure, a scrap W1 generated when the workpiece W is worked is strongly sucked downward from the die hole, and is forcibly discharged outside. Even when the scrap W1 is made of large bore and thin blade metal mold, scrap floating can be prevented easily.

An embodiment in which the mechanism shown in FIG. 57 is partially modified will be explained next, with reference to FIG. 58.

A scrap floating prevention mechanism shown in FIG. 58 is provided with the lower frame 407 of the die support portion 429. A laterally extending communication hole 475 and a vertically extending communication hole 477 are formed in the lower frame 407. The lower frame 407 is provided at its outer periphery with a swivel joint. The swivel joint is flexibly jointed and supplies air to the communication hole 475. The swivel joint is formed with a communication hole 473 which is in communication with the communication hole 475. Therefore, even when the die support portion 429 is indexed at an arbitrary angle position by the index motor 419, air can be supplied to the communication hole 475 through the communication hole 473 of the swivel joint.

Further, air supplied to the communication hole 477 is supplied to a plurality of communication holes 481 formed in the cylindrical member 413 through the communication hole 479 formed in the index gear 417. The cylindrical member 413 is located below the die D.

With this structure, air supplied from the swivel joint is injected from the communication hole 481, and a scrap W1 generated when the workpiece W is worked is strongly sucked downward and is forcibly discharged outside. Even when the scrap W1 is made of large bore and thin blade metal mold, scrap floating can be prevented easily.

Therefore, an air injecting negative pressure suction mechanism can be provided in a single station punch press in which a metal mold exchanging apparatus mounts a metal mold comprising a punch P and a die D on a work station. Thus, even in the single station punch press, the scrap floating can be prevented, and it is possible to carry out the work at high speed.

The disclosures of Japanese Patent Application Nos. 2002-166876 (filed on Jun. 7, 2002), 2002-210883 (filed on Jul. 19, 2002), and 2002-323501 (filed on Nov. 7, 2002) are incorporated by reference herein in their entirety.

The embodiments of the present invention described above are to be considered not restrictive, and the invention can be embodied in other various forms, as changes are appropriately made.

The invention claimed is:

1. A scrap floating prevention mechanism, comprising:

a die holder holding a plurality of dies for punching a plate-like workpiece, the die holder being formed with a plurality of first communication pipes for sending compressed fluid, the first communication pipes being associated with the plurality of dies, respectively;

a punch holder holding a plurality of punches for punching the workpiece, one of the plurality of punches configured to be selected to punch the workpiece in cooperation with one of the plurality of dies at a work position;

a mounting table on which the die holder is placed and fixed, the mounting table being formed with a plurality of second communication pipes which are configured to communicate with the plurality of first communication pipes, respectively, for sending the compressed fluid;

a fluid injecting member provided below each of the plurality of dies, the fluid injecting member being formed with a plurality of inclined injecting pipes for injecting the compressed fluid;

a striker configured to be moved to the selected one of the plurality of punches to strike the selected one of the plurality of punches;

a striker position controller configured to detect and control a position of the striker; and a switching valve, controlled by the striker position controller, configured to selectively send the compressed fluid only to the one of the plurality of second communication pipes corresponding to the one of the plurality of dies that is to punch the workpiece together with the selected one of the plurality of punches, wherein the injecting pipes inject the compressed fluid sent from the switching valve via the one of the plurality of second communication pipes and the one of the plurality of first communication pipes downward in a space into which a scrap punched out by the selected one of the plurality of punches and the one of the plurality of dies drops, and the mounting table is a lower turret disk of a turret punch press.

2. The scrap floating prevention mechanism according to claim 1, wherein a disk support is fixedly provided below the work position of the lower turret disk; and the disk support is provided with a third communication pipe configured to supply the compressed fluid to the plurality of second communication pipes formed in the lower turret disk.

3. The scrap floating prevention mechanism according to claim 2, wherein the third communication pipe branches within the disk support to provide a branch pipe configured to communicate with the plurality of second communication pipes.

4. The scrap floating prevention mechanism according to claim 1, wherein the plurality of dies is located on a plurality of tracks, respectively, and the plurality of tracks is formed as concentric circular paths about a rotational center of the lower turret.

5. The scrap floating prevention mechanism according to claim 4, wherein the plurality of dies are aligned along a radial direction of the plurality of tracks, and the striker is configured to move along the radial direction.

6. The scrap floating prevention mechanism according to claim 5, wherein the die holder is provided in a plurality along the radial direction, and the punch holder is provided in a plurality along the radial direction.

7. The scrap floating prevention mechanism according to claim 1, further comprising a single source connected to the switching valve for supplying the compressed fluid to the switching valve.

8. The scrap floating prevention mechanism according to claim 1, wherein the punch holder is provided on an upper turret disk of the turret punch press, the lower turret disk and the upper turret disk are configured to rotate in synchronism with each other, the striker is provided above the upper turret disk.

* * * * *